US008673526B2

(12) United States Patent
Sonobe et al.

(10) Patent No.: US 8,673,526 B2
(45) **Date of Patent: *Mar. 18, 2014**

(54) ELECTROPHOTOGRAPHIC PHOTORECEPTOR, PROCESS CARTRIDGE, AND IMAGE FORMING APPARATUS

(75) Inventors: Kenya Sonobe, Tokyo (JP); Katsumi Nukada, Kanagawa (JP); Wataru Yamada, Kanagawa (JP); Takatsugu Doi, Kanagawa (JP); Tsuyoshi Miyamoto, Kanagawa (JP); Yuko Iwadate, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 146 days.

This patent is subject to a terminal disclaimer.

(21) Appl. No.: 13/197,399

(22) Filed: Aug. 3, 2011

(65) Prior Publication Data

US 2012/0196214 A1 Aug. 2, 2012

(30) Foreign Application Priority Data

Jan. 28, 2011 (JP) ..... 2011-016962

(51) Int. Cl.
*G03G 15/04* (2006.01)
*G03G 15/00* (2006.01)

(52) U.S. Cl.
USPC ..... 430/66; 430/56; 430/58.05

(58) Field of Classification Search
USPC ..... 430/56, 58.05, 58.35, 58.7, 58.75, 66, 430/69
See application file for complete search history.

(56) References Cited

U.S. PATENT DOCUMENTS

| | | | | |
|---|---|---|---|---|
| 4,599,286 | A | 7/1986 | Limburg et al. | |
| 5,427,880 | A | 6/1995 | Tamura et al. | |
| 5,695,898 | A | 12/1997 | Go et al. | |
| 6,043,334 | A * | 3/2000 | Kanamaru et al. | 430/58.35 |
| 6,180,303 | B1 | 1/2001 | Uematsu et al. | |
| 6,262,206 | B1 | 7/2001 | Nesvadba et al. | |
| 7,169,521 | B2 | 1/2007 | Tokarski et al. | |
| 7,629,103 | B2 | 12/2009 | Ikuno et al. | |
| 7,842,444 | B2 | 11/2010 | Nukada et al. | |
| 8,373,160 | B2 | 2/2013 | Yamada et al. | |
| 2005/0244732 | A1 | 11/2005 | Tokarski et al. | |
| 2005/0282075 | A1 | 12/2005 | Ikuno et al. | |
| 2007/0178400 | A1 * | 8/2007 | Kikuchi et al. | 430/133 |
| 2007/0231721 | A1 | 10/2007 | Nukada et al. | |
| 2008/0102391 | A1 | 5/2008 | Yanagawa et al. | |

(Continued)

FOREIGN PATENT DOCUMENTS

| | | |
|---|---|---|
| JP | A-7-072640 | 3/1995 |
| JP | A-9-302011 | 11/1997 |

(Continued)

OTHER PUBLICATIONS

Mar. 21, 2013 Office Action issued in U.S. Appl. No. 13/197,416.

(Continued)

*Primary Examiner* — Stewart Fraser
(74) *Attorney, Agent, or Firm* — Oliff PLC

(57) ABSTRACT

Provided is an electrophotographic photoreceptor including a substrate and an outermost layer containing a cured film of a composition containing a compound having a chain polymerizable functional group and a charge transporting skeleton in the same molecule, and at least one chain transfer agent selected from a compound having 4 or more primary thiol groups and a compound having 2 or more secondary thiol groups.

18 Claims, 6 Drawing Sheets

(56) References Cited

U.S. PATENT DOCUMENTS

| | | | | |
|---|---|---|---|---|
| 2008/0199217 | A1 | 8/2008 | Iwamoto et al. | |
| 2010/0119260 | A1* | 5/2010 | Egawa et al. | 399/159 |
| 2011/0076603 | A1 | 3/2011 | Shibata et al. | |
| 2012/0100472 | A1* | 4/2012 | Sonobe et al. | 430/56 |

FOREIGN PATENT DOCUMENTS

| | | |
|---|---|---|
| JP | A-2000-19749 | 1/2000 |
| JP | A-2000-66424 | 3/2000 |
| JP | A-2000-169531 | 6/2000 |
| JP | A-2002-040686 | 2/2002 |
| JP | B2-3287678 | 3/2002 |
| JP | A-2004-012986 | 1/2004 |
| JP | A-2004-240079 | 8/2004 |
| JP | A-2005-234546 | 9/2005 |
| JP | A-2005-321792 | 11/2005 |
| JP | A-2005-345782 | 12/2005 |
| JP | A-2006-010757 | 1/2006 |
| JP | A-2006-234943 | 9/2006 |
| JP | A-2007-264214 | 10/2007 |
| JP | A-2007-322483 | 12/2007 |
| JP | A-2008-058779 | 3/2008 |
| JP | A-2008-216297 | 9/2008 |
| JP | A-2008-225043 | 9/2008 |
| JP | A-2008-225411 | 9/2008 |
| JP | A-2008-233893 | 10/2008 |

OTHER PUBLICATIONS

U.S. Appl. No. 13/197,416 of Yamada et al., filed Aug. 3, 2011.
U.S. Appl. No. 12/861,280 of Yamada et al., filed Aug. 23, 2010.
May 7, 2012 Office Action issued in U.S. Appl. No. 12/861,280.

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2011-016962 filed Jan. 28, 2011.

BACKGROUND

1. Technical Field

The present invention relates to an electrophotographic photoreceptor, a process cartridge, and an image forming apparatus.

2. Related Art

In a so-called xerographic image forming apparatus, an electrophotographic photoreceptor is used as a member for forming an electrostatic latent image by charging the surface by a charging unit, and selectively erasing the charge by imagewise exposure after charging, and currently, an organic electrophotographic photoreceptor is predominantly used.

SUMMARY

According to an aspect of the invention, there is provided an electrophotographic photoreceptor including a substrate and an outermost layer containing a cured film of a composition containing a compound having a chain polymerizable functional group and a charge transporting skeleton in the same molecule, and at least one chain transfer agent selected from a compound having 4 or more primary thiol groups and a compound having 2 or more secondary thiol groups.

BRIEF DESCRIPTION OF THE DRAWINGS

Exemplary embodiments of the present invention will be described in detail based on the following figures, wherein.

DETAILED DESCRIPTION

Electrophotographic Photoreceptor

Figure 1:
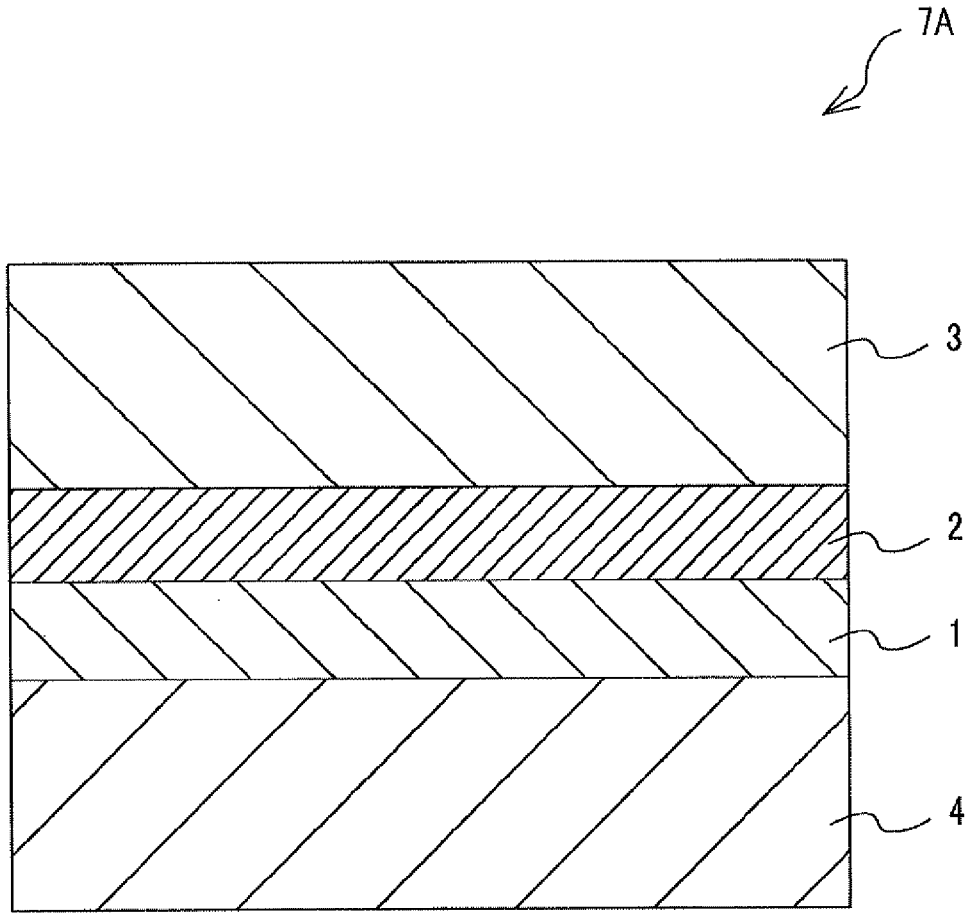
FIG. 1 is a schematic partial cross-sectional view showing an electrophotographic photoreceptor according to the present exemplary embodiment.

The electrophotographic photoreceptor according to the present exemplary embodiment is an electrophotographic photoreceptor having an outermost layer including a cured film of a composition containing a compound having a chain polymerizable functional group and a charge transporting skeleton in the same molecule (hereinafter sometimes referred to as a specific charge transporting material), and at least one chain transfer agent selected from a compound having 4 or more primary thiol groups and a compound having 2 or more secondary thiol groups (hereinafter sometimes referred to as a polyfunctional thiol compound).

In the electrophotographic photoreceptor according to the present exemplary embodiment, by using a polyfunctional thiol compound in the chain transfer agent together with the specific charge transporting material, an electrophotographic photoreceptor having an outermost layer having excellent mechanical strength as well as excellent flexibility and toughness is obtained.

The reason therefor is not clear, but is presumed as follows.

In the first place, the chain transfer agent refers to an additive known as an adjuster for inhibition of the polymerization degree in a general chain polymerization reaction and for the polymerization. Examples thereof include an additive that allows hydrogen radicals to undergo the chain transfer by a dehydrogenation reaction to stop the chain polymerization, an additive that generates radicals by itself by heat or the like, and performs addition at the end of the chain polymerization to stop the chain polymerization reaction.

Generally, in the chain polymerization reaction in a polymer field, it is known that a monofunctional thiol compound (compound having one thiol group) is used as a chain transfer agent. That is, a radical on an extending end in the extension reaction of a polymer performs the chain transfer with a monofunctional thiol compound, and as a result, the extending end of the polymer is capped with the monofunctional thiol compound to regulate the molecular weight.

Here, it may be seen that if the specific charge transporting material is subjected to a radical reaction in the absence of the thiol compound, the charge transporting function is lowered. It is thought that one of the reasons therefor is that the generated radical species cause a side reaction with a site having a charge transporting function, thus leading to by-products which will be certain electrical traps.

On the other hand, if a thiol compound (a compound having a thiol group) coexists, the produced radical species first subtract a hydrogen from a thiol compound which is likely to cause a dehydrogenation reaction, thereby producing a sulfur radical. It is thought that it is difficult for the sulfur radical to cause a dehydrogenation reaction, and as a result, it inhibits the side reaction with a site having a charge transporting function (a charge transporting skeleton) or generation of by-products that may be electrical traps, and allows a chain polymerization to predominantly proceed, and consequently, reduction of the charge transporting function is inhibited.

However, it could be seen that if a monofunctional thiol compound (a compound having one primary thiol group) is used in the chain polymerization, a polymerization reaction and a crosslinking reaction are inhibited by capping of the ends, whereas the molecular weight does not easily increases and it is difficult to improve the mechanical characteristics for the cured film.

Therefore, as in the present exemplary embodiment, it is thought that by applying a polyfunctional thiol compound (compound having 4 or more primary thiol groups and a compound having 2 or more secondary thiol groups) as a chain transfer agent, the crosslinking, the increased molecular weights, and formation of the crosslinking sites are allowed by the polyfunctional thiol compound, unlike a monofunctional thiol compound or a lower functional thiol compound, and thus, the network of the resulting molecules expands easily and the mechanical characteristics are improved.

Here, in the primary thiol compound and the secondary thiol compound, the sulfur radicals produced during the radical reaction are different from each other from the viewpoint of lifespan. That is, it is thought that the sulfur radical produced from the secondary thiol compound is stabilized as a radical itself in terms of the structure, and from the viewpoint of easy occurrence of a side reaction, it is superior to the primary thiol compound. As a result, it is thought that the secondary thiol compound becomes capable of being sufficiently reacted with a chain polymerizable functional group in the compound having a chain polymerizable functional group and a charge transporting skeleton in the same molecule of an aspect of the present invention. On the other hand, it is thought that since the primary thiol compound has a sufficient reactivity of a sulfur radical as compared with the above, in contrast it easily causes a side reaction, and the reactivity with a chain polymerizable functional group is relatively disadvantageous. It is thus thought that in order to allow the reaction with a primary thiol compound to proceed sufficiently, it is necessary that the number of the functional groups of the thiol group be high.

Furthermore, it is thought that by using a polyfunctional thiol compound, a cured film formed by curing (crosslinking) has a bond between carbon and sulfur introduced thereinto, and as a result, a structure having high flexibility is introduced, and the cured film is provided with characteristic properties with flexibility and toughness.

As described above, it is thought that the electrophotographic photoreceptor according to the present exemplary embodiment is an electrophotographic photoreceptor having an outermost layer having excellent mechanical strength as well as excellent flexibility and toughness.

Moreover, since it is thought that in the electrophotographic photoreceptor according to the present exemplary embodiment, generation of the by-products is inhibited by the thiol compound, as described above, the chain polymerization predominantly proceeds. As a result, the charge transporting property of the outermost layer increases and the mechanical strength also increases, leading to excellent abrasion resistance, scratch resistance, or the like.

In addition, with an image forming apparatus and a process cartridge, each of which includes the electrophotographic apparatus according to the present exemplary embodiment, an image having inhibited generation of image density unevenness due to repeated use is obtained.

Furthermore, in the electrophotographic photoreceptor according to the present exemplary embodiment, it is thought that a structure having sufficient flexibility due to introduction of a bond between carbon and sulfur considered to provide the outermost layer with flexibility and toughness alleviates local aggregation of a specific charge transporting material and unevenness of the molecular orientation, and exhibits or improves the charge transporting function.

In addition, it is thought that this structure having sufficient flexibility contributes to improvement of friction and abrasion resistance of the outermost layer of the electrophotographic photoreceptor. That is, for a small volume variation that is considered to occur in the outermost layer of the electrophotographic photoreceptor by the contact with a toner and friction with a cleaning blade, a structure having sufficient flexibility due to a region in which damage to the outermost layer is prevented, and thus generation of fine cracks and propagation of damage are inhibited. As a result, it is thought that it becomes difficult for failures such as cracks, scratching, and peeling due to damage of the outermost layer of the electrophotographic photoreceptor to be caused.

Further, in the electrophotographic photoreceptor according to the present exemplary embodiment, the cured film constituting the outermost layer is preferably cured by, for example, heat or an electron beam.

This is because if an outermost layer (cured film) is formed by a curing method by means of heat or an electron beam, the molecular motion of the polyfunctional thiol compound is further activated, as compared with a case where a curing method by means of light (for example, ultraviolet rays) is applied, and the frequency and probability of the contact of the specific charge transporting material with the chain polymerizable functional group are enhanced, and accordingly, the side reaction due to a radical species with the charge transporting skeleton is inhibited and only the curing reaction is efficiently performed.

On the other hand, in the case where a curing reaction due to light (for example, ultraviolet rays) is applied, there is a tendency that electrical characteristics are not easily obtained, and the reason therefor is thought that the charge transporting skeleton causes light absorption upon curing thereof, leading to a side reaction.

Here, the electrophotographic photoreceptor according to the present exemplary embodiment is specifically an electrophotographic photoreceptor which has, for example, a conductive substrate, a photosensitive layer provided on the conductive substrate, and if necessary, a protective layer provided on the photosensitive layer, and has an outermost layer including the cured film, as an outermost layer provided at a position farthest from the conductive substrate among the layers provided on the conductive substrate.

In addition, the outermost layer is particularly preferably provided as a layer that functions as a protective layer, or a layer that functions as a charge transporting layer.

In the case where the outermost layer is a layer that functions as a protective layer, a configuration where a photosensitive layer and a protective layer as an outermost layer are provided on a conductive substrate, and the protective layer includes a cured film of the composition may be mentioned.

On the other hand, in the case where the outermost layer is a layer that functions as a charge transporting layer, a configuration where a charge generating layer and a charge transporting layer as an outermost layer are provided on a conductive substrate and the charge transporting layer includes a cured film of the composition may be mentioned.

Hereinbelow, the electrophotographic photoreceptor according to the present exemplary embodiment will be described in detail below with reference to the figures. Further, in the figures, the same or corresponding parts are attached with the same symbols and duplicating explanations are omitted.

Figure 2:
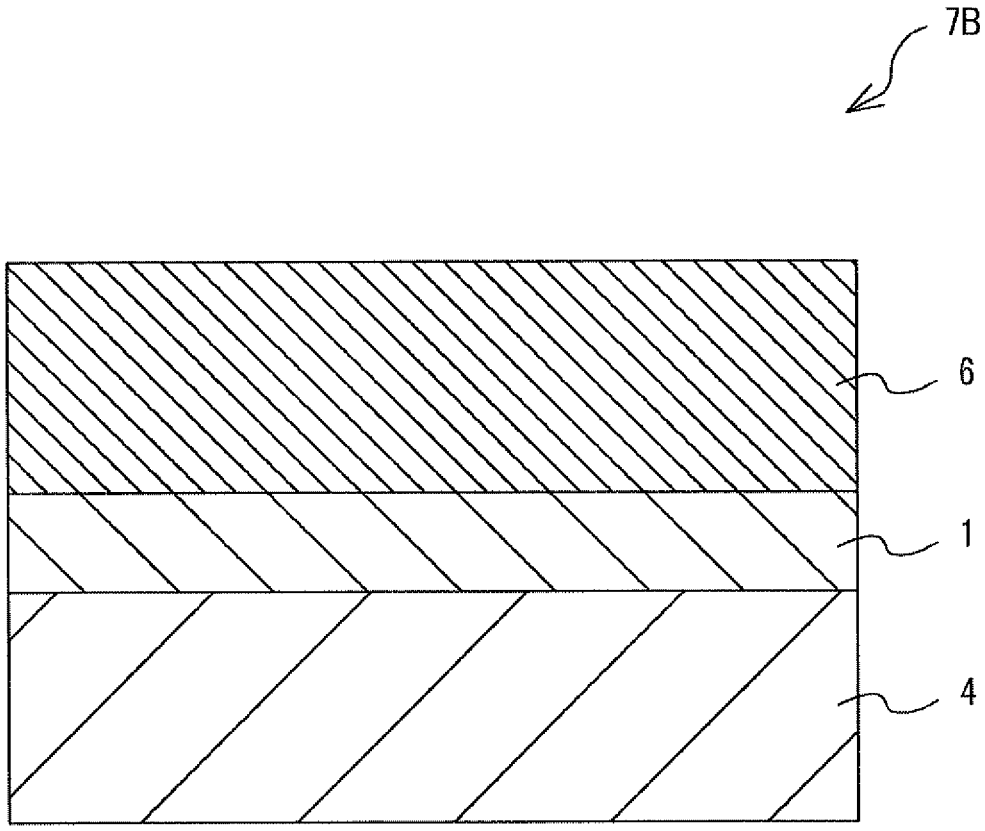
FIG. 2 is a schematic partial cross-sectional view showing another electrophotographic photoreceptor according to the present exemplary embodiment.
Figure 3:
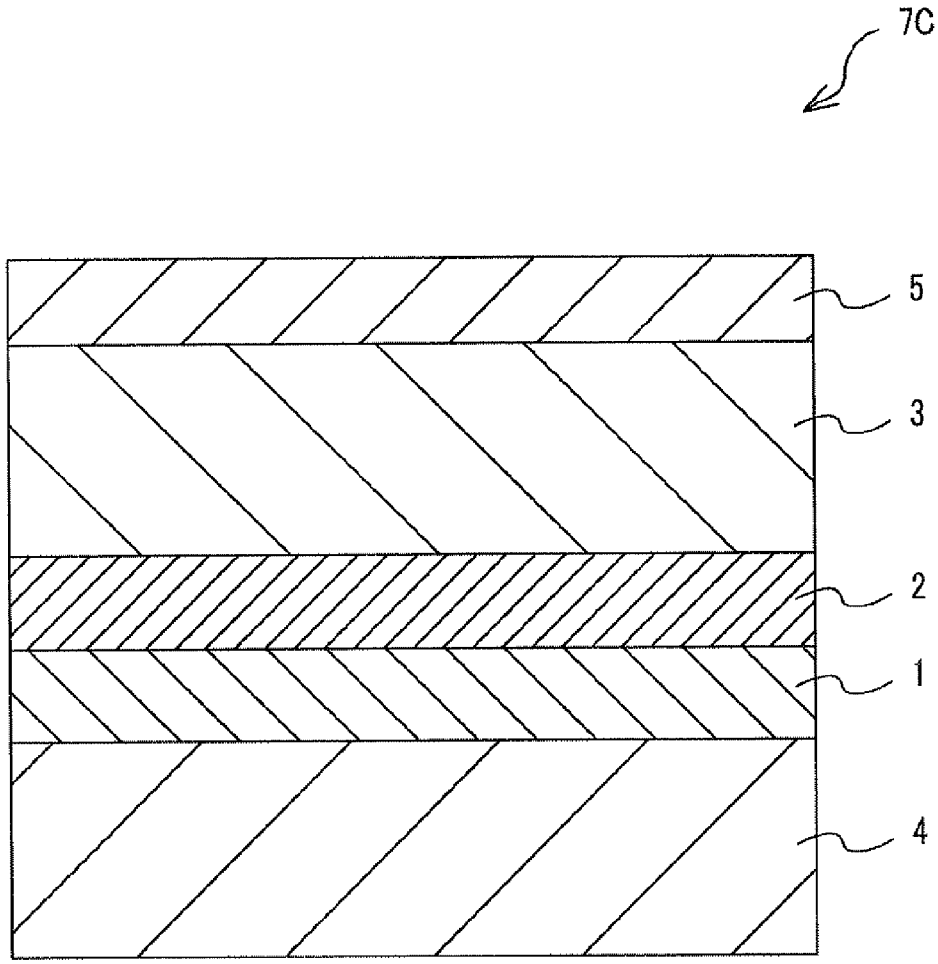
FIG. 3 is a schematic partial cross-sectional view showing a further electrophotographic photoreceptor according to the present exemplary embodiment.
Figure 4:
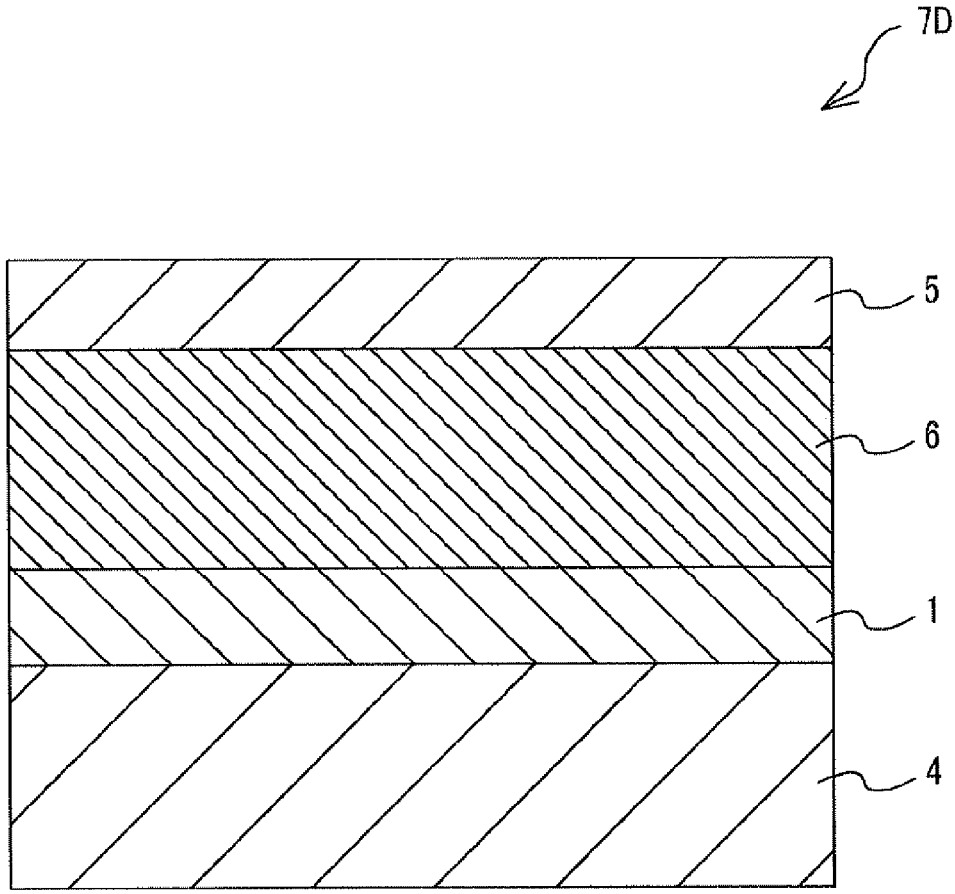
FIG. 4 is a schematic partial cross-sectional view showing a further electrophotographic photoreceptor according to the present exemplary embodiment.

FIG. 1 is a schematic cross-sectional view showing an electrophotographic photoreceptor according to the present exemplary embodiment. FIGS. 2 to 4 are each a schematic cross-sectional view showing another electrophotographic photoreceptor according to the present exemplary embodiment.

The electrophotographic photoreceptor 7A shown in FIG. 1 is a so-called function-separate type photoreceptor (or a multilayer type photoreceptor) having a structure that includes a conductive substrate 4 having thereon an undercoat layer 1, and having formed thereon a charge generating layer 2 and a charge transporting layer 3 in order. In the electrophotographic photoreceptor 7A, a photosensitive layer includes the charge generating layer 2 and the charge transporting layer 3.

The electrophotographic photoreceptor 7B shown in FIG. 2 has a structure that includes a conductive substrate 4 having thereon an undercoat layer 1, and having formed thereon a singlelayer type photosensitive layer 6. That is, the electrophotographic photoreceptor 7B shown in FIG. 2 contains a charge generating material and a charge transporting material in the same layer (singlelayer type photosensitive layer 6 (charge generating/charge transporting layer)).

The electrophotographic photoreceptor 7C shown in FIG. 3 has a structure where a protective layer 5 is provided on the electrophotographic photoreceptor 7A shown in FIG. 1, that is, the undercoat layer 1 is provided on the conductive substrate 4, and the charge generating layer 2, the charge transporting layer 3, and the protective layer 5 are formed in order thereon.

The electrophotographic photoreceptor 7D shown in FIG. 4 has a structure where the protective layer 5 is provided on the electrophotographic photoreceptor 7B shown in FIG. 2, that is, the undercoat layer 1 is provided on the conductive substrate 4, and the singlelayer type photosensitive layer 6 and the protective layer 5 are formed in order thereon.

Moreover, the electrophotographic photoreceptor 7A shown in FIG. 1 has a structure where the charge transporting layer 3 includes an outermost layer disposed on a side farthest from the conductive substrate 4, in which the outermost layer includes the cured film of the composition.

The electrophotographic photoreceptor 7B shown in FIG. 2 has a structure where the singlelayer type photosensitive layer 6 includes an outermost layer disposed on a side farthest from the conductive substrate 4, in which the outermost layer includes the cured film of the composition.

Moreover, the electrophotographic photoreceptors 7C to 7D shown in FIGS. 3 to 4 have a structure where the protective layer 5 includes an outermost layer disposed on a side farthest from the conductive substrate 4, in which the outermost layer includes the cured film of the composition.

Further, in the electrophotographic photoreceptors shown in FIGS. 1 to 4, the undercoat layer 1 may or may not be provided.

Hereinbelow, each of the components will be described on the basis of the electrophotographic photoreceptor 7A shown in FIG. 1 as a representative example.

(Conductive Substrate)

As the conductive substrate, any material that has been conventionally used may be used. For example, cylindrical substrates made of metal are typically used. Other examples thereof include resin films or the like provided with conductive films (for example, metals such as aluminum, nickel, chromium, stainless steel, and the like, and films of aluminum, titanium, nickel, chromium, stainless steel, gold, vanadium, tin oxide, indium oxide, indium tin oxide (ITO), or the like), paper that is coated with or impregnated with a conductivity imparting agent, resin films that are coated with or impregnated with a conductivity imparting agent, and the like. The shape of the substrate is not limited to a cylindrical shape and it may be a sheet shape or a plate shape.

In addition, the conductive substrate preferably has, for example, conductivity with a volume resistivity of less than $10^7$ Ω·cm.

In the case where a metal pipe is used as the conductive substrate, the surface thereof may be the surface of a bare metal pipe itself or may be subjected beforehand to a treatment such as mirror grinding, etching, anodic oxidation, coarse grinding, centerless grinding, sandblasting, wet honing, and the like.

(Undercoat Layer)

The undercoat layer may be provided, as required, for the purpose of prevention of light reflection at the surface of the conductive substrate, prevention of inflow of unnecessary carrier from the conductive substrate into the photosensitive layer, or the like.

The undercoat layer is configured to include, for example, a binder resin and other additives, as required.

Examples of the binder resin contained in the undercoat layer include known resins (for example, acetal resins such as polyvinyl butyral and the like, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, urethane resins, and the like), and conductive resins (for example, charge transporting resins having charge transporting groups, polyaniline and the like). Among these, resins which are insoluble in the coating solvent for the upper layer are preferably used as the binder resin, and specifically, phenolic resins, phenol-formaldehyde resins, melamine resins, urethane resins, epoxy resins, or the like are particularly preferably used.

In addition, the conductive resin preferably has, for example, conductivity with a volume resistivity of less than $10^7$ Ω·cm.

The undercoat layer may contain, for example, metal compounds such as a silicon compound, an organic zirconium compound, an organic titanium compound, an organic aluminum compound, and the like.

The ratio of the metal compound to the binder resin is not particularly limited, but is determined within a range in which desired electrophotographic photoreceptor characteristics are obtained.

For example, resin particles may also be added to the undercoat layer for adjusting the surface roughness. Examples of the resin particles include silicone resin particles, crosslinking type polymethyl methacrylate (PMMA) resin particles, and the like. Further, the undercoat layer may be formed and then subjected to grinding for adjusting the surface roughness thereof. As the grinding method, buffing grinding, a sandblast treatment, wet honing, a grinding treatment, or the like is used.

Here, examples of the constitution of the undercoat layer include a constitution in which the undercoat layer contains at least a binder resin and conductive particles.

Further, the conductive particles preferably have, for example, conductivity with a volume resistivity of less than $10^7$ Ω·cm.

Examples of the conductive particle include metal particles (particles of aluminum, copper, nickel, silver, or the like), conductive metal oxide particles (particles of antimony oxide, indium oxide, tin oxide, zinc oxide, or the like), conductive material particles (particles of carbon fiber, carbon black, or graphite powders), and the like. Among these, conductive metal oxide particles are suitable. The conductive particles may be used as a mixture of 2 or more kinds thereof.

Furthermore, the conductive particles may be used after adjustment of the resistivity by performing a surface treatment with a hydrophobilizing treatment agent (for example, a coupling agent) or the like.

The content of the conductive particles may be, for example, in the range of 10% by mass or more and 80% by mass or less or in the range of 40% by mass or more and 80% by mass or less, based on the mass of the binder resin.

When the undercoat layer is formed, a coating liquid for forming an undercoat layer, in which the components as described above are added to a solvent, is used.

Further more, for a method for dispersing the particles in the coating liquid for forming an undercoat layer, a media disperser such as a ball mill, a vibration ball mill, an attritor, a sand mill, and the like, or a medialess disperser such as a stirrer, an ultrasonic disperser, a roll mill, a high-pressure homogenizer, and the like, is used. Examples of the high-pressure homogenizer include a homogenizer using a collision method including subjecting a dispersion liquid to liquid-liquid collision or liquid-wall collision at high pressure so as to perform dispersing, a homogenizer using a flow-through method including allowing the dispersion liquid to flow through a fine flow path at high pressure so as to perform dispersing, and the like.

Examples of the method of coating the coating liquid for forming an undercoat layer on a conductive substrate include a dip coating method, a push-up coating method, a wire bar coating method, a spray coating method, a blade coating method, a knife coating method, a curtain coating method, and the like.

The film thickness of the undercoat layer may be, for example, in the range of 15 μm or more or in the range of 20 μm or more and 50 μm or less.

Here, although not shown, an intermediate layer may be further provided between the undercoat layer and the photosensitive layer. Examples of the binder resin used in the intermediate layer include polymer resin compounds such as acetal resins (for example, polyvinyl butyral and the like), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, melamine resins, and the like, and organic metal compounds containing, for example, a zirconium atom, a titanium atom, an aluminum atom, a manganese atom, a silicon atom, and the like. These compounds may be used singly or in a mixture of plural kinds of the compounds or a polycondensate thereof. Among those, if the organic metal compound containing zirconium or silicon is used, a photoreceptor having a low residual potential, small change in potential due to the environment, and small change in potential due to repeated use is easily obtained in comparison with a case where other binder resins are used.

When the intermediate layer is formed, for example, a coating liquid for forming an intermediate layer, which is formed by adding the above-described components to a solvent, is used.

As a coating method for forming the intermediate layer, an ordinary method such as a dip coating method, a push-up coating method, a wire bar coating method, a spray coating method, a blade coating method, a knife coating method, a curtain coating method, and the like is used.

Moreover, the intermediate layer also functions as an electrical blocking layer in addition to improving the coatability of the upper layer. However, when the thickness of the intermediate layer is excessively large, the electric barrier sometimes becomes excessively strong, thereby causing desensitization or an increase in potential during repeated use.

Therefore, when the intermediate layer is formed, the thickness thereof is adjusted to be in the range of 0.1 μm or more and 3 μm or less. Further, the intermediate layer in this case may be used as the undercoat layer.

(Charge Generating Layer)

The charge generating layer is formed of, for example, a charge generating material in a binder resin.

Examples of the charge generating material constituting the charge generating layer include phthalocyanine pigments such as metal-free phthalocyanine, chlorogallium phthalocyanine, hydroxygallium phthalocyanine, dichlorotin phthalocyanine, titanyl phthalocyanine, and the like. In particular, the examples include a chlorogallium phthalocyanine crystal having strong diffraction peaks at Bragg angles (2θ±0.2°) to CuKα characteristic X-rays of at least 7.4°, 16.6°, 25.5°, and 28.3°, a metal-free phthalocyanine crystal having strong diffraction peaks at Bragg angles (2θ±0.2°) to CuKα characteristic X-rays of at least 7.7°, 9.3°, 16.9°, 17.5°, 22.4°, and 28.8°, a hydroxygallium phthalocyanine crystal having strong diffraction peaks at Bragg angles (2θ±0.2°) to CuKα characteristic X-rays of at least 7.5°, 9.9°, 12.5°, 16.3°, 18.6°, 25.1°, and 28.3°, or a titanyl phthalocyanine crystal having strong diffraction peaks at Bragg angles (2θ±0.2°) to CuKα characteristic X-rays of at least 9.6°, 24.1°, and 27.2°. Examples of the charge generating material further include quinone pigments, perylene pigments, indigo pigments, bisbenzimidazole pigments, anthrone pigments, quinacridone pigments, and the like, and these charge generating materials may be used singly or in a mixture of 2 or more kinds thereof.

Examples of the binder resin constituting the charge generating layer include polycarbonate resins of a bisphenol A type, a bisphenol Z type, or the like, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer, a polyvinyl acetate resin, a polyvinyl formal resin, a polysulfone resin, a styrene-butadiene copolymer resin, a vinylidene chloride acrylonitrile copolymer resin, a vinyl chloride-vinyl acetate maleic anhydride resin, a silicone resin, a phenol-formaldehyde resin, a polyacrylamide resin, a polyamide resin, a poly-N-vinylcarbazole resin, and the like. These binder resins may be used singly or in a mixture of 2 or more kinds thereof.

Further, the blending ratio of the charge generating material and the binder resin (charge generating material:binder resin) may be, for example, in the range of 10:1 to 1:10 based on mass.

When the charge generating layer is formed, a coating liquid for forming a charge generating layer formed by adding the components to a solvent is used.

As a method for dispersing the particles (for example, charge generating materials) in the coating liquid for forming a charge generating layer, a media disperser such as a ball mill, a vibration ball mill, an attritor, a sand mill, and the like, or a medialess disperser such as a stirrer, an ultrasonic disperser, a roll mill, a high-pressure homogenizer, and the like, is used. Examples of the high-pressure homogenizer include a homogenizer using a collision method including subjecting a dispersion liquid to liquid-liquid collision or liquid-wall collision at high pressure so as to perform dispersing, a homogenizer using a flow-through method including allowing the dispersion liquid to flow through a fine flow path at high pressure so as to perform dispersing, and the like.

Examples of the method for coating the coating liquid for forming a charge generating layer on the undercoat layer include a dip coating method, a push-up coating method, a wire bar coating method, a spray coating method, a blade coating method, a knife coating method, a curtain coating method, and the like.

The film thickness of the charge generating layer may be, for example, in the range of 0.01 μm or more and 5 μm or less or in the range of 0.05 μm or more and 2.0 μm or less.

(Charge Transporting Layer)

The charge transporting layer is a layer constituted with a cured film of a composition containing a specific charge transporting material and a chain transfer agent (hereinafter sometimes referred to as a charge transporting composition), —Specific Charge Transporting Material—

The specific charge transporting material is a compound having a chain polymerizable functional group and a charge transporting skeleton in the same molecule.

Examples of the chain polymerizable functional group in the specific charge transporting material include functional groups having a carbon double bond, including, for example, a group selected from an acryloyl group, a methacryloyl group, a vinylphenyl group, an allyl group, a vinyl group, a vinyl ether group, an vinyl ester group, and derivatives thereof. Among these, from the viewpoint of excellent reactivity, examples of the chain polymerizable functional group include at least one group selected from an acryloyl group, a methacryloyl group, a vinylphenyl group, a vinyl group, and derivatives thereof.

On the other hand, examples of the charge transporting skeleton in the specific charge transporting material include a skeleton derived from a nitrogen-containing hole transporting compound such as a triarylamine-based compound, a benzidine-based compound, a hydrozone-based compound, and the like, in which the structure conjugated with a nitrogen atom is a charge transporting skeleton. Among these, a triarylamine skeleton is preferable.

As the specific charge transporting material, a compound having 2 or more (particularly 4 or more) chain polymerizable functional groups in one molecule is preferable. By this, the electrical characteristics (a charge transporting property, a charging property, a residual potential, and the like) of the cured film are improved, these characteristics are easily maintained even with repeated use, and generation of density unevenness due to repeated use is easily inhibited. Further, the crosslinking density increases, and thus, a cured film having higher mechanical strength is easily obtained.

The number of these chain polymerizable functional groups may be in the range of 20 or less or of 10 or less, in view of the stability and the electrical characteristics of the charge transporting composition (coating liquid).

Specific examples of the specific charge transporting material include a compound represented by the following formula (A) from the viewpoint of the electrical characteristics and the film strength.

When the compound represented by the following formula (A) is applied, the electrical characteristics (a charge transporting property, a charging property, a residual potential, and the like) of the cured film is improved, these characteristics are easily maintained even with repeated use, and generation of density unevenness due to repeated use is easily inhibited. Further, the crosslinking density increases, and thus, a cured film having even higher mechanical strength is easily obtained.

(A)

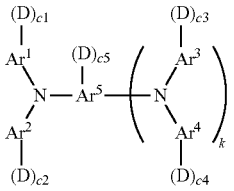

In the formula (A), $Ar^1$ to $Ar^4$ each independently represent a substituted or unsubstituted aryl group; $Ar^5$ represents a substituted or unsubstituted aryl group, or a substituted or unsubstituted arylene group; D represents a group containing a functional group having a carbon double bond; c1 to c5 each independently represent 0, 1, or 2; k represents 0 or 1; and the total number of D's is 1 or more.

Here, as the compound represented by the formula (A), the compound in which D represents a group having at least one selected from an acryloyl group, a methacryloyl group, a vinylphenyl group, an allyl group, a vinyl group, a vinyl ether group, a vinyl ester group, and derivatives thereof (particularly, a group having any of those groups on the end) and the total number of D's is 2 or more, is preferable from the viewpoint that the cured film has excellent mechanical strength.

Particularly, as the compound represented by the formula (A), the compound in which D represents $—(CH_2)_d—(O—CH_2—CH_2)_e—O—CO—C(R')=CH_2$ (wherein R' represents a hydrogen atom or a methyl group, d represents an integer of 1 or more and 5 or less, and e represents 0 or 1), and the total number of D's is 4 or more is preferable from the viewpoint that the cured film has excellent electrical characteristics (a charge transporting property, a charging property, a residual potential, and the like) and mechanical strength.

Further, an acryloyl group, a methacryloyl group, and a vinylphenyl group have a tendency to have a high reactivity with a chain transfer agent and imparting high mechanical strength to the resulting cured film. On the other hand, an allyl group, a vinyl group, a vinyl ether group, and a vinyl ester group have a low reactivity and barely react in general polymerization, but have a high reactivity with a polyfunctional thiol compound (a thiol group thereof) as a chain transfer agent, and thus, the polymerization proceeds and the mechanical strength of the resulting cured film increases.

In the formula (A), $Ar^1$ to $Ar^4$ each independently represent a substituted or unsubstituted aryl group. $Ar^1$ to $Ar^4$ may be the same as or different from each other.

Here, examples of the substituent in the substituted aryl group include an alkyl group having 1 to 4 carbon atoms, an alkoxy group having 1 to 4 carbon atoms, a substituted or unsubstituted aryl group having 6 to 10 carbon atoms, and the like, in addition to the groups represented by D.

Specifically, $Ar^1$ to $Ar^4$ are preferably any of the following formulae (1) to (7). Further, in the following formulae (1) to (7), "$-(D)_{C1}$" to "$-(D)_{C4}$" capable of bonding to each of $Ar^1$ to $Ar^4$ are generally shown as "$-(D)_C$".

(1)

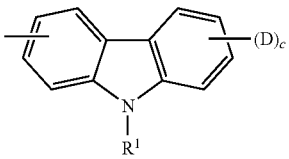

(2)

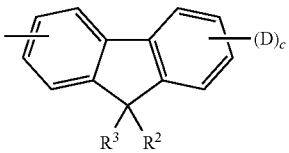

(3)

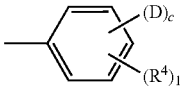

-continued (4)

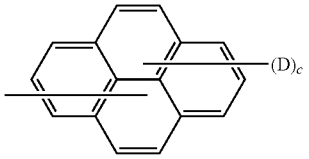

(5)

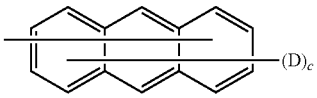

(6)

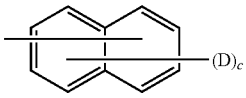

(7)

$$-\mathrm{Ar}-(\mathrm{Z}')_s-\mathrm{Ar}-(\mathrm{D})_c$$

In the formulae (1) to (7), $R^1$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; $R^2$ to $R^4$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; D represents the same group as D in the formula (A); c represents 1 or 2; s represents 0 or 1; and t represents an integer of 0 or more and 3 or less.

Here, Ar in the formula (7) is preferably represented by the following structural formula (8) or (9).

(8)

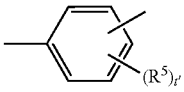

(9)

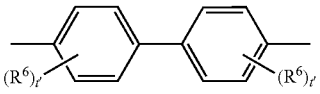

In the formulae (8) and (9), $R^5$ and $R^6$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and t' represents an integer of 0 or more and 3 or less.

In the formula (7), Z' represents a divalent organic linking group, and is preferably represented by any one of the following formulae (10) to (17).

(10)

$$-(\mathrm{CH_2})_q-$$

(11)

$$-(\mathrm{CH_2CH_2O})_r-$$

-continued (12)

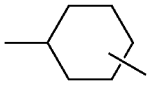

(13)

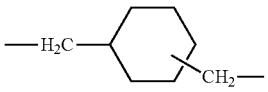

(14)

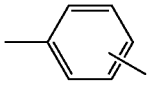

(15)

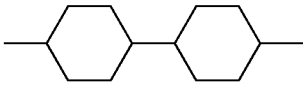

(16)

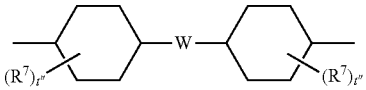

(17)

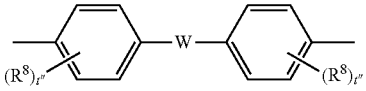

In the formulae (10) to (17), $R^7$ and $R^8$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; W represents a divalent group; q and r each independently represent an integer of 1 to 10; and t" represents an integer of 0 or more and 3 or less.

W in the formulae (16) and (17) is preferably any one of divalent groups represented by the following formulae (18) to (26). In the formula (25), u represents an integer of 0 or more and 3 or less.

(18)

$$-\mathrm{CH_2}-$$

(19)

$$-\mathrm{C(CH_3)_2}-$$

(20)

$$-\mathrm{O}-$$

(21)

$$-\mathrm{S}-$$

(22)

$$-\mathrm{C(CF_3)_2}-$$

(23)

$$-\mathrm{Si(CH_3)_2}-$$

(24)

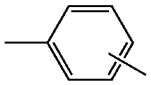

(25)

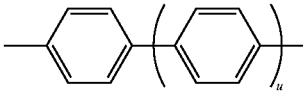

-continued (26)

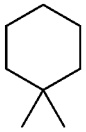

Furthermore, in the formula (A), $Ar^5$ represents a substituted or unsubstituted aryl group when k is 0. As the aryl group, the same aryl groups shown in the description of $Ar^1$ to $Ar^4$ are exemplified. $Ar^5$ represents a substituted or unsubstituted arylene group when k is 1, and as the arylene group, arylene groups obtained by subtracting one hydrogen atom at a desired position from the aryl groups shown in the description of $Ar^1$ to $Ar^4$ are exemplified.

Specific examples of the specific charge transporting material are shown below. However, the specific charge transporting material is by no means limited thereto.

In the first place, specific examples of the specific charge transporting material having one chain polymerizable functional group are shown, but are not limited thereto.

i-1

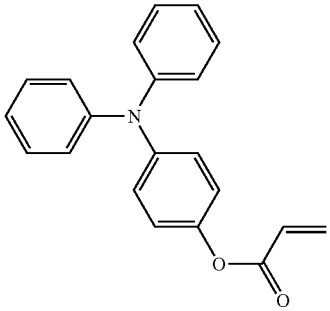

i-2

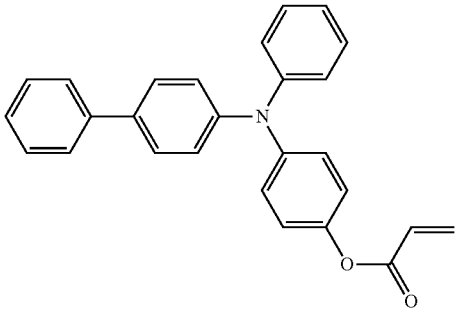

i-3

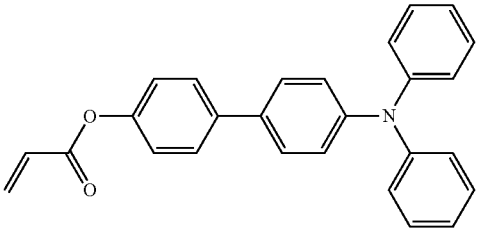

i-4

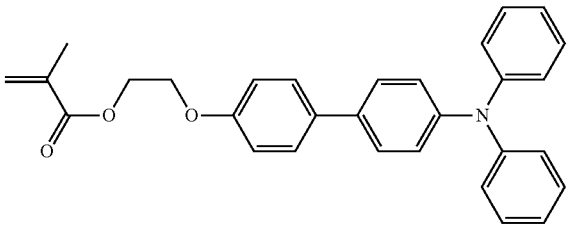

-continued i-5

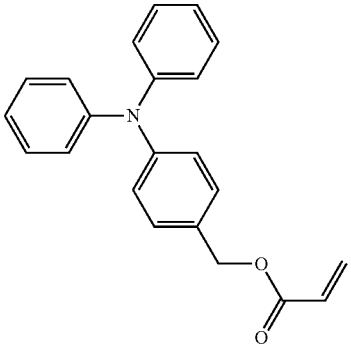

i-6

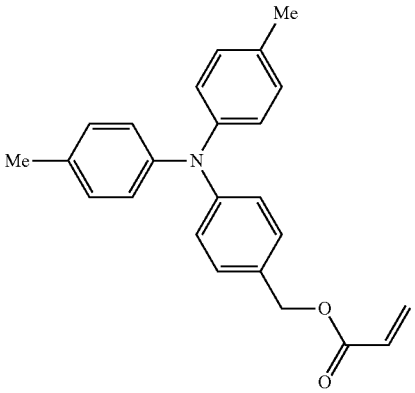

i-7

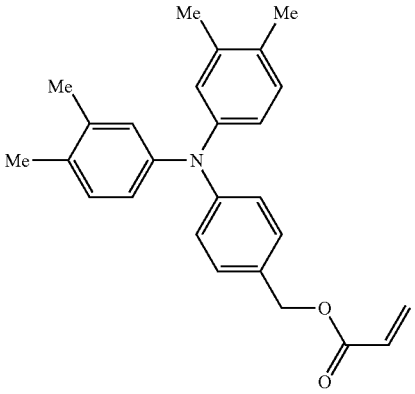

i-8

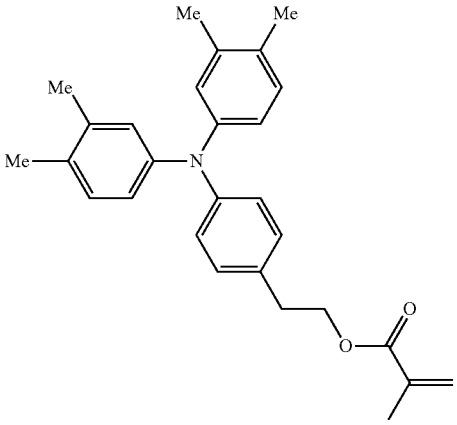

-continued
i-9
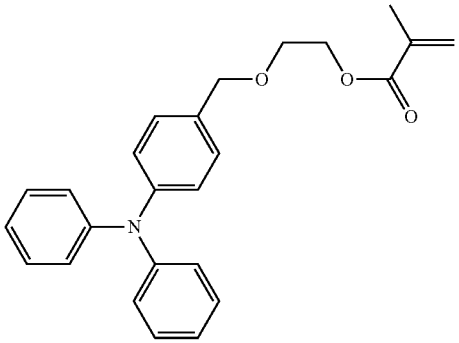
i-10
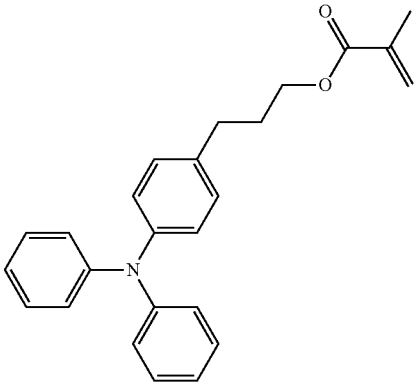
i-11
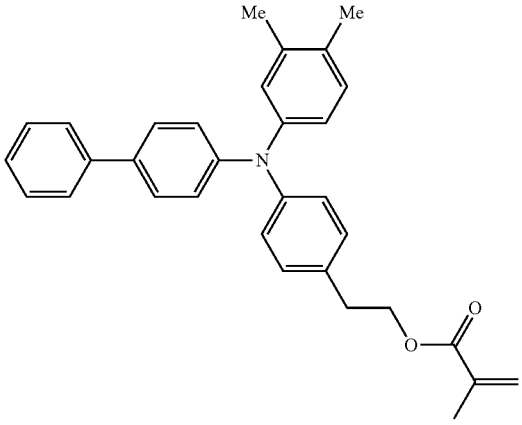
-continued
i-12
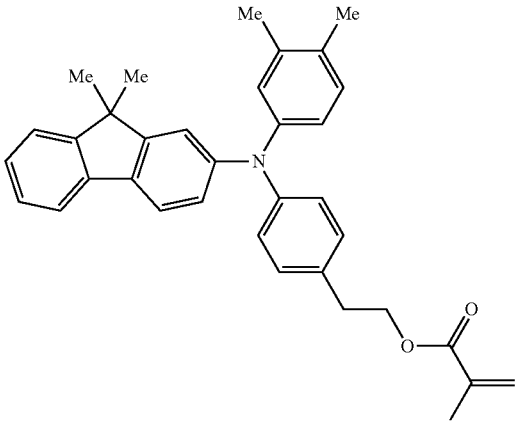
i-13
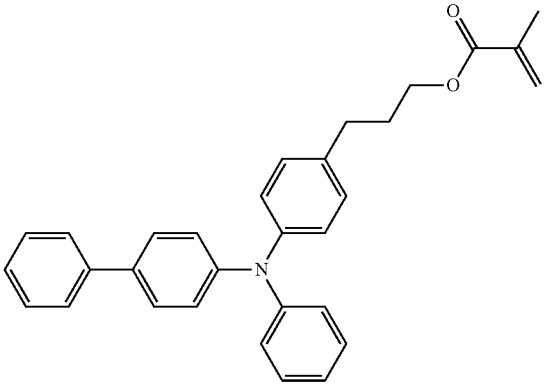
i-14
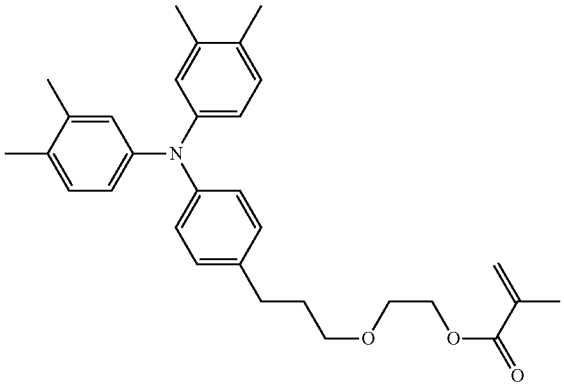

-continued
i-15
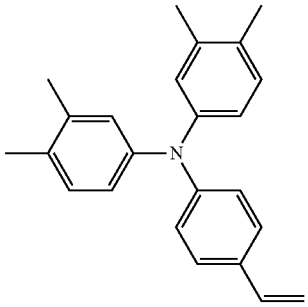
i-16
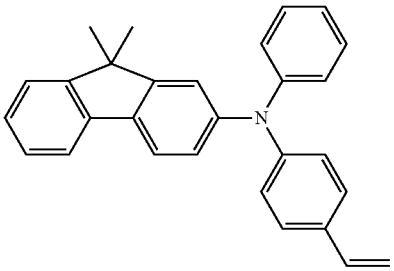
i-17
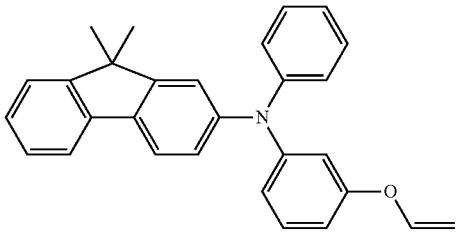
i-18
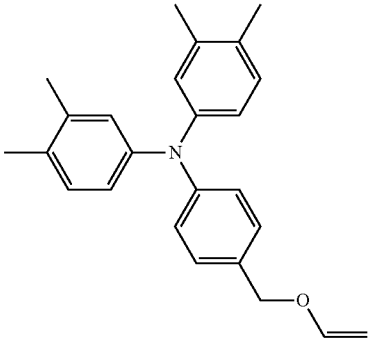
i-19
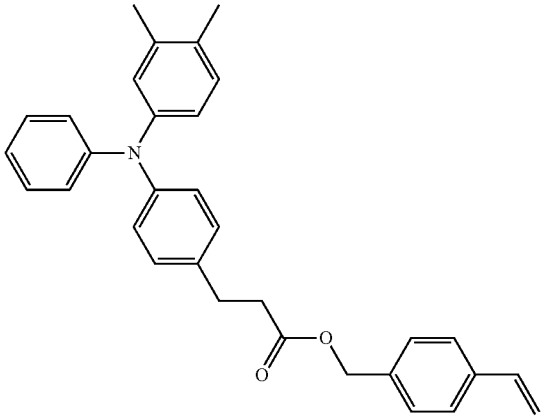
-continued
i-20
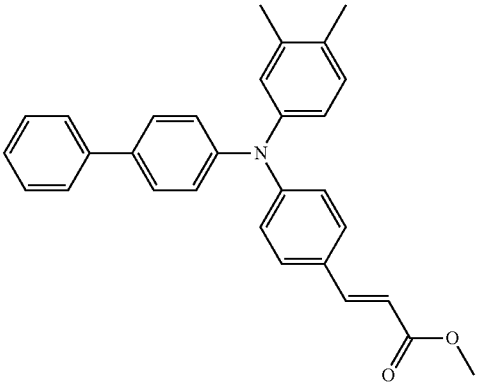
i-21
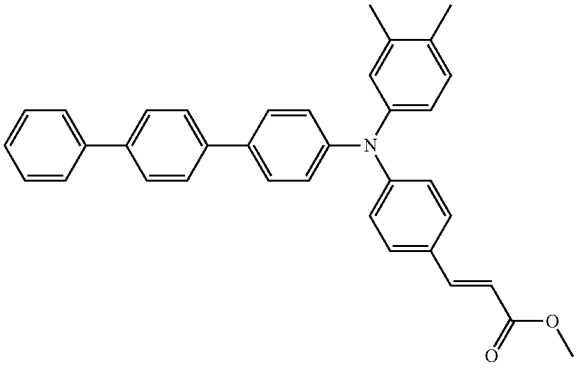
i-22
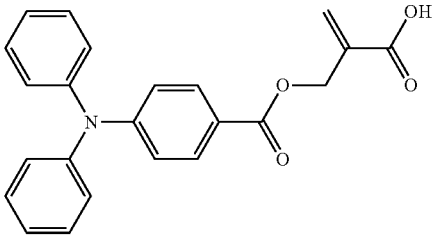
i-23
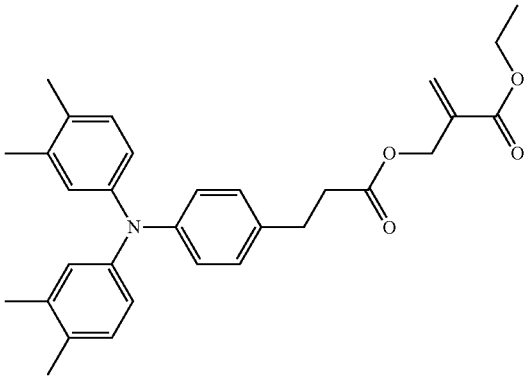

-continued
i-24
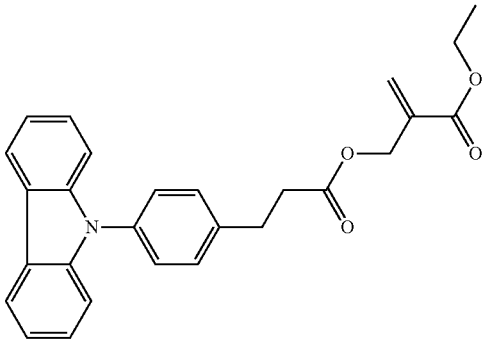
i-25
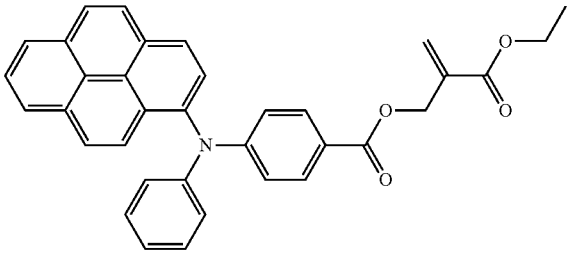
-continued
i-26
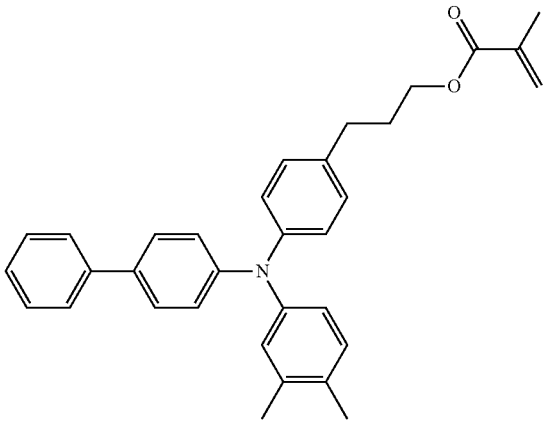
Next, specific examples of the specific charge transporting material having 2 chain polymerizable functional groups are shown, but are not limited thereto.
ii-1
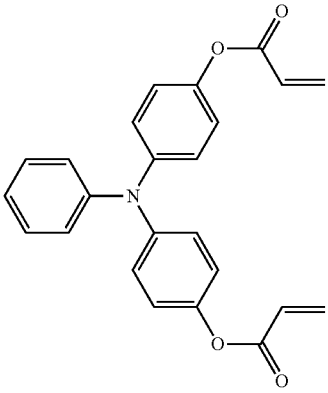
ii-2
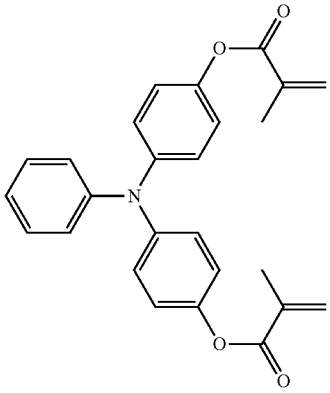
ii-3
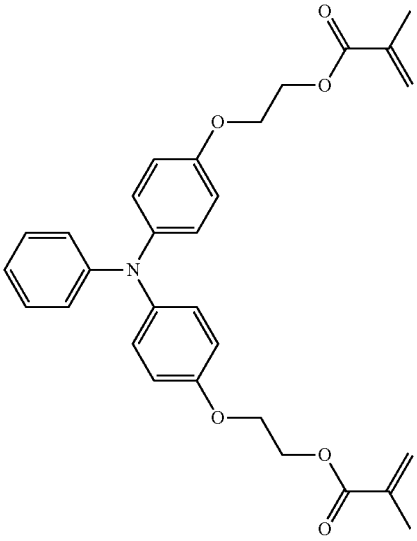
ii-4
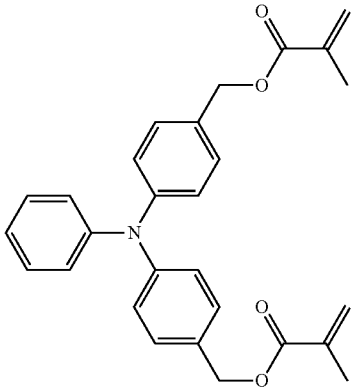

-continued
ii-5
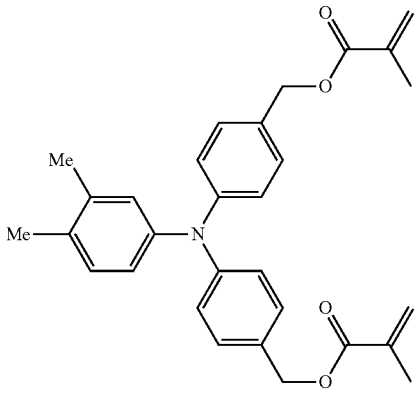
ii-6
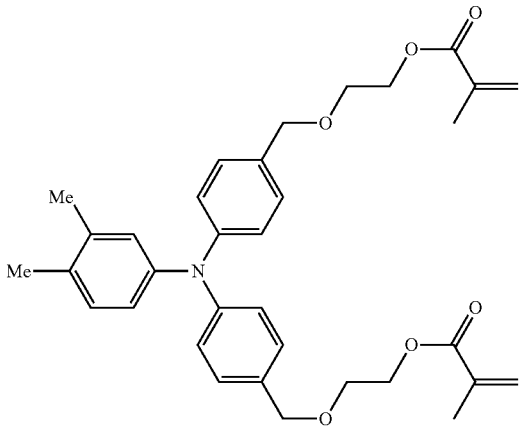
ii-7
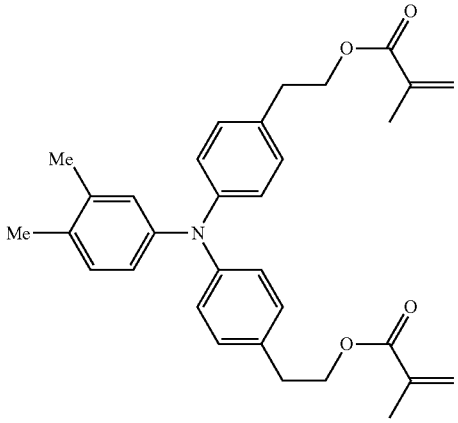
ii-8
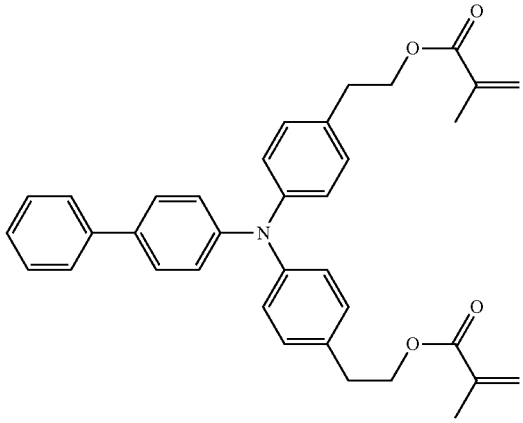
ii-9
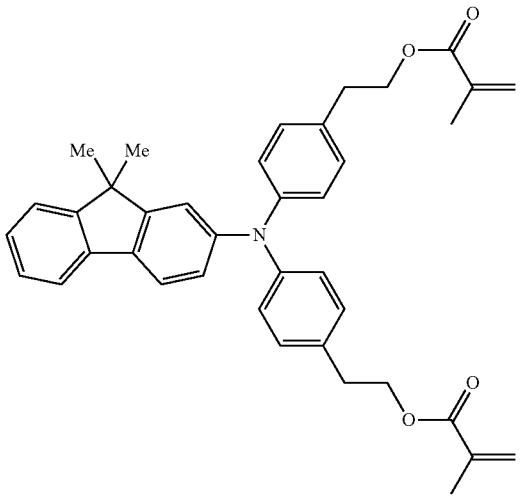

-continued
ii-10
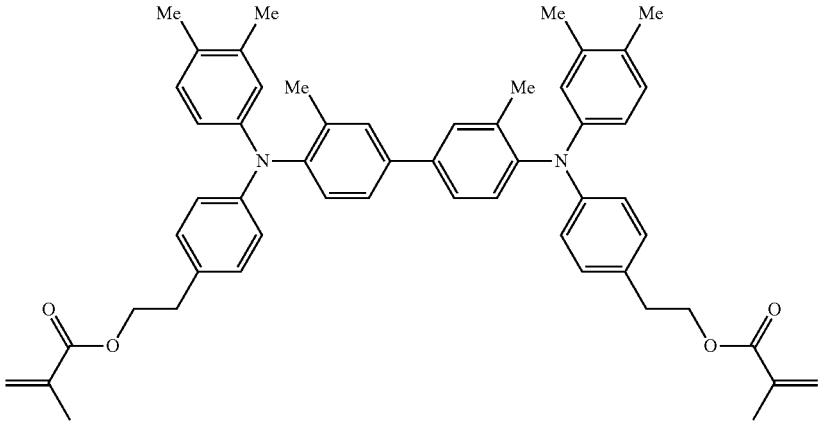
ii-11
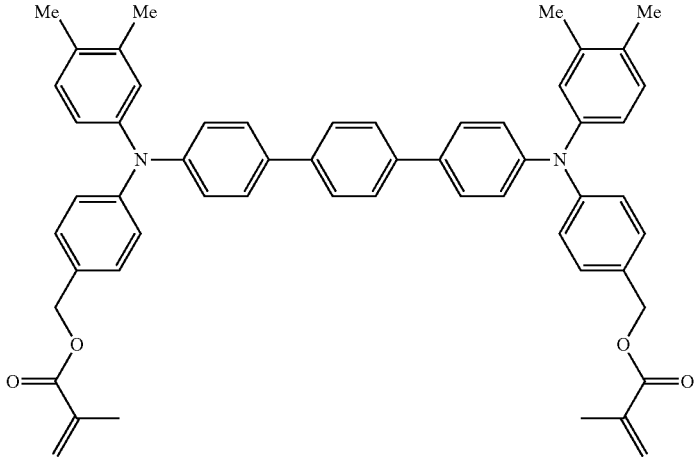
ii-12
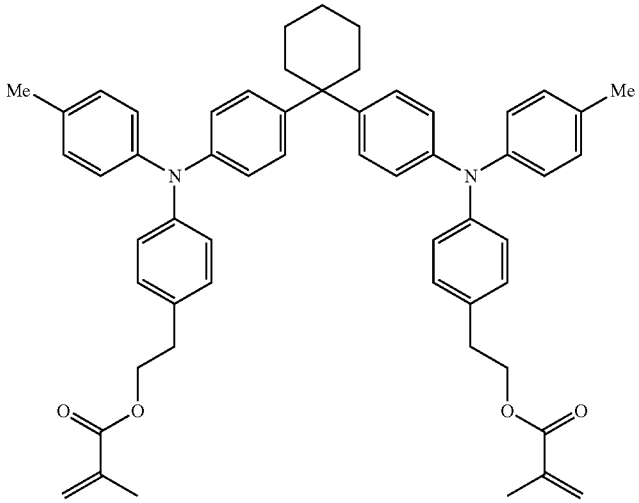

-continued
ii-13
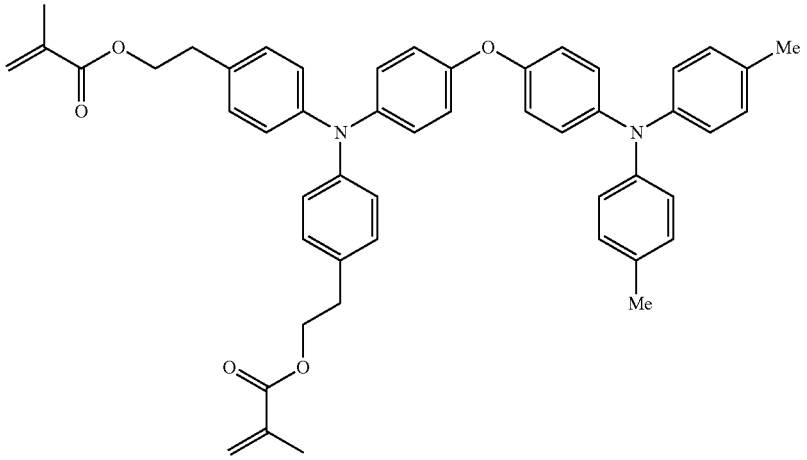
ii-14
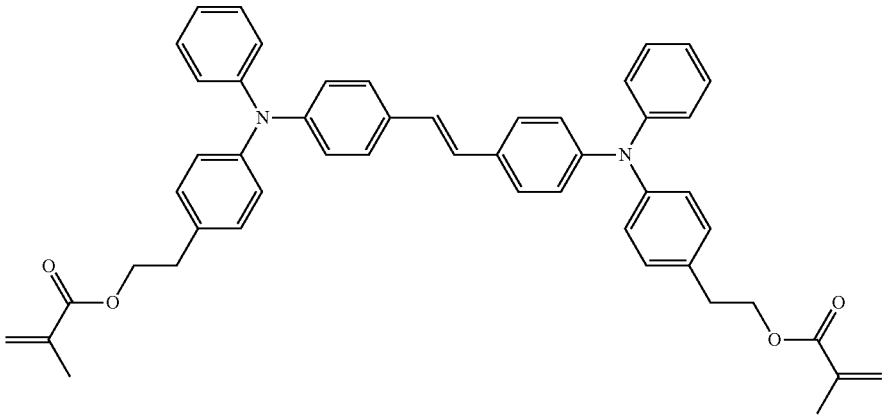
ii-15
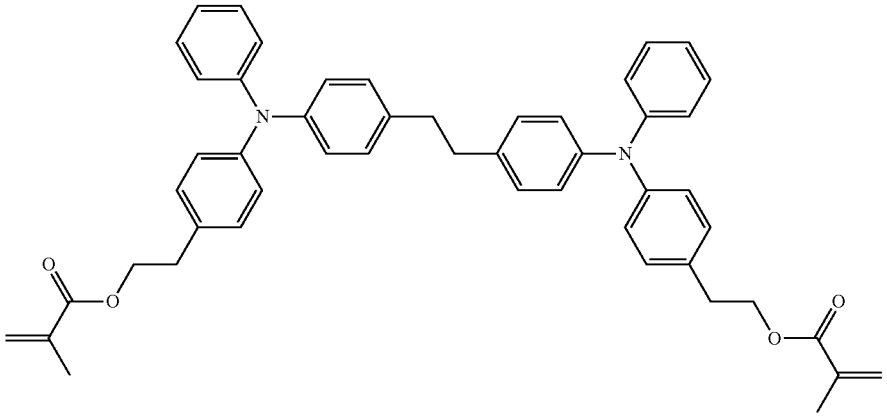

-continued
ii-16
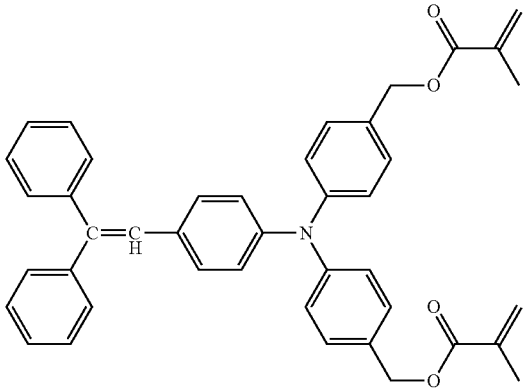
ii-17
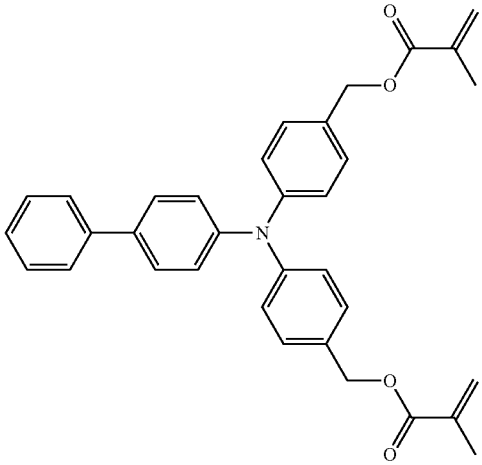
ii-18
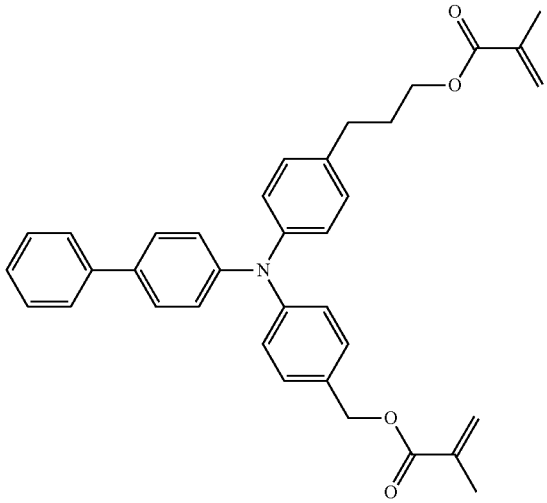
ii-19
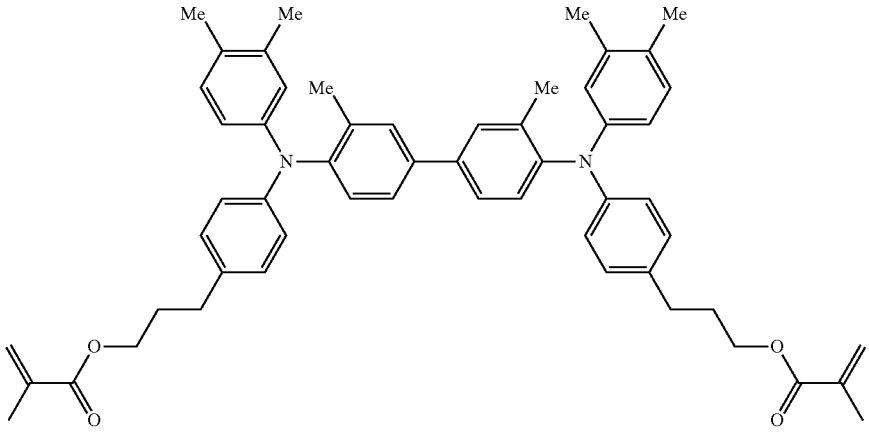

-continued
ii-20
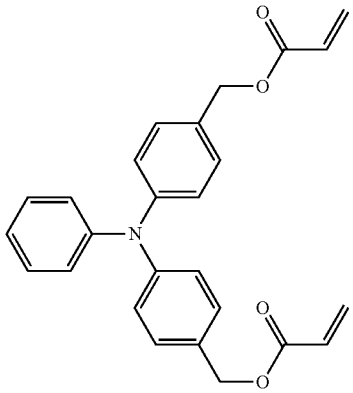
ii-21
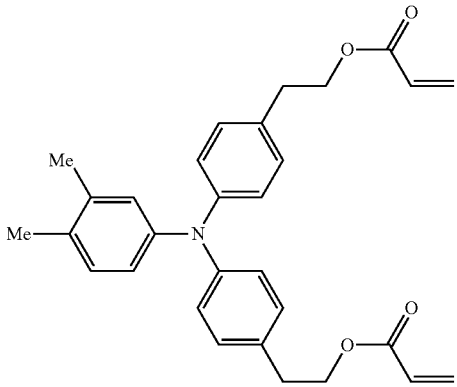
ii-22
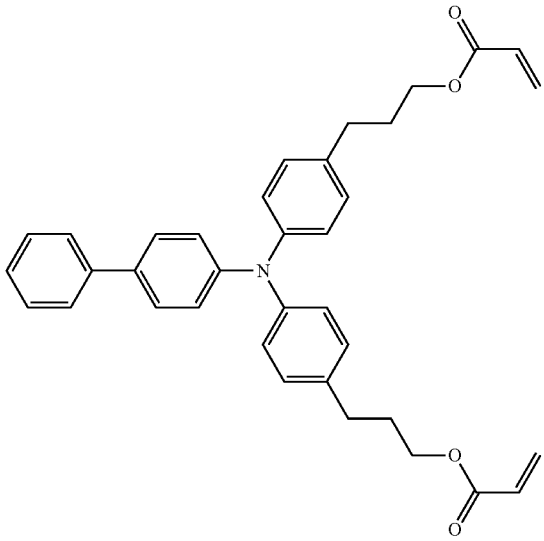
ii-23
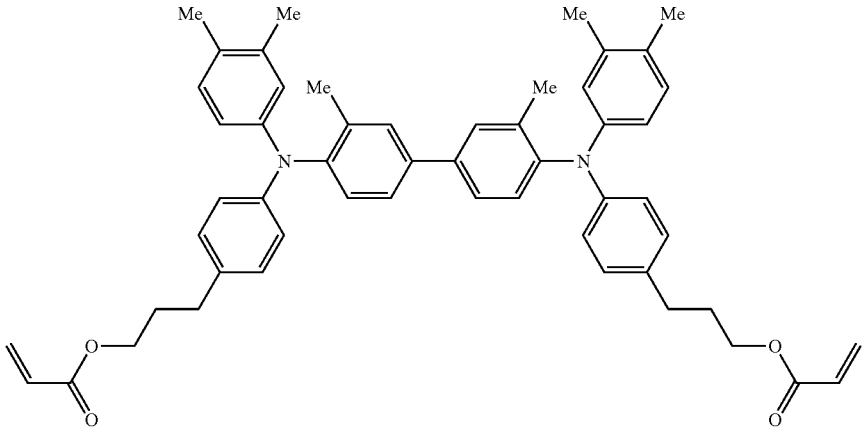

-continued
ii-24
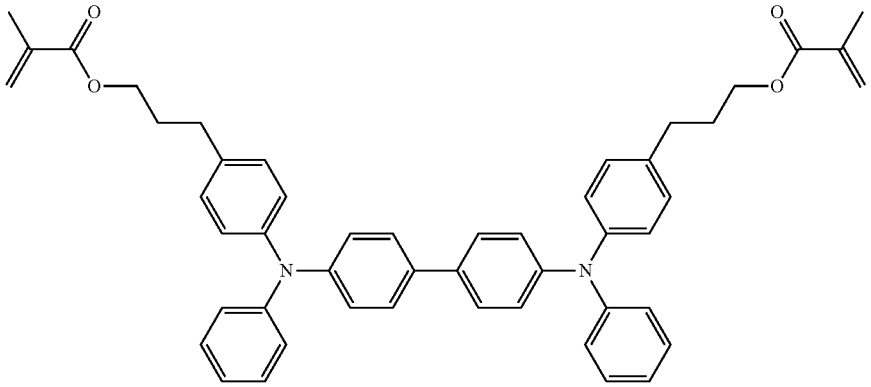
ii-25
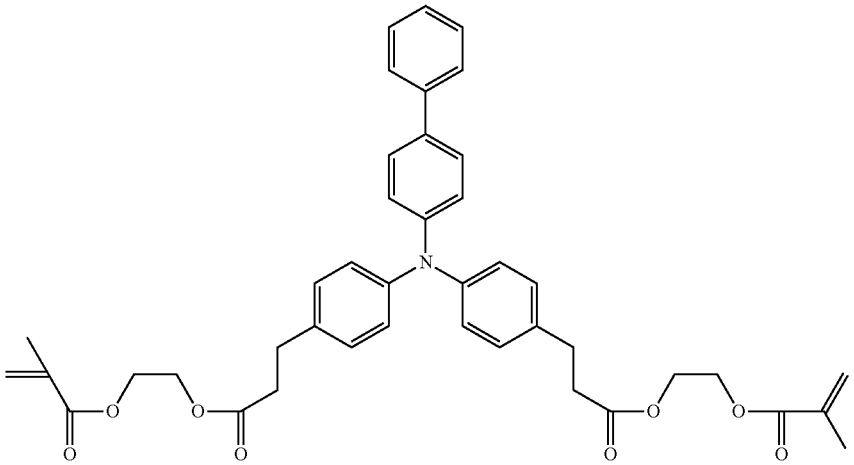
ii-26
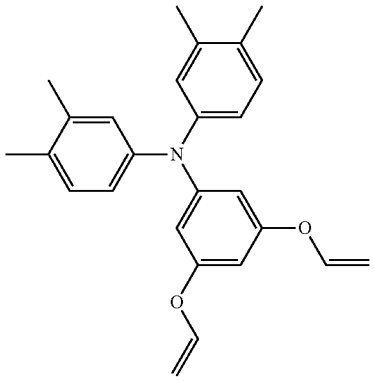
ii-27
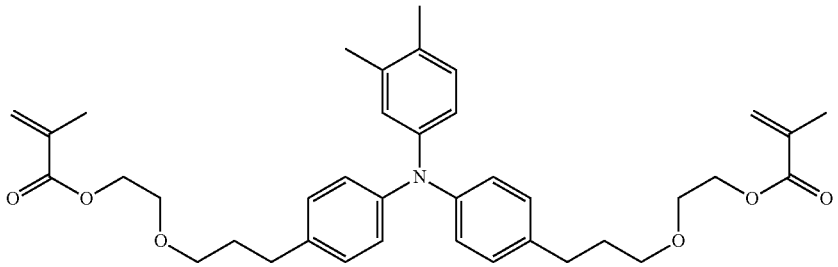

-continued
ii-28
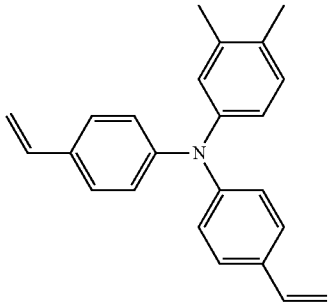
ii-29
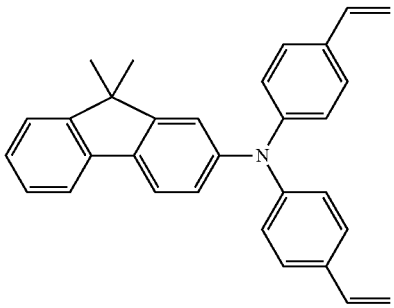
ii-30
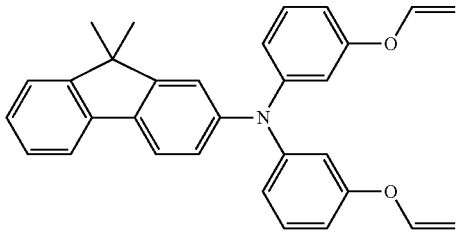
ii-31
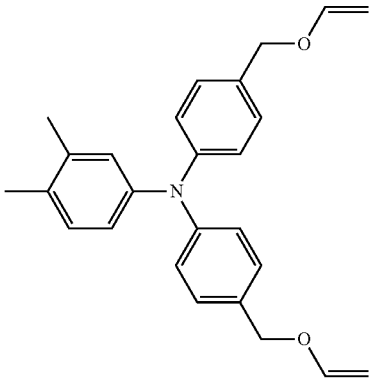
ii-32
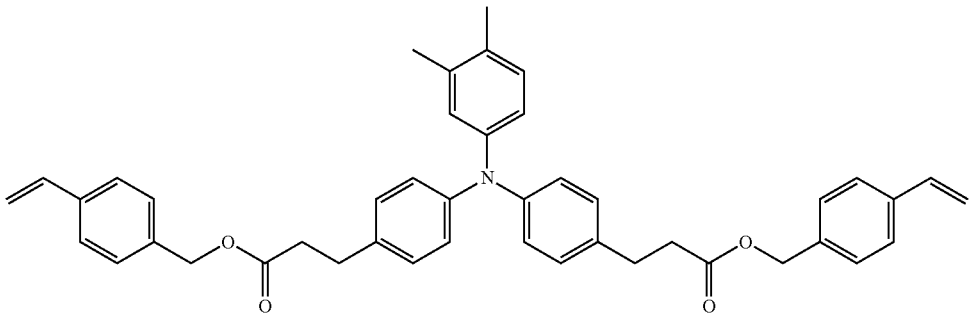
ii-33
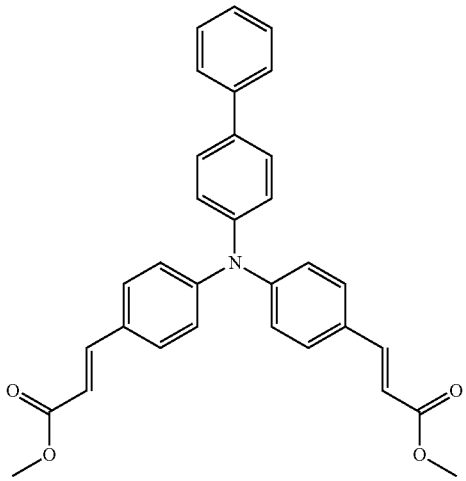
ii-34
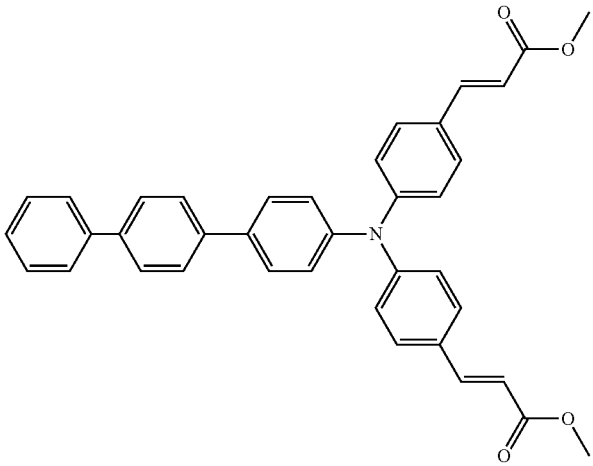

-continued
ii-35
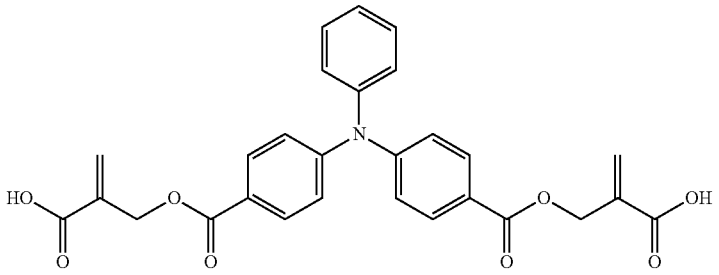
ii-36
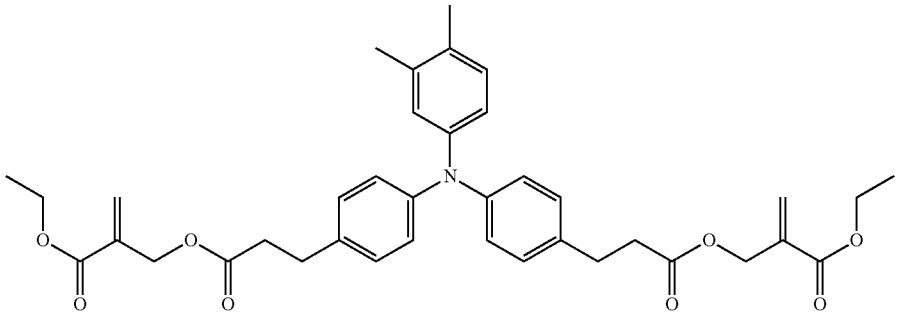
ii-37
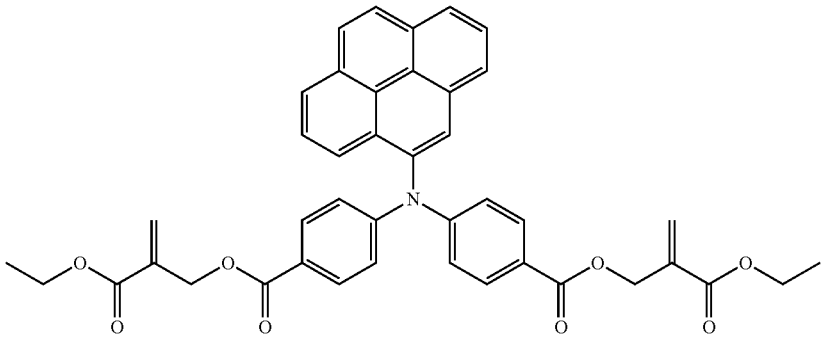
ii-38
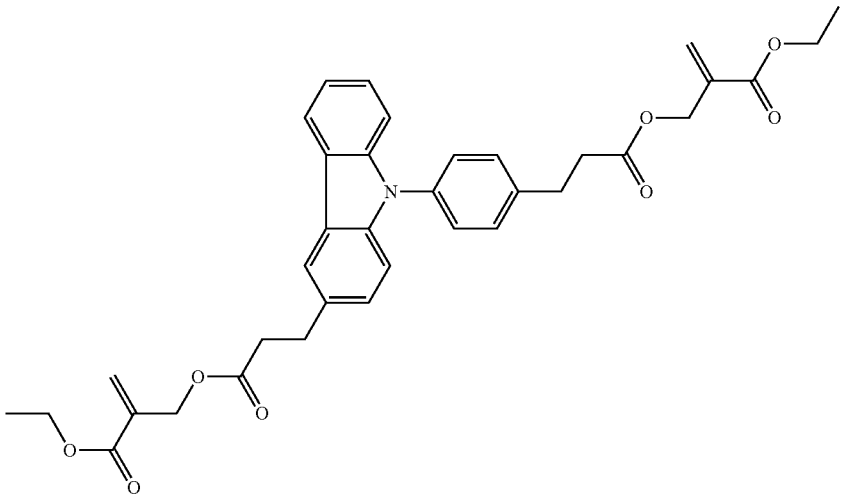

-continued
ii-39
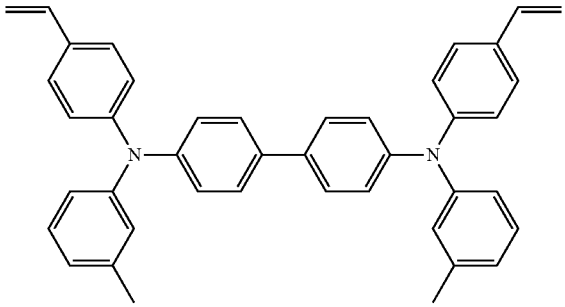
ii-40
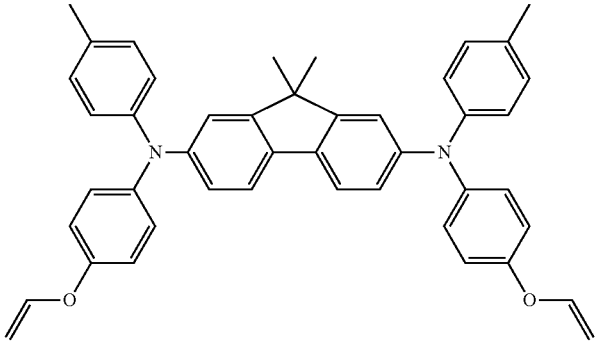
ii-41
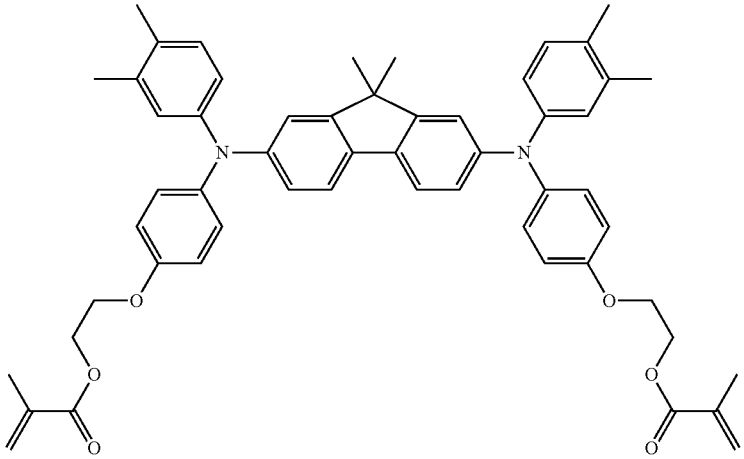
ii-42
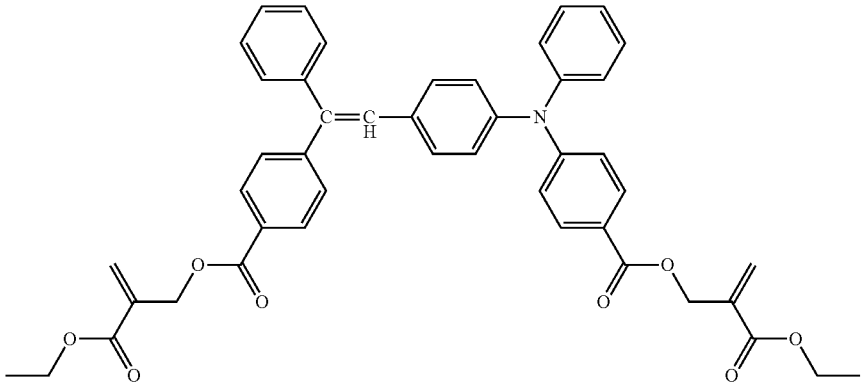
ii-43
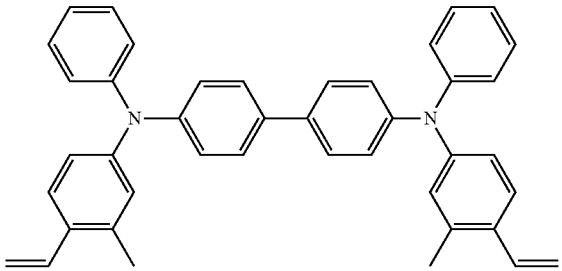

-continued
ii-44
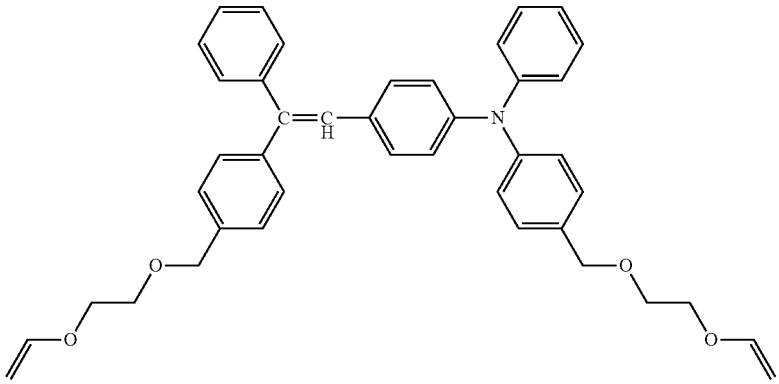
ii-45
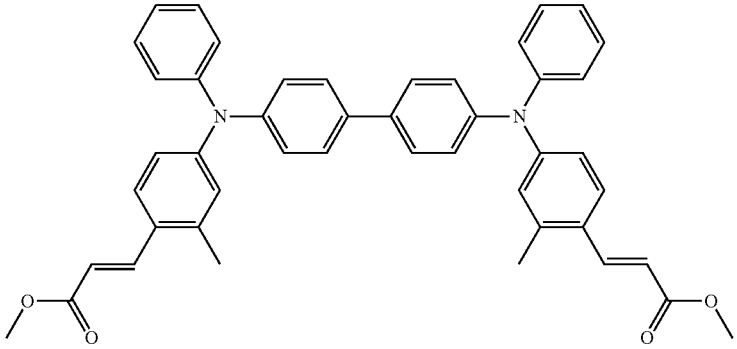
ii-46
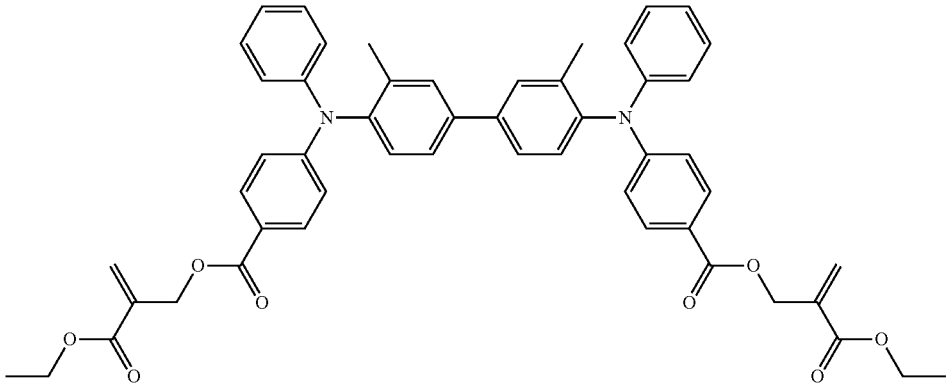
ii-47
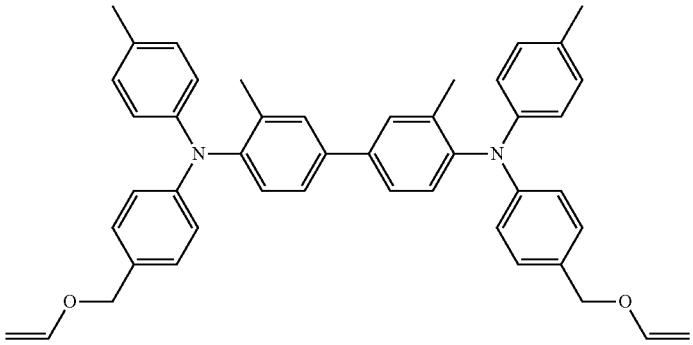

-continued
ii-48
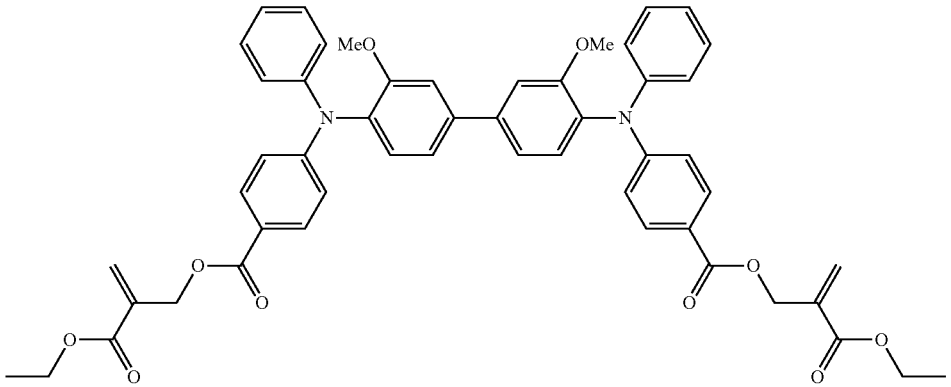
ii-49
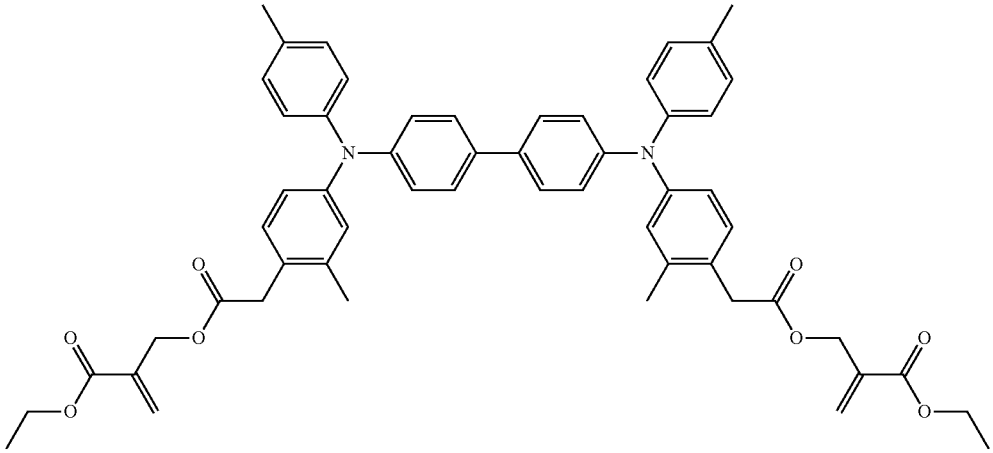
ii-50
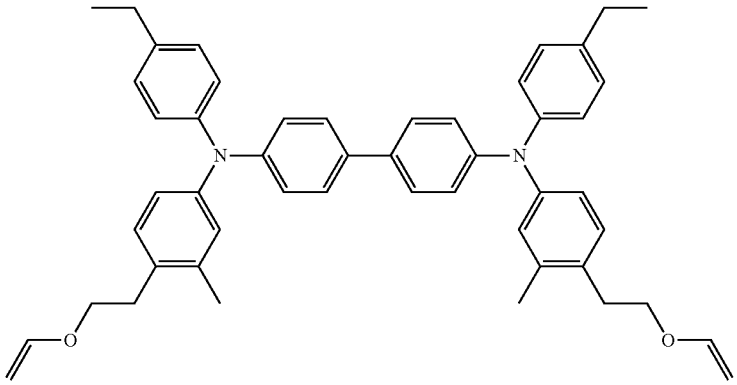

-continued
ii-51
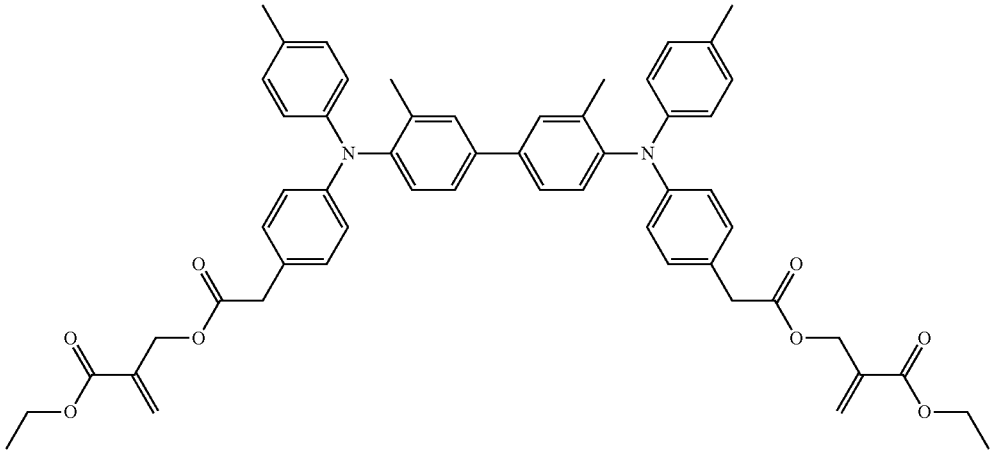
ii-52
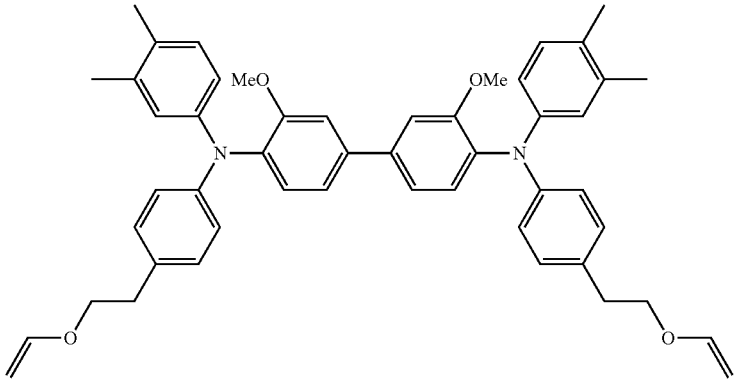
ii-53
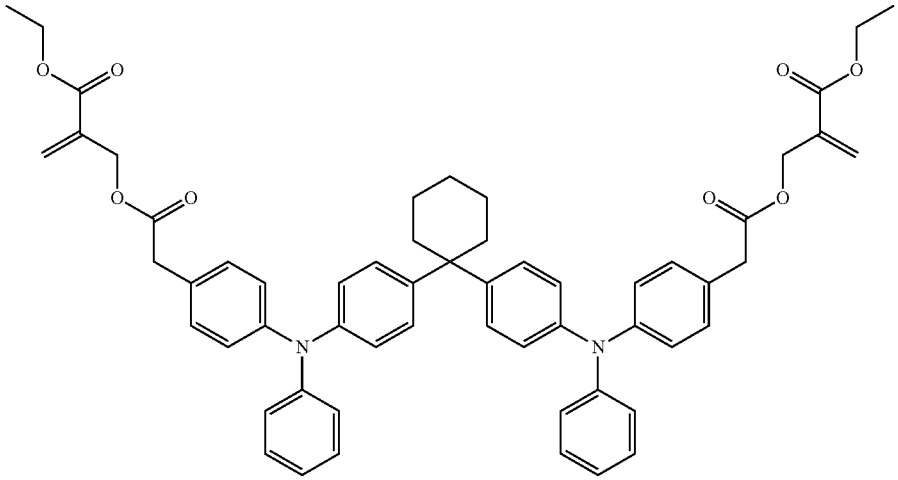

-continued
ii-54
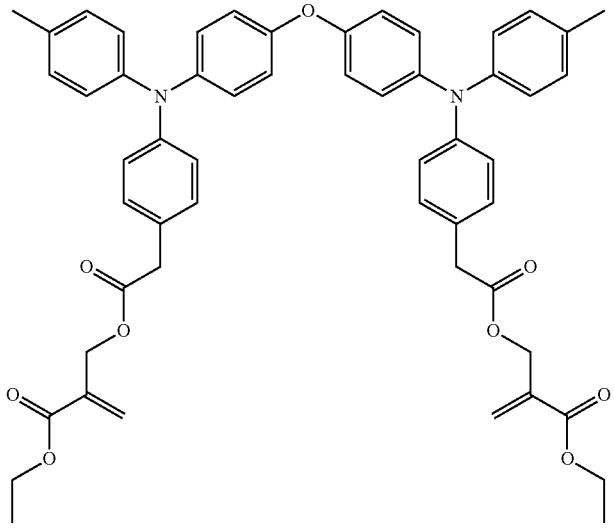
ii-55
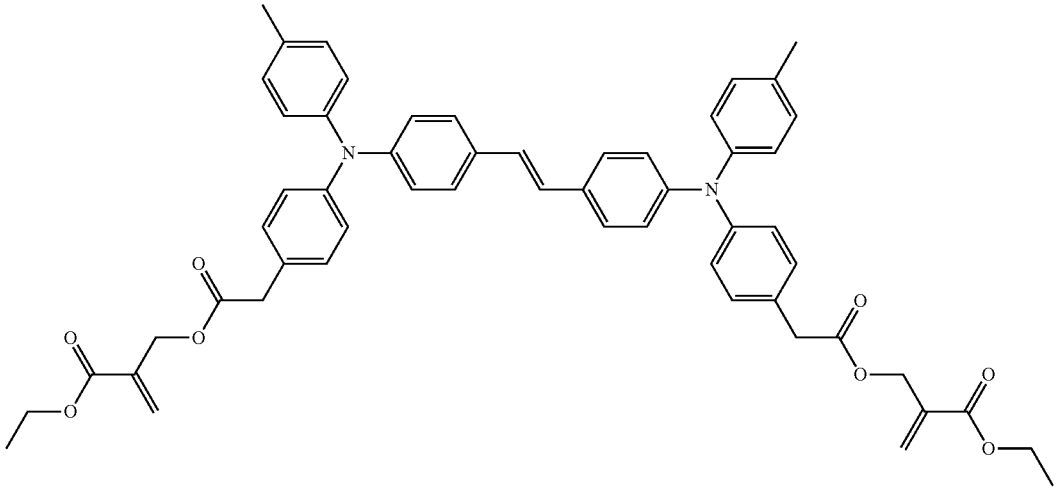
ii-56
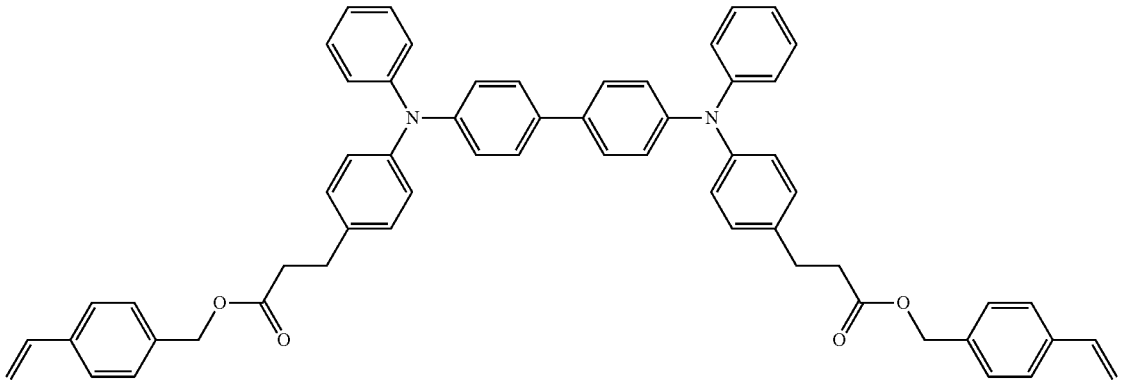

Next, specific examples of the specific charge transporting material having 3 chain polymerizable functional groups are shown, but are not limited thereto.
iii-1
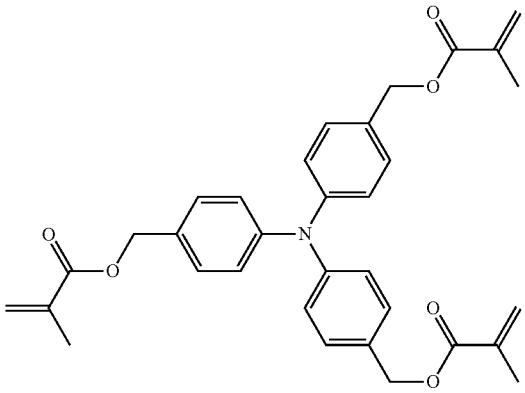
iii-2
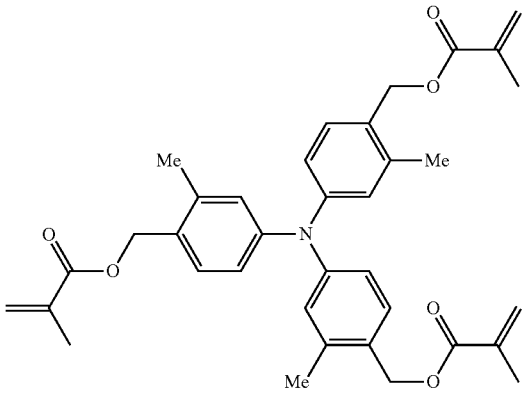
iii-3
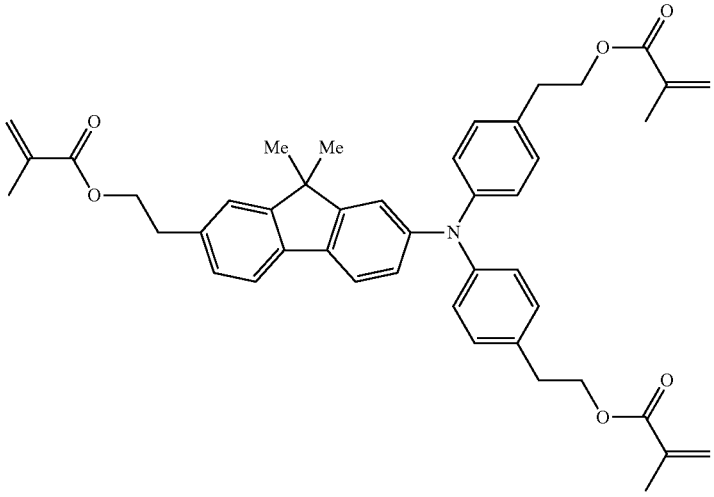
iii-4
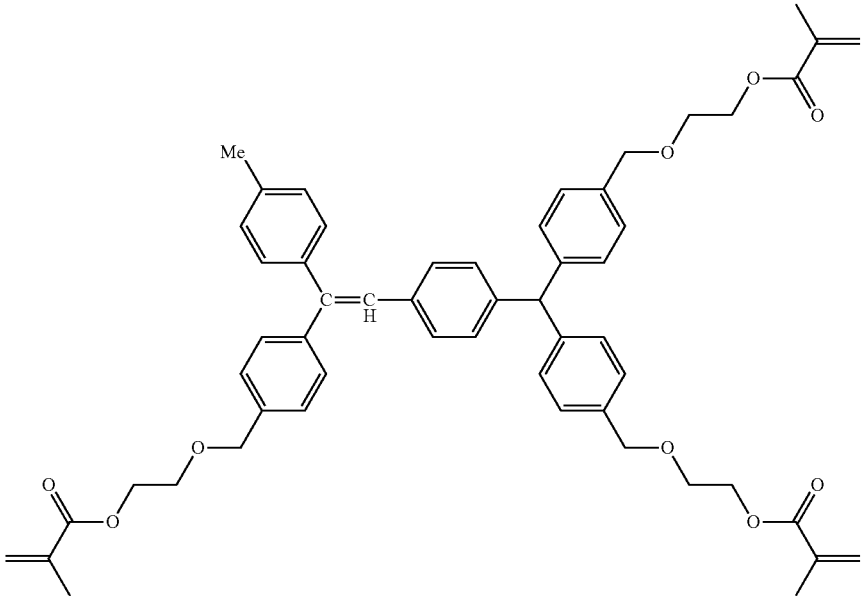

-continued
iii-5
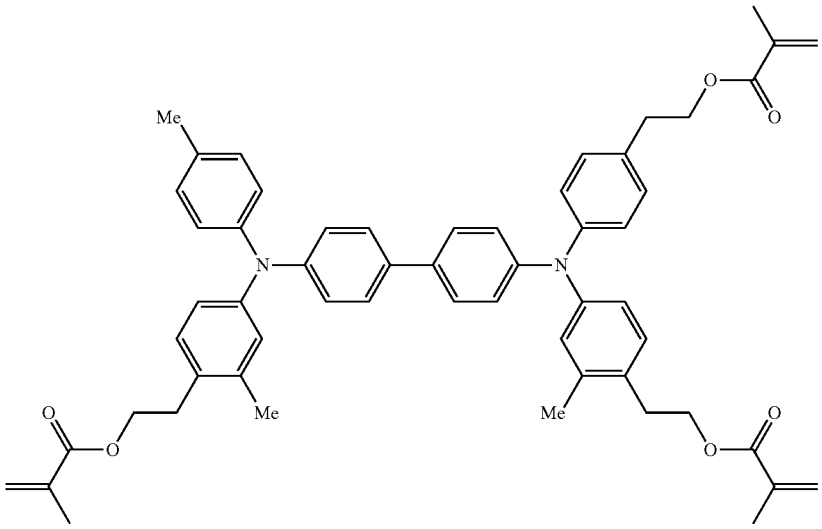
iii-6
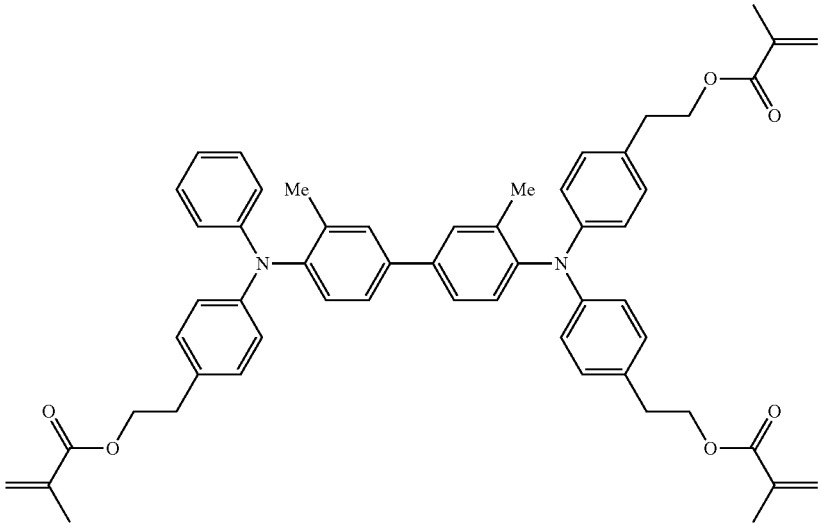
iii-7
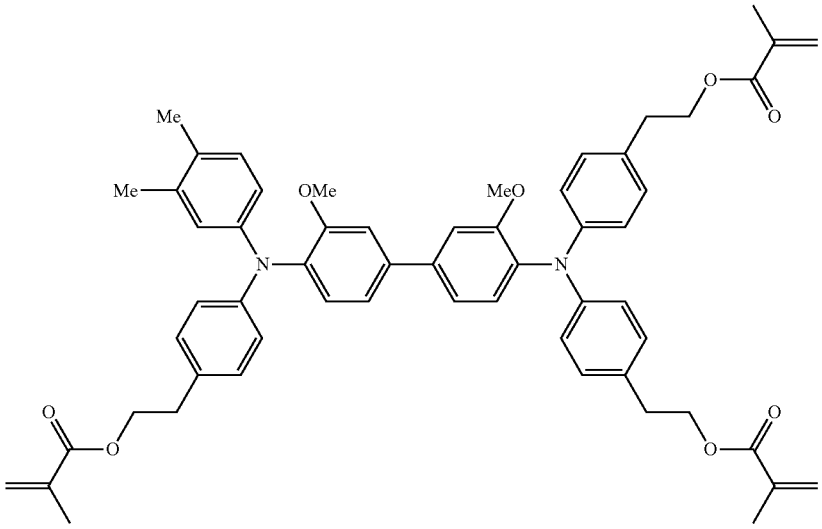

-continued
iii-8
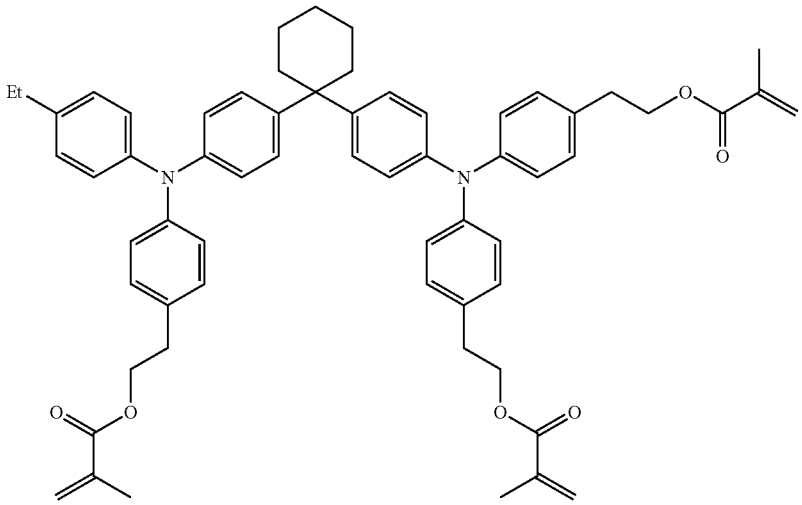
iii-9
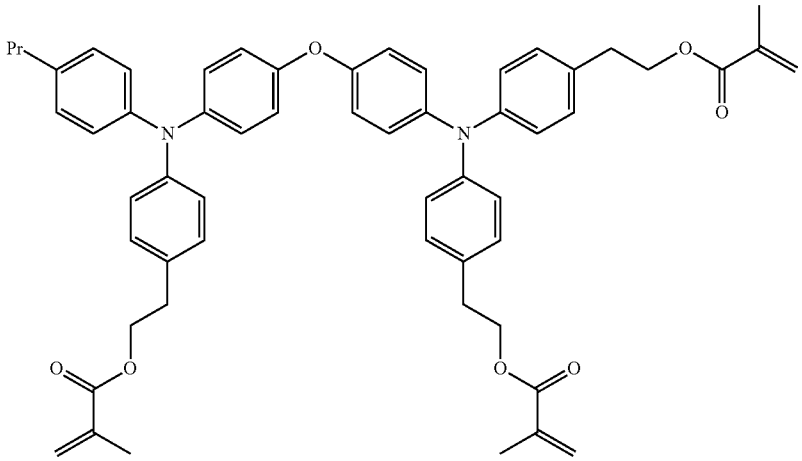
iii-10
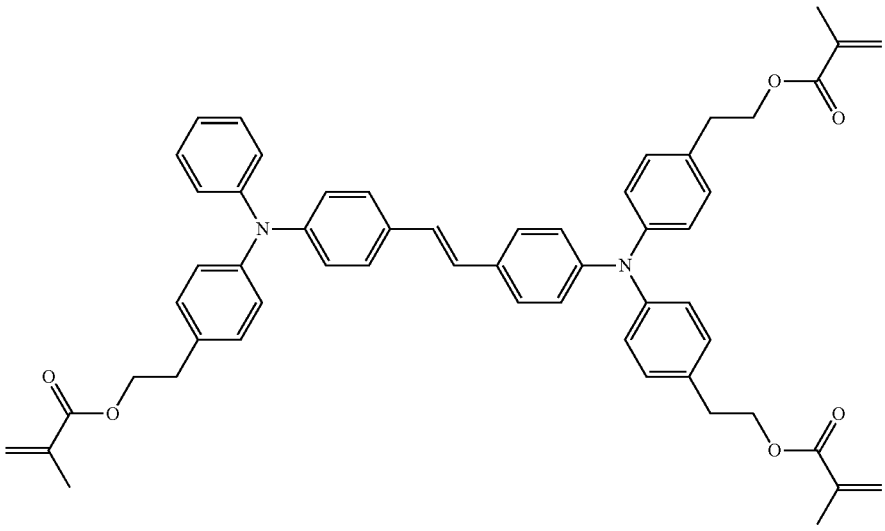

-continued
iii-11
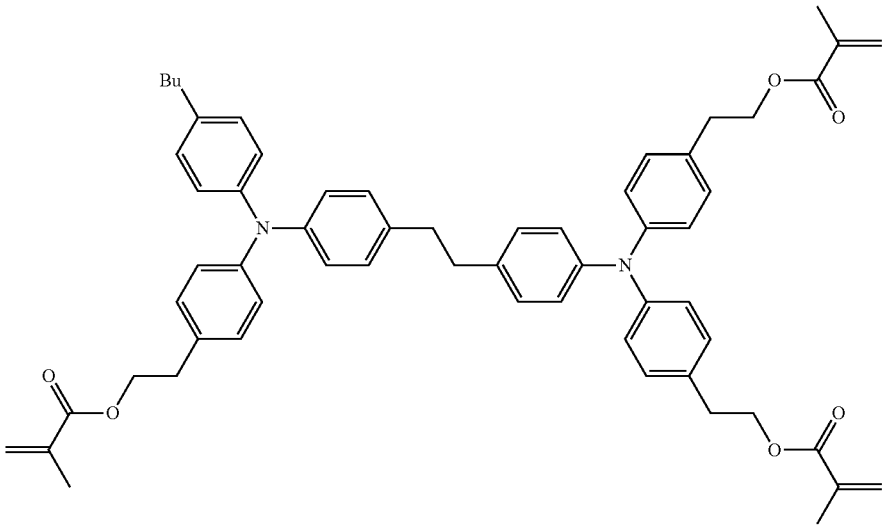
iii-12
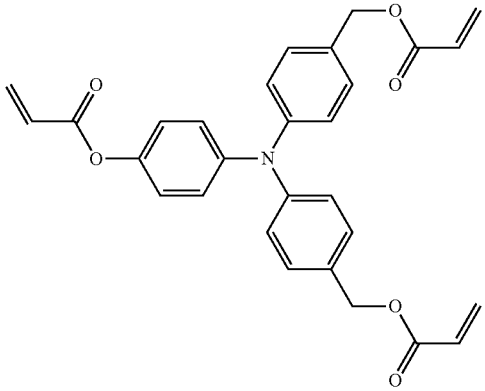
iii-13
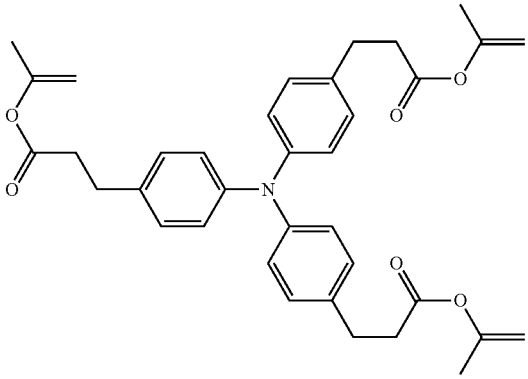
iii-14
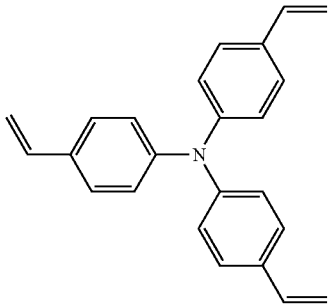
iii-15
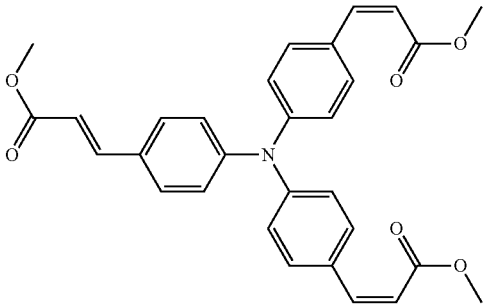
iii-16
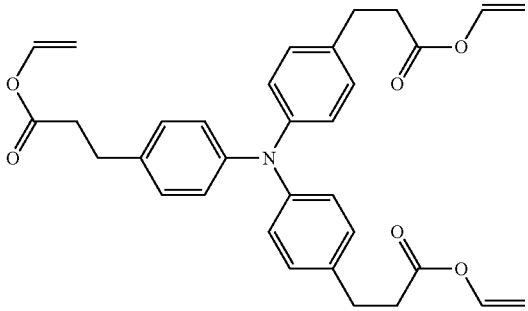

-continued
iii-17
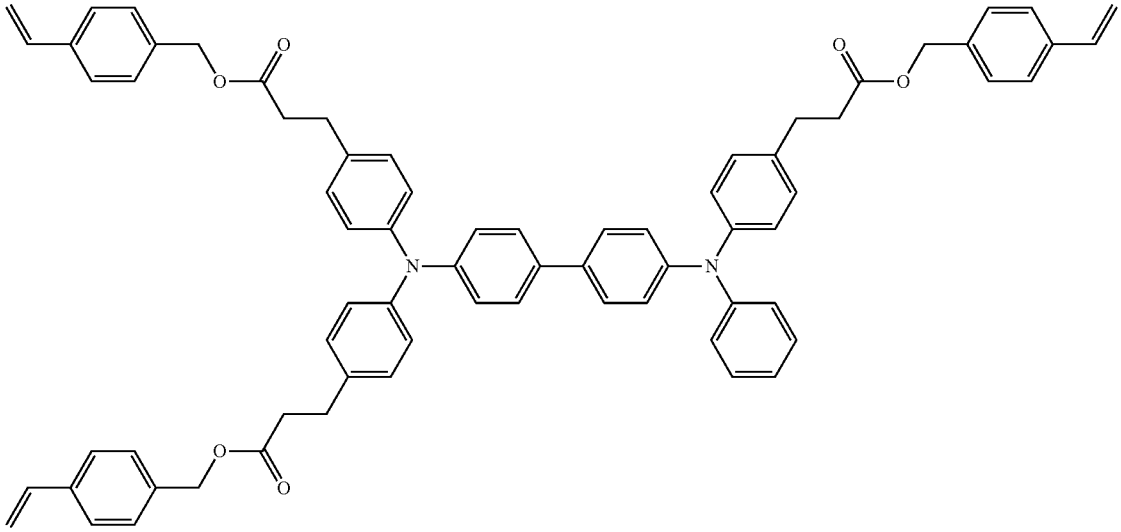
iii-18
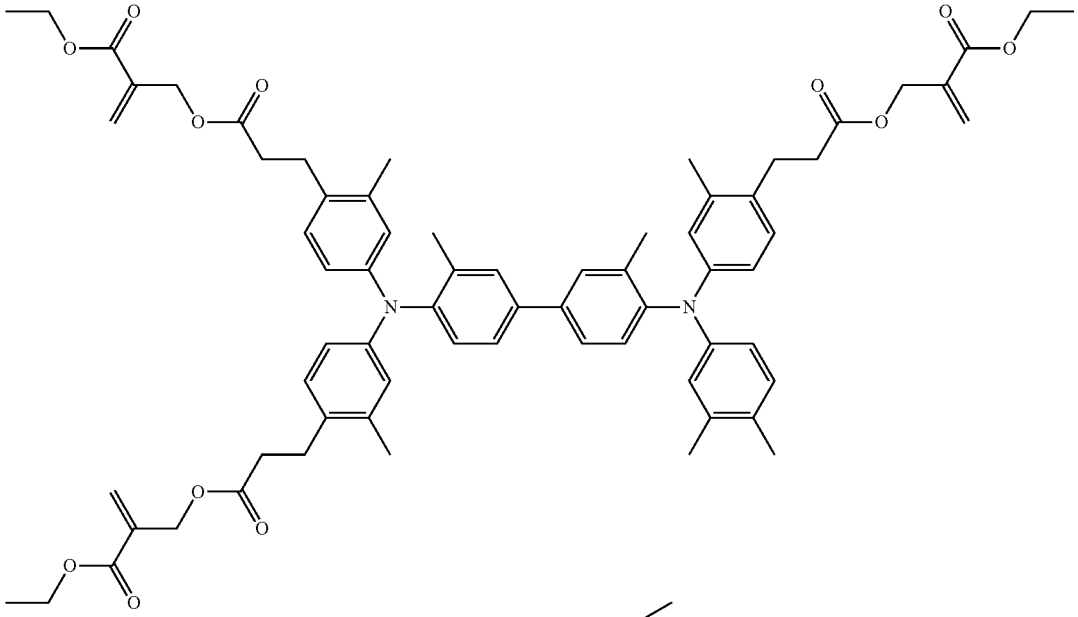
iii-19
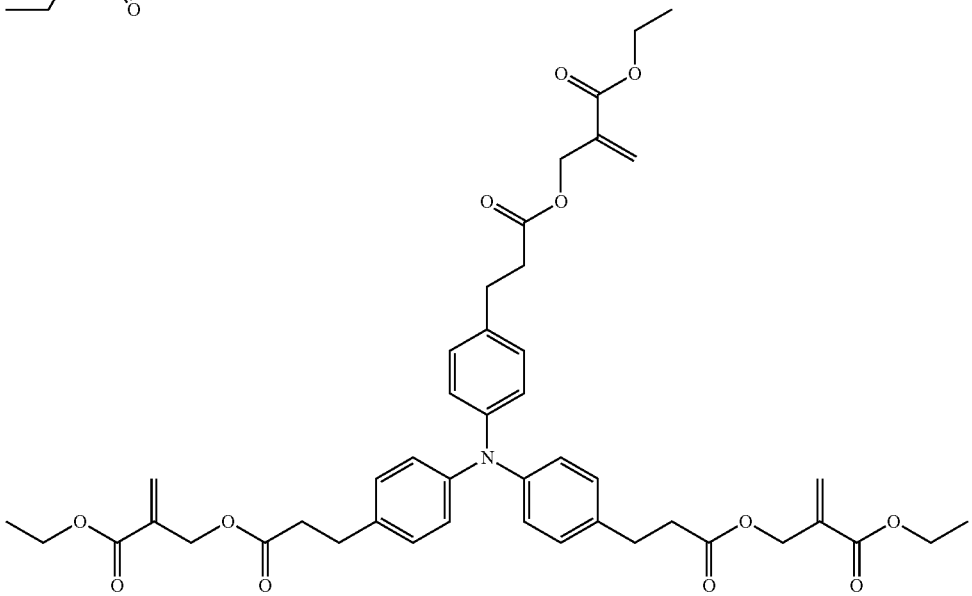

Next, specific examples of the specific charge transporting material having 4 to 6 chain polymerizable functional groups are shown, but are not limited thereto.
iv-1
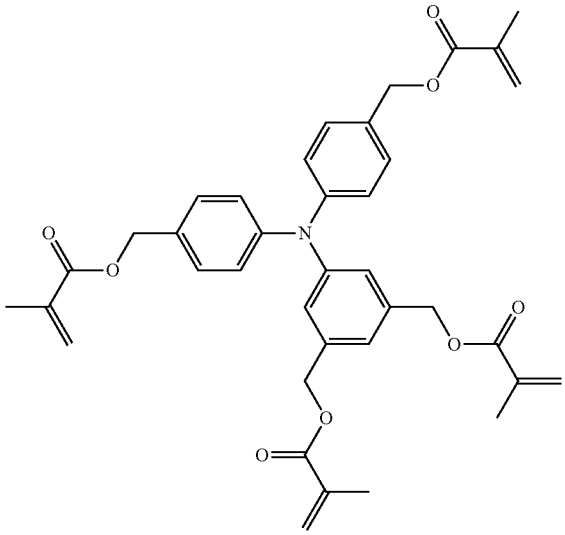
iv-2
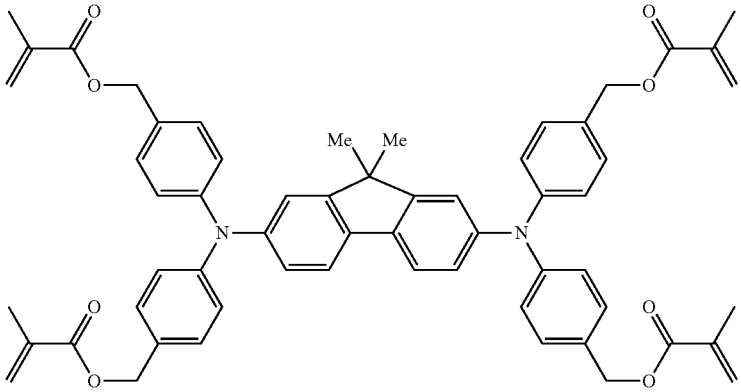
iv-3
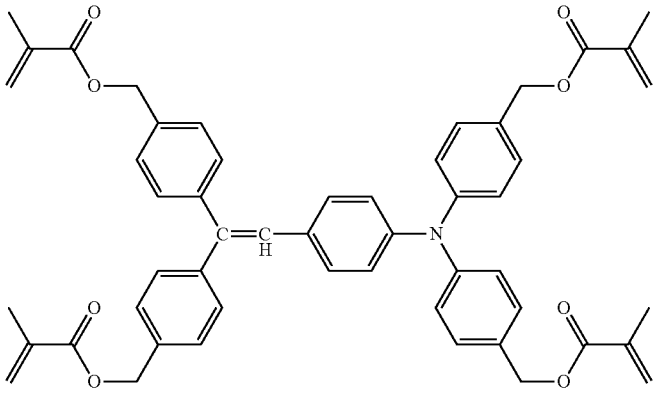

-continued
iv-4
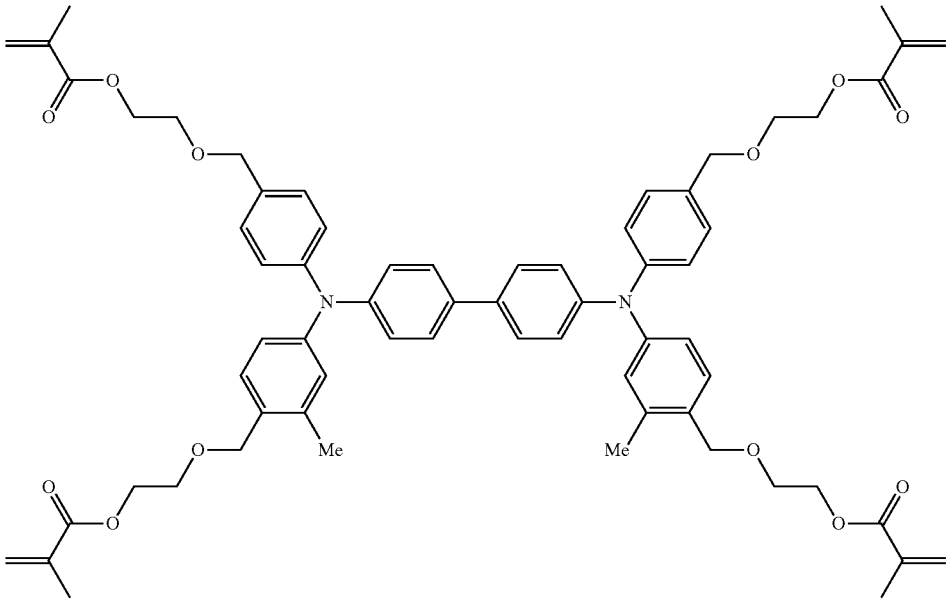
iv-5
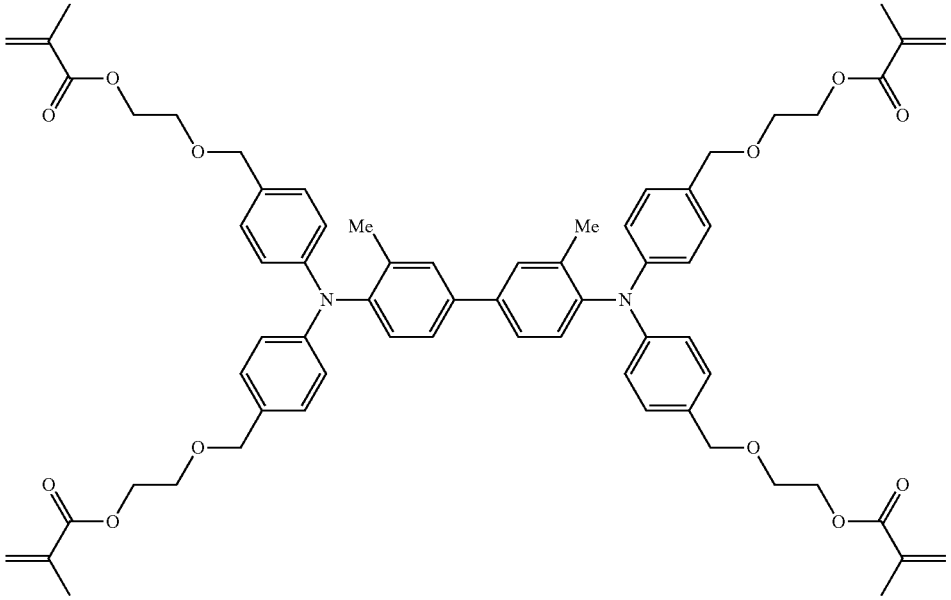

-continued
iv-6
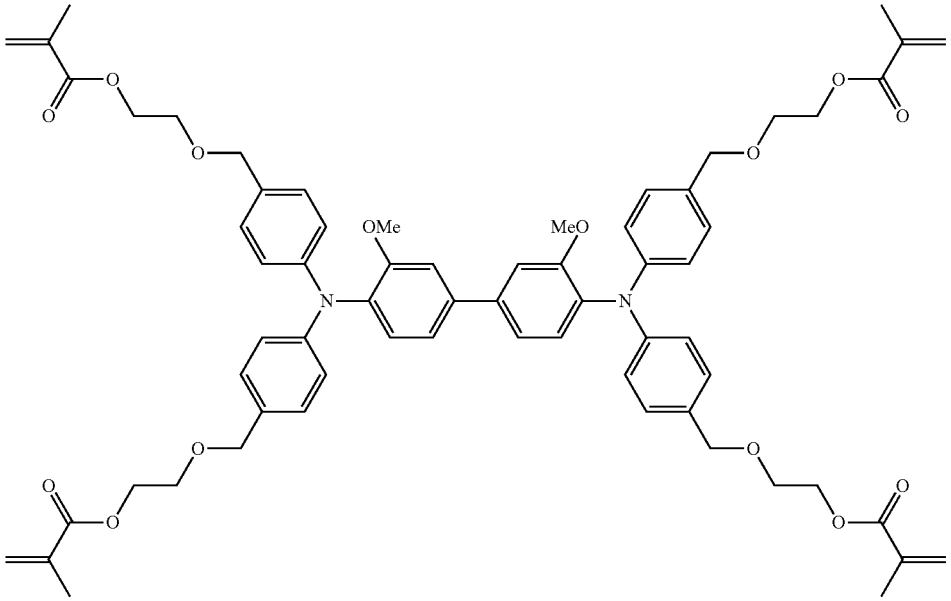
iv-7
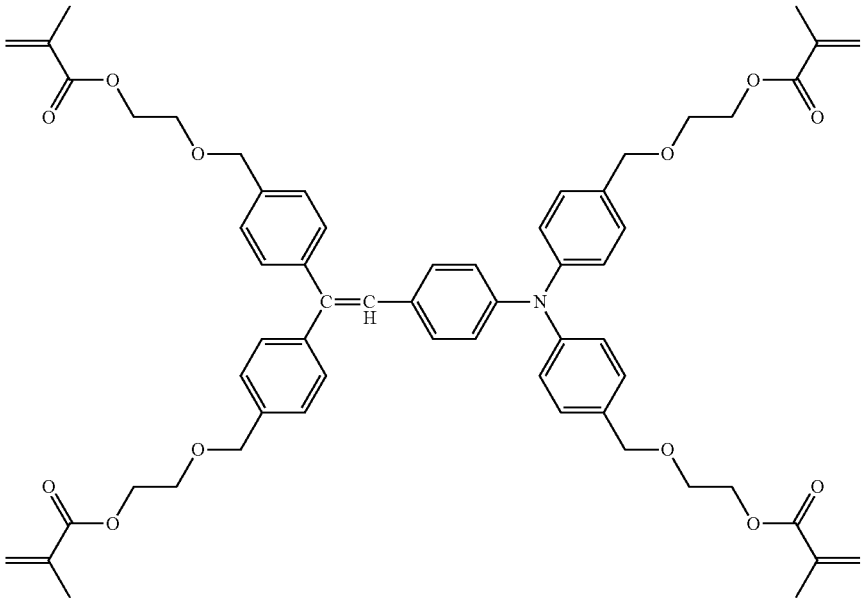

-continued
iv-8
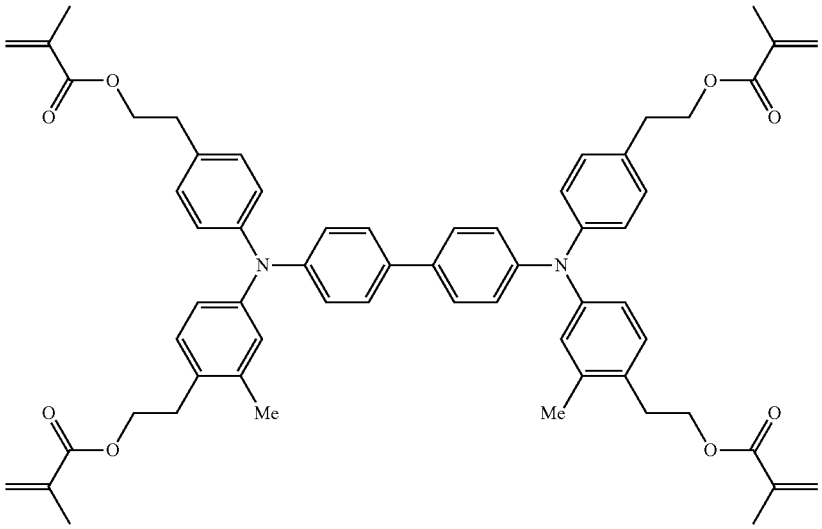
iv-9
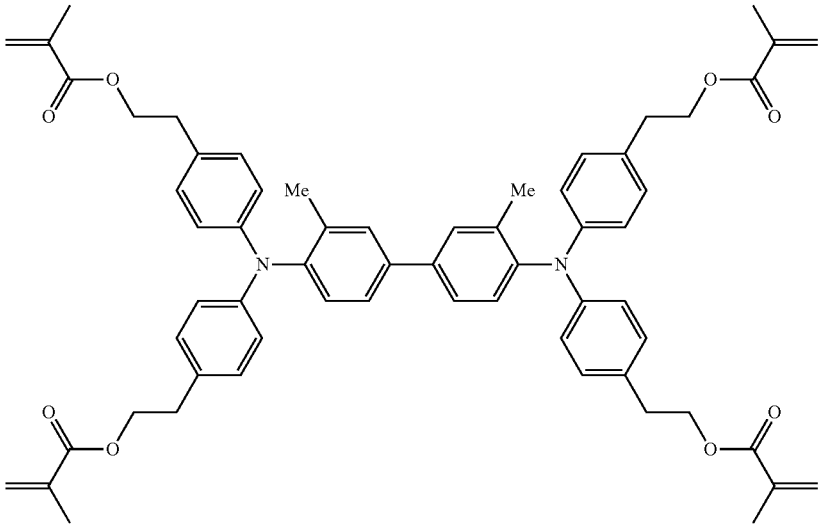
iv-10
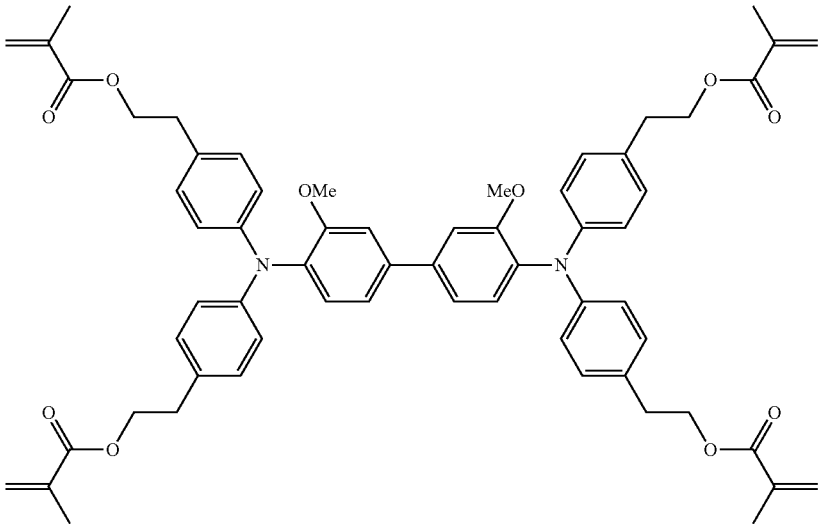

-continued
iv-11
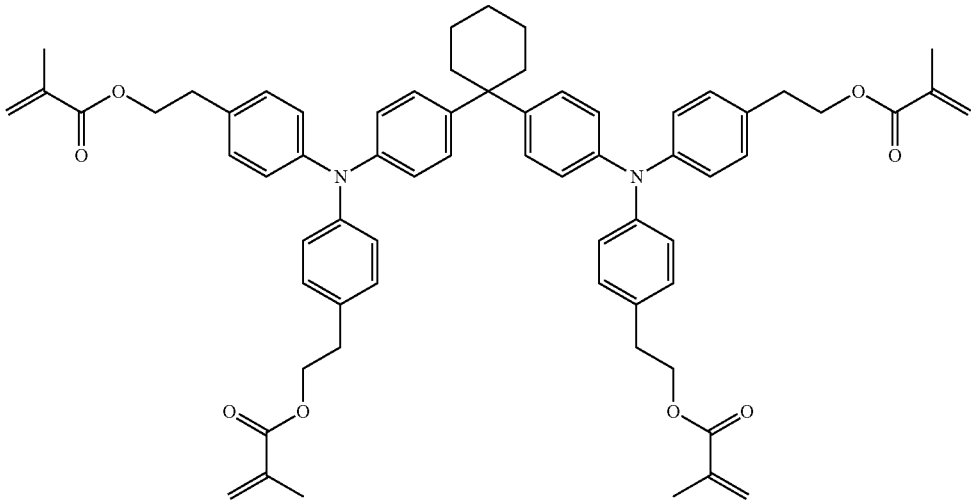
iv-12
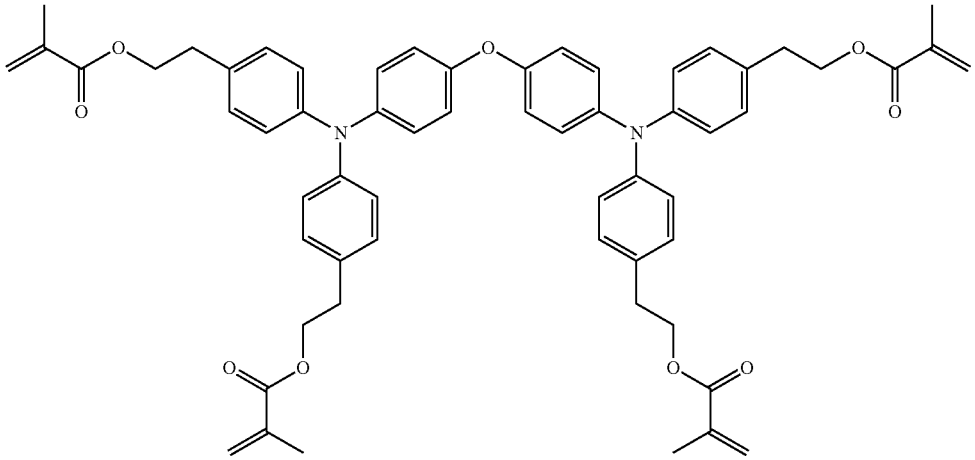
iv-13
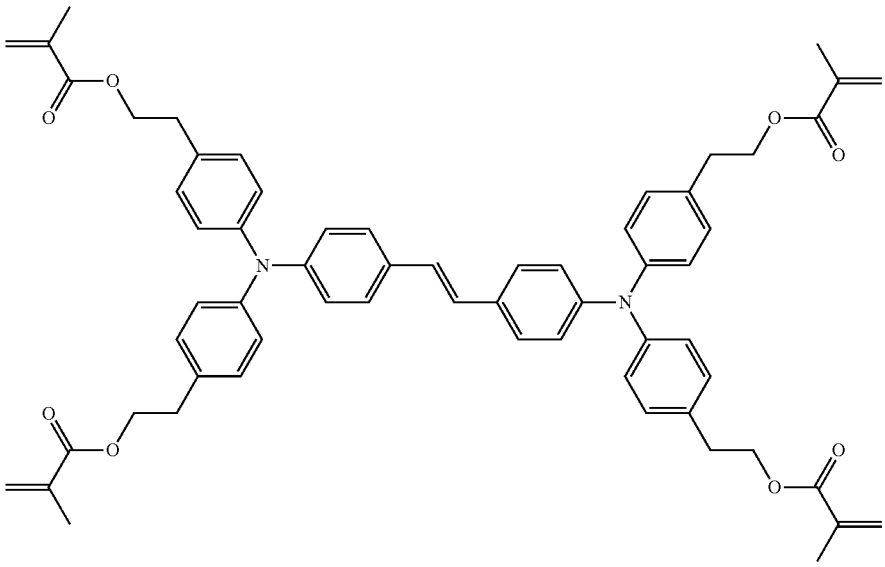

-continued
iv-14
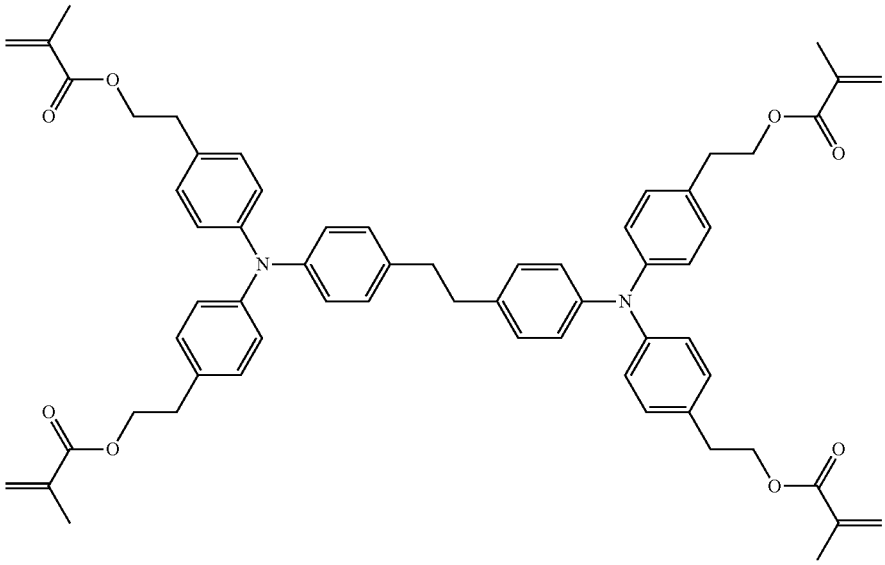
iv-15
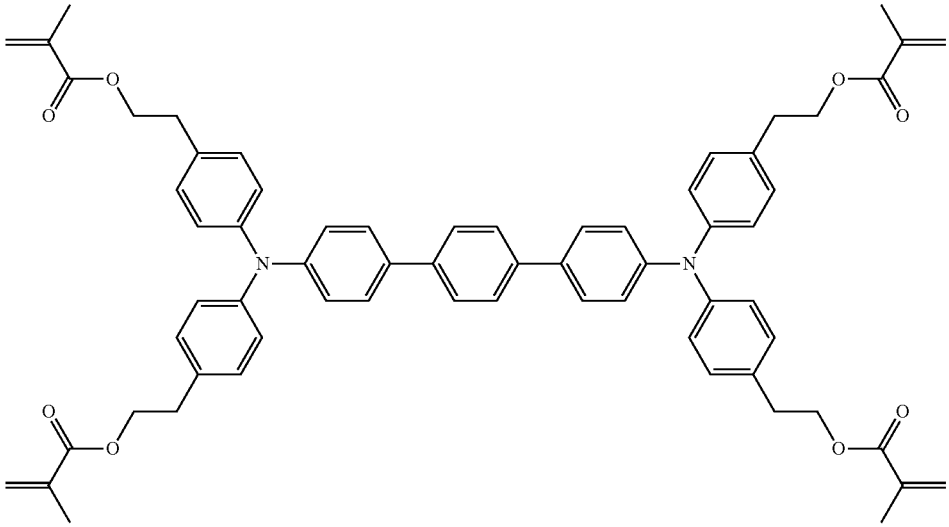
iv-16
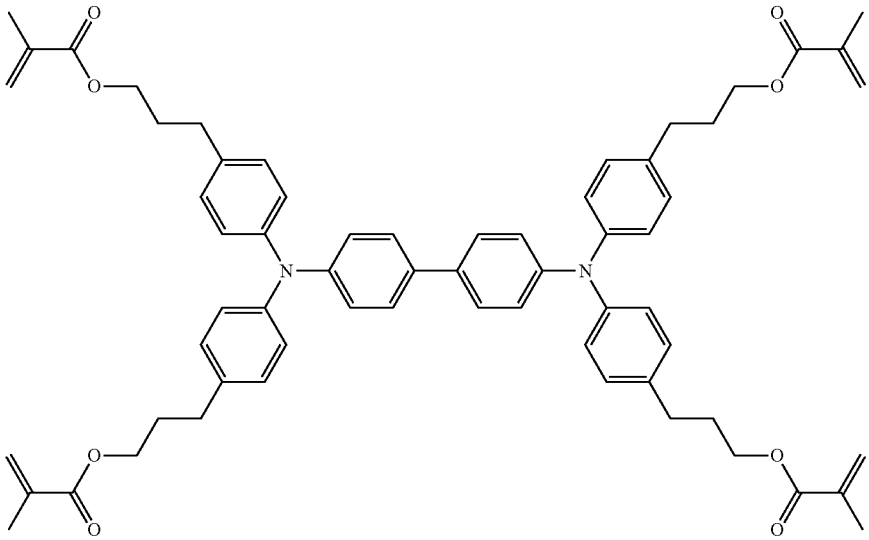

-continued
iv-17
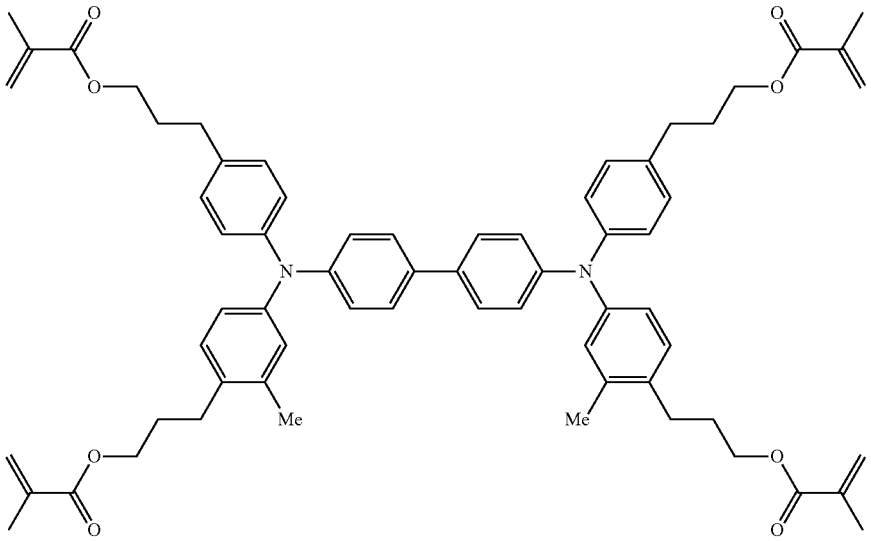
iv-18
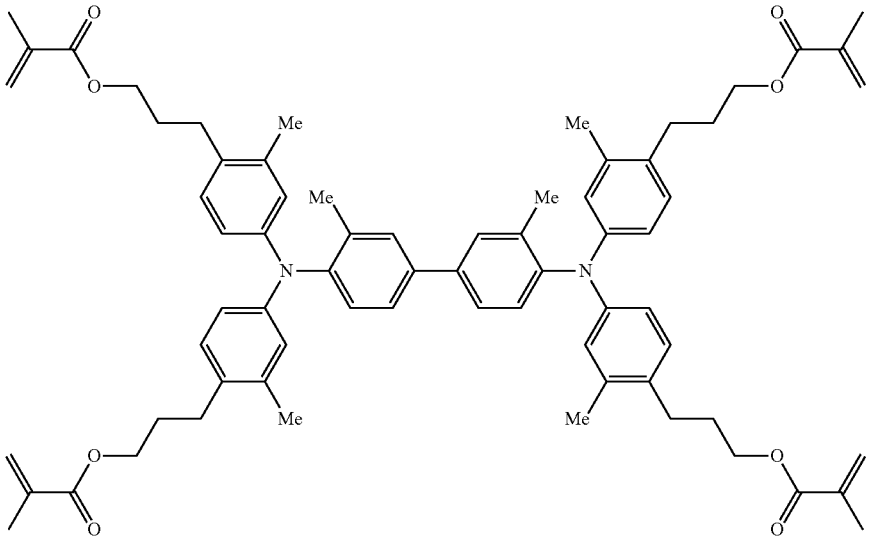

-continued
iv-19
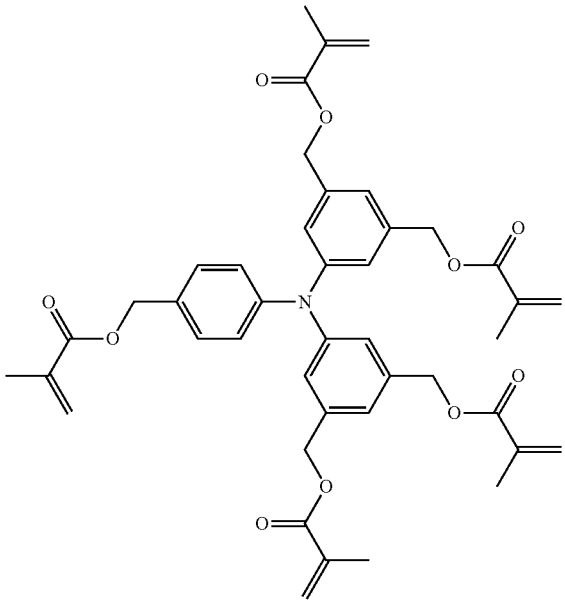
iv-20
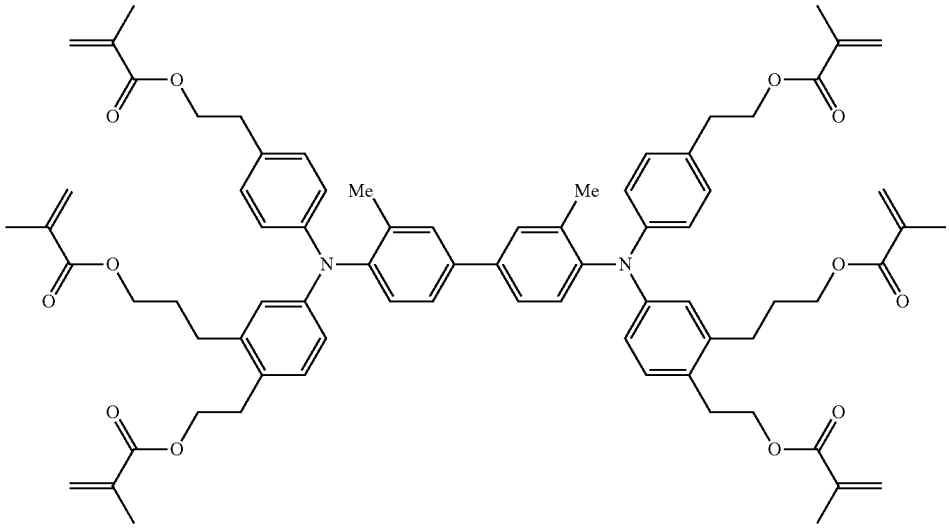

-continued
iv-21
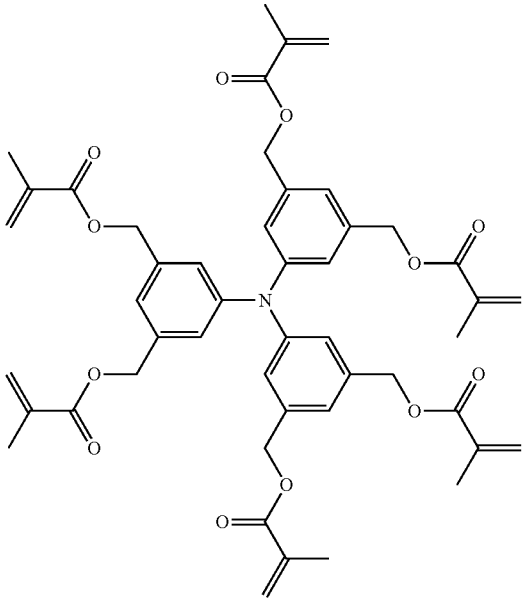
iv-22
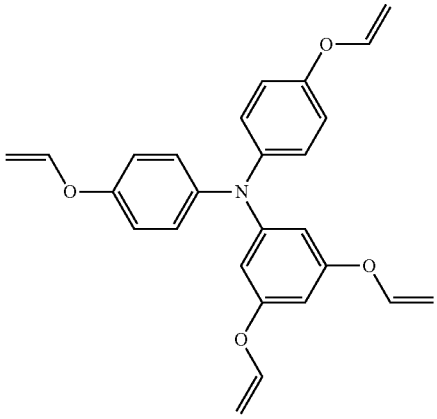
iv-23
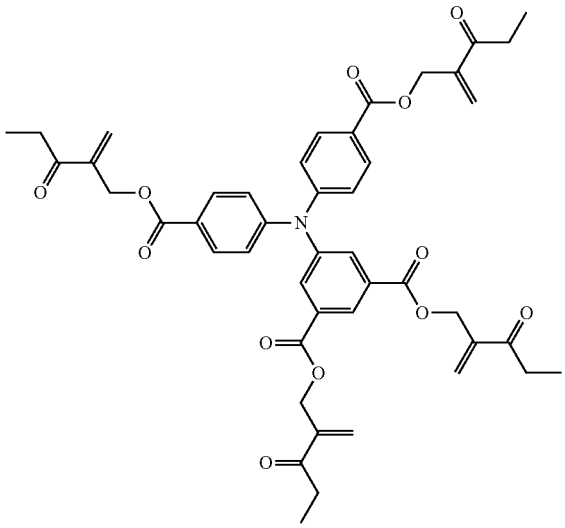
iv-24
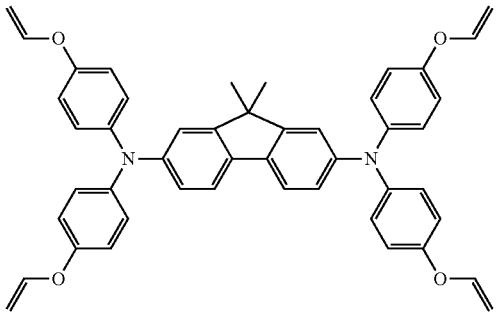

-continued
iv-25
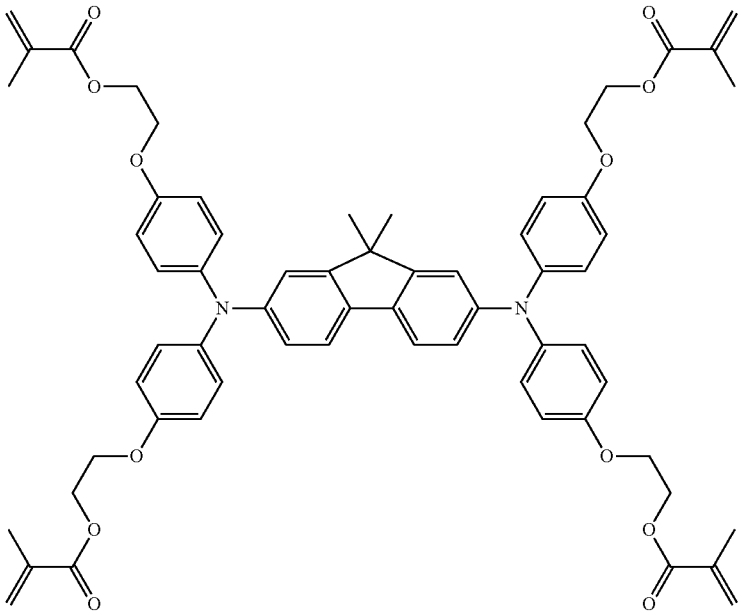
iv-26
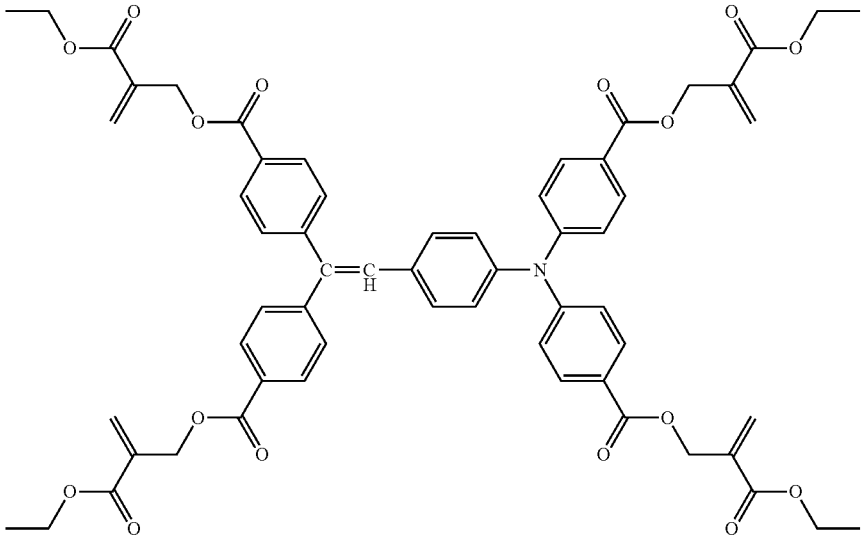

-continued
iv-27
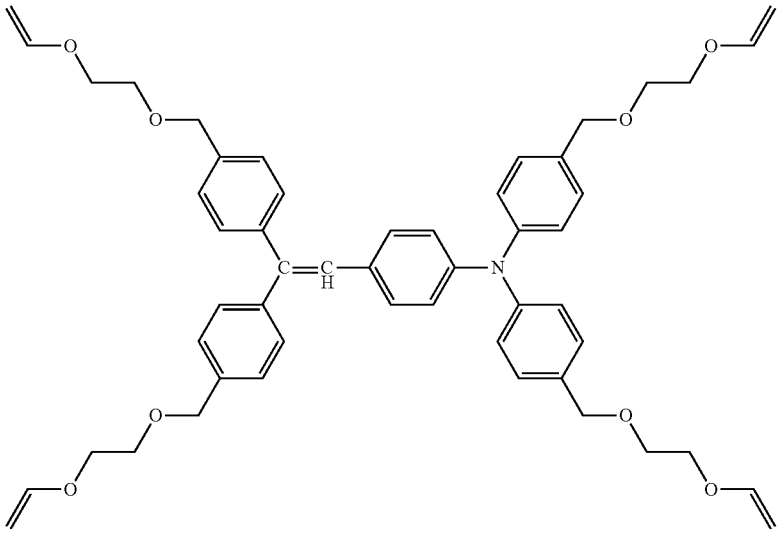
iv-28
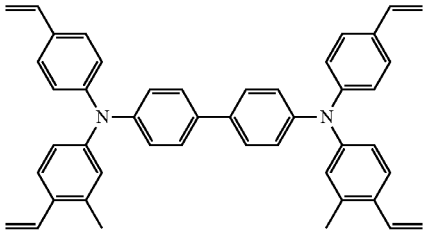
iv-29
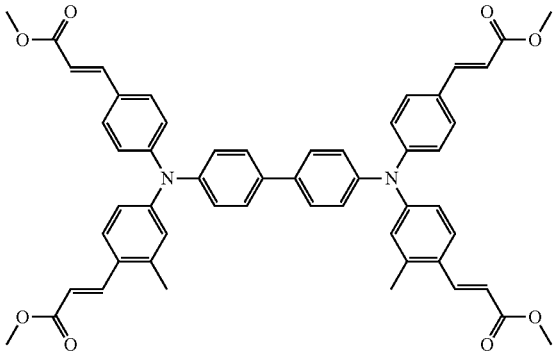
iv-30
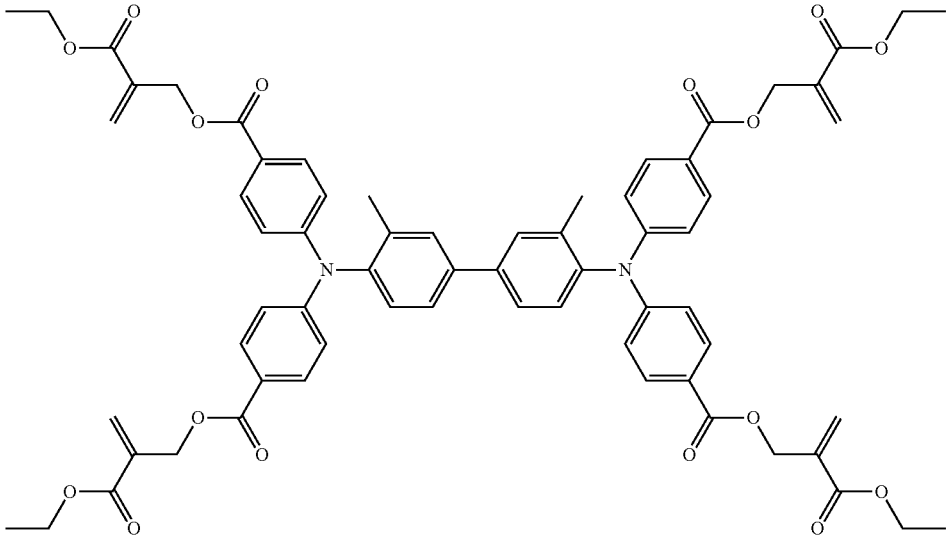

-continued
iv-31
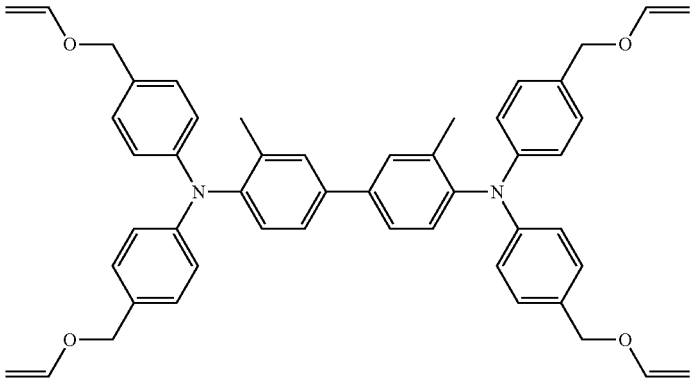
iv-32
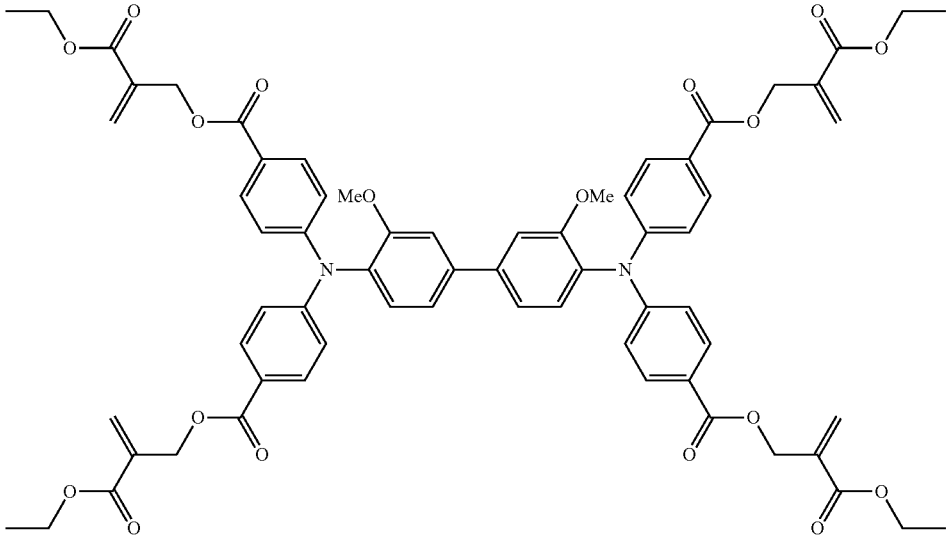
iv-33
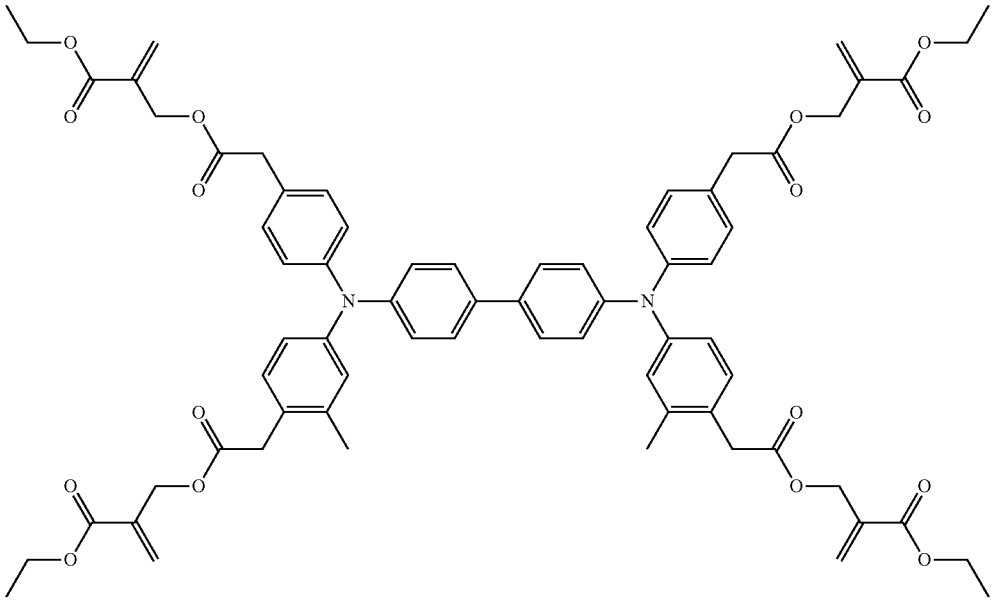

-continued
iv-34
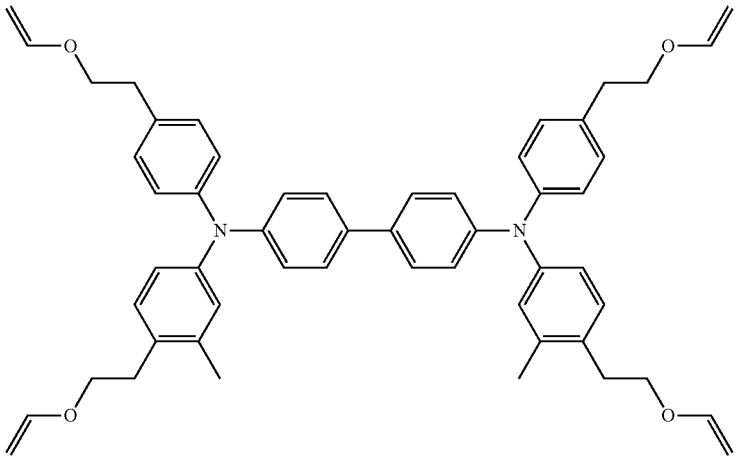
iv-35
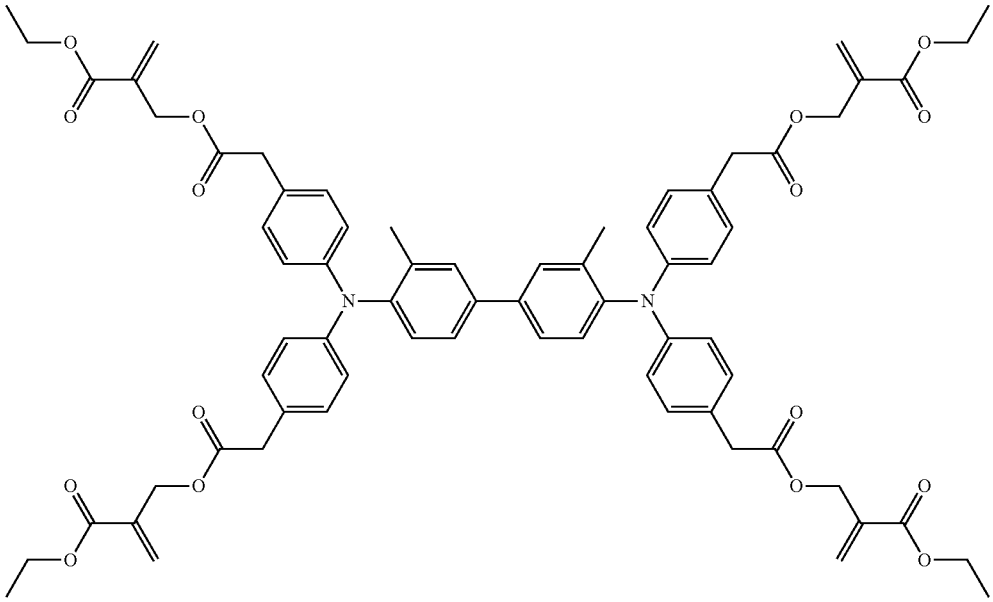
iv-36
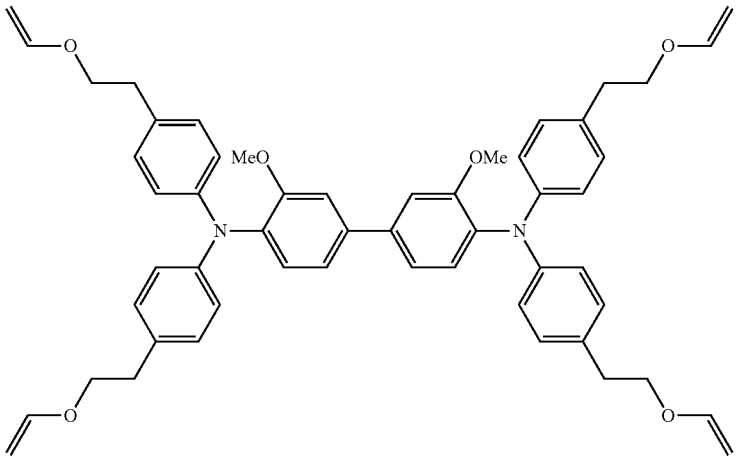

-continued
iv-37
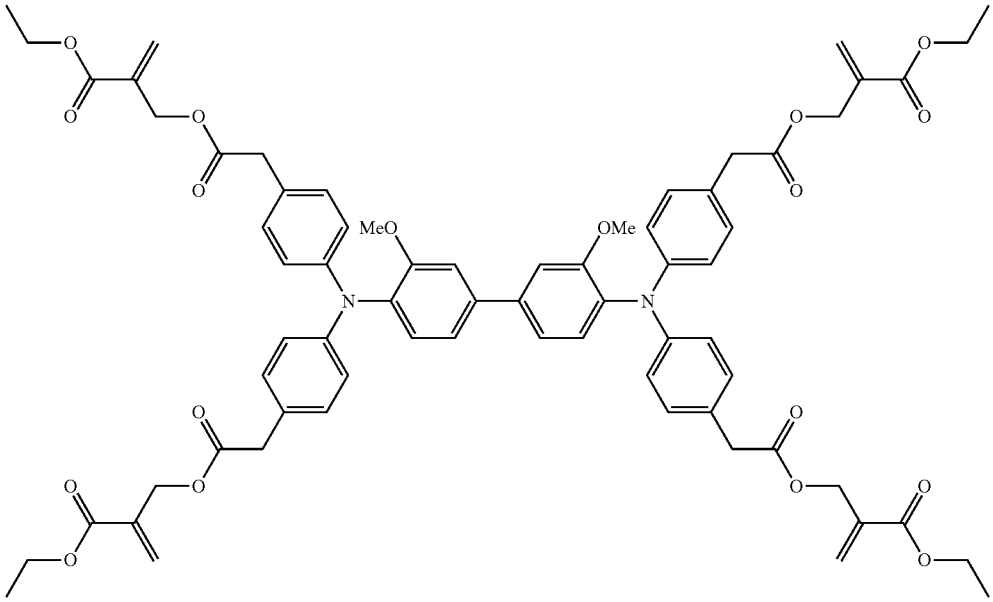
iv-38
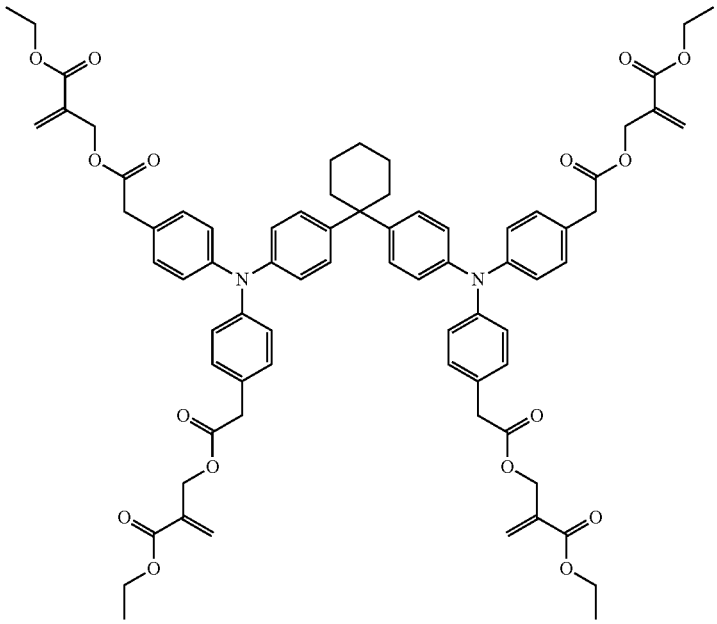

-continued
iv-39
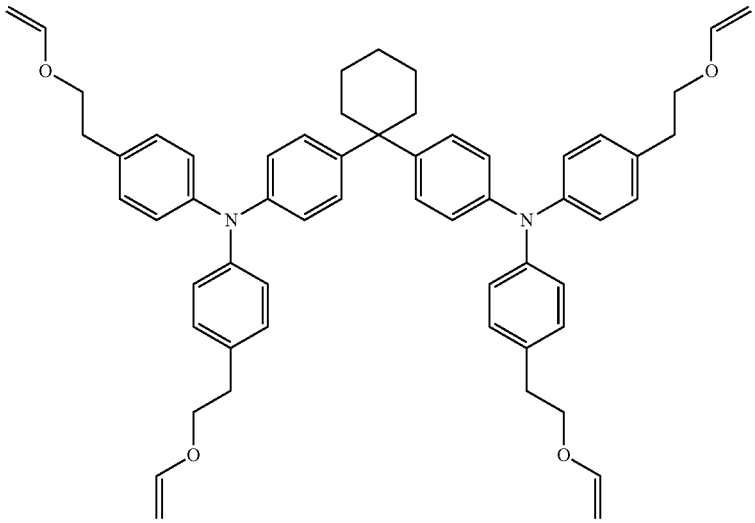
iv-40
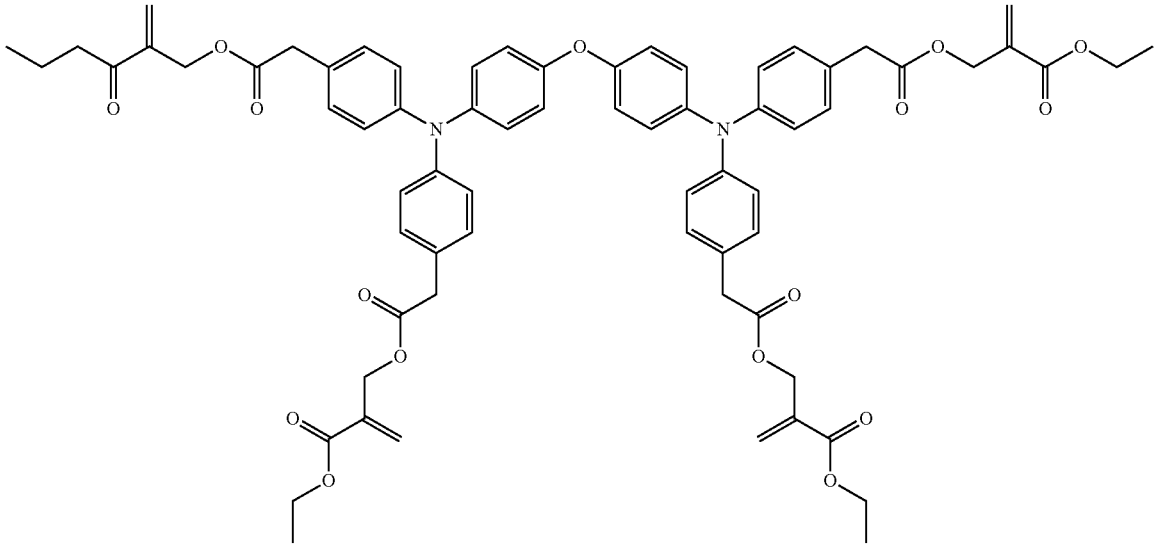

-continued
iv-41
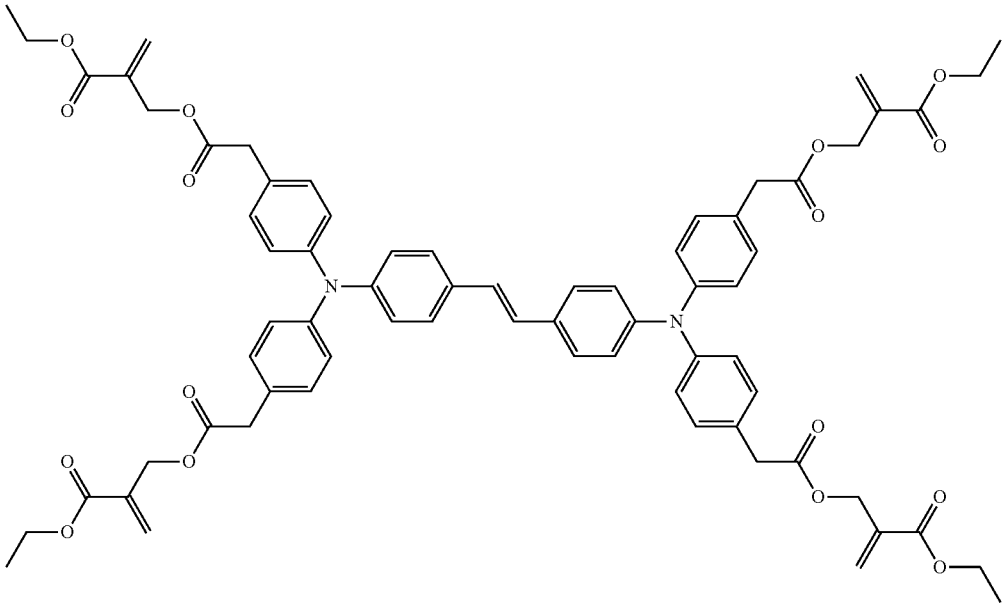
iv-42
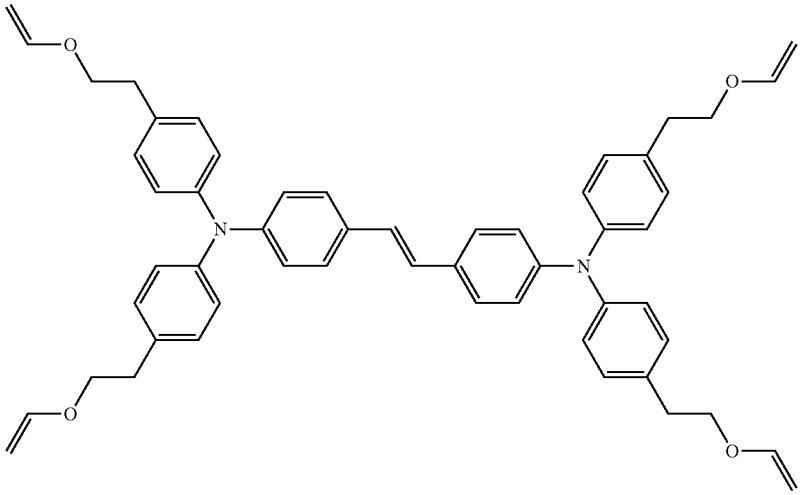

-continued
iv-43
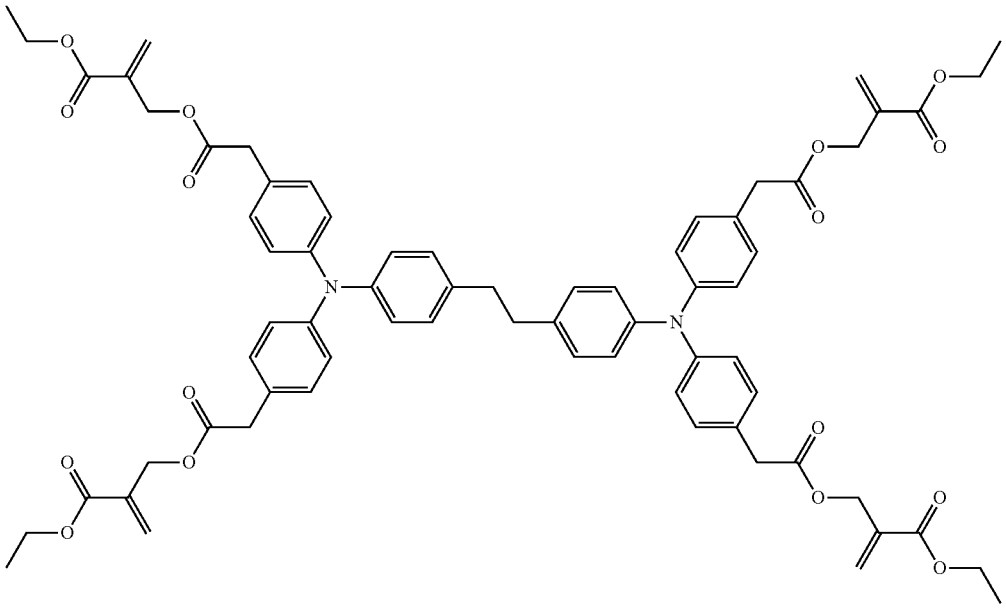
iv-44
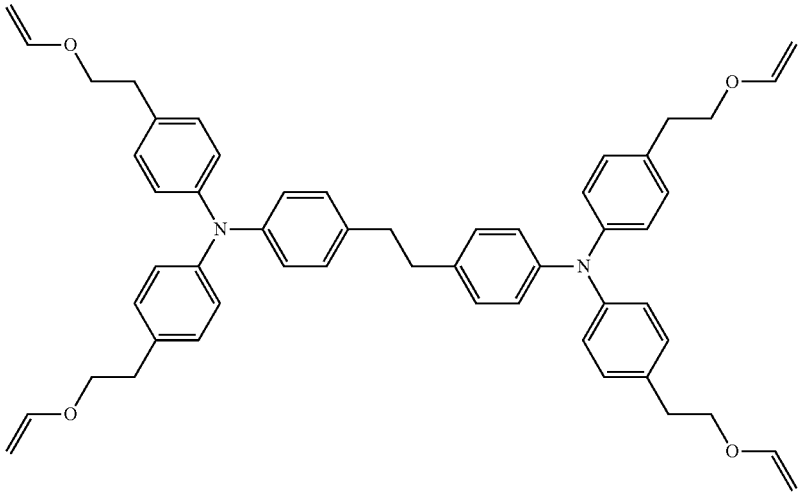

-continued
iv-45
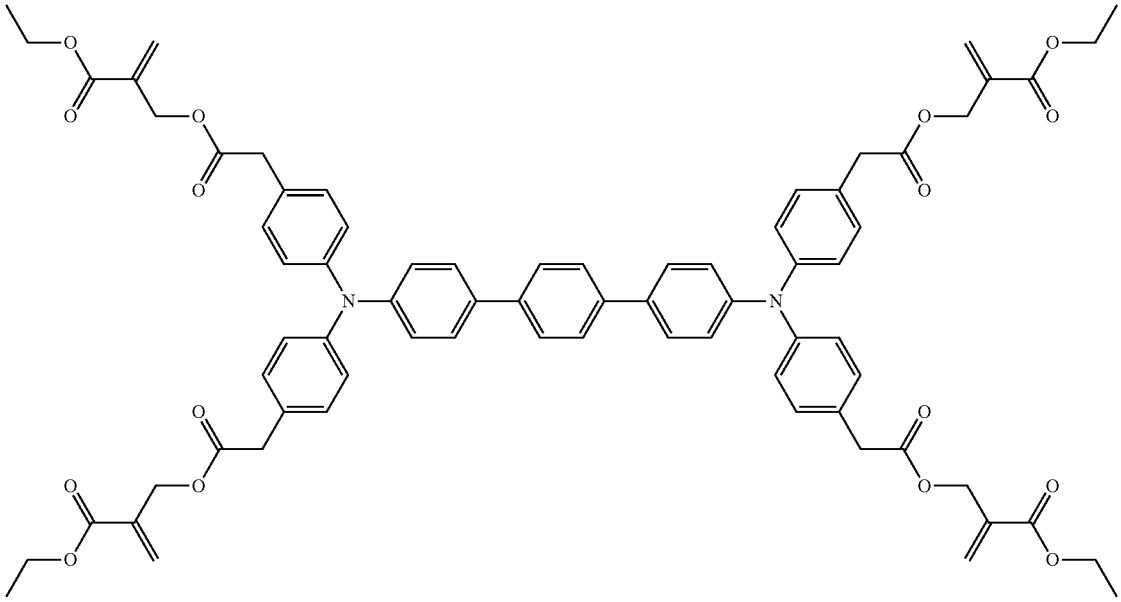
iv-46
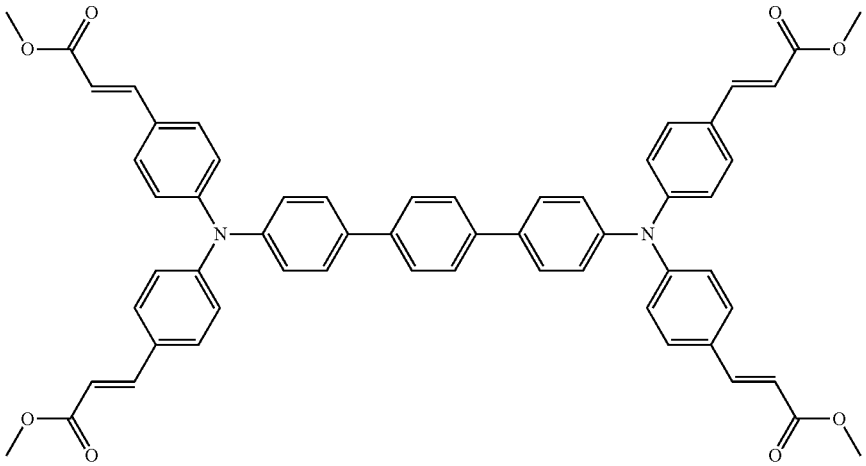
iv-47
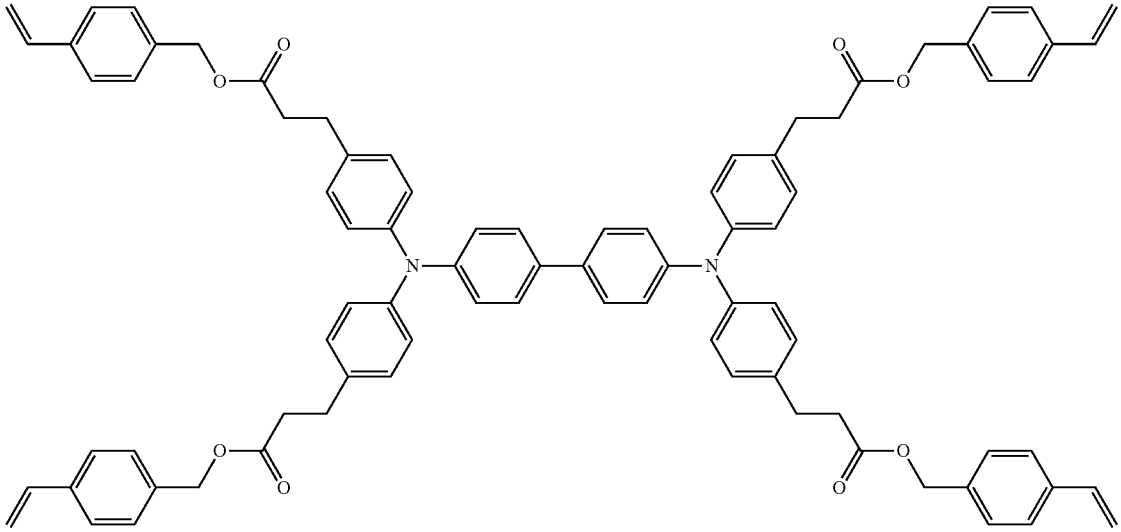

-continued
iv-48
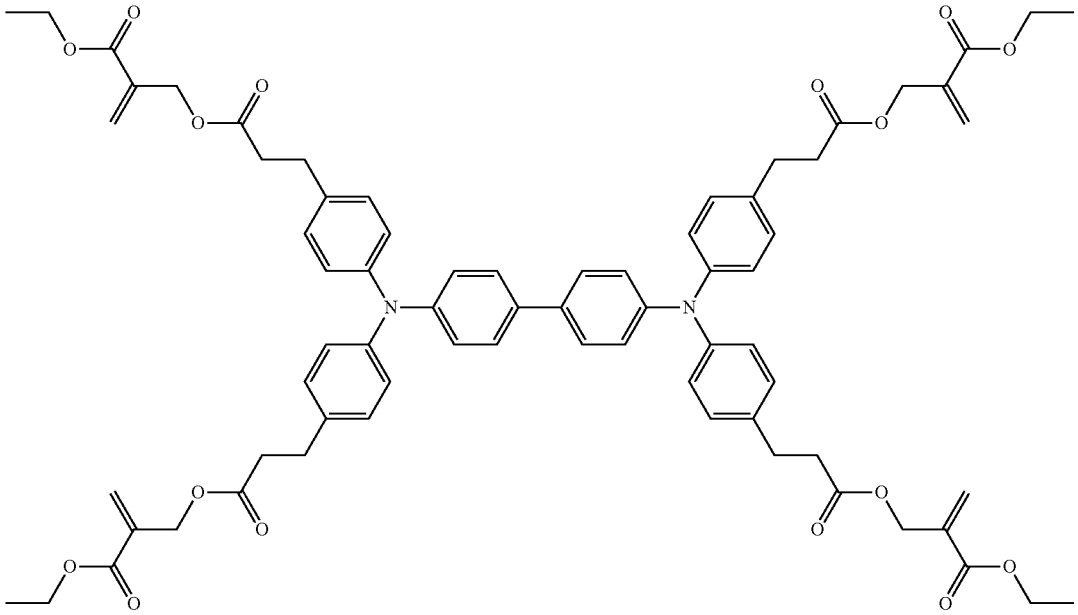
iv-49
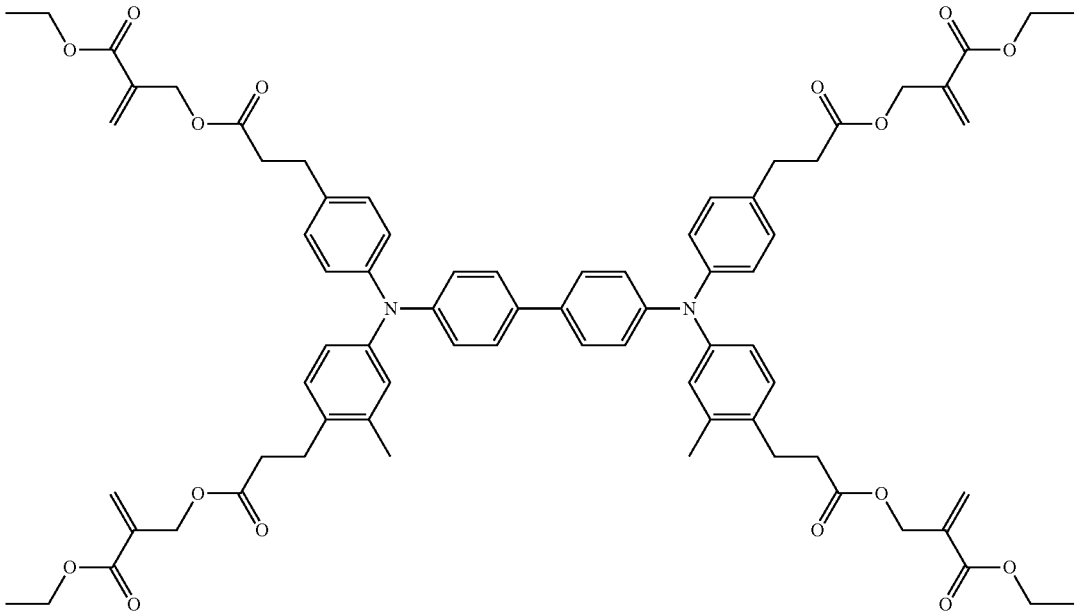

-continued
iv-50
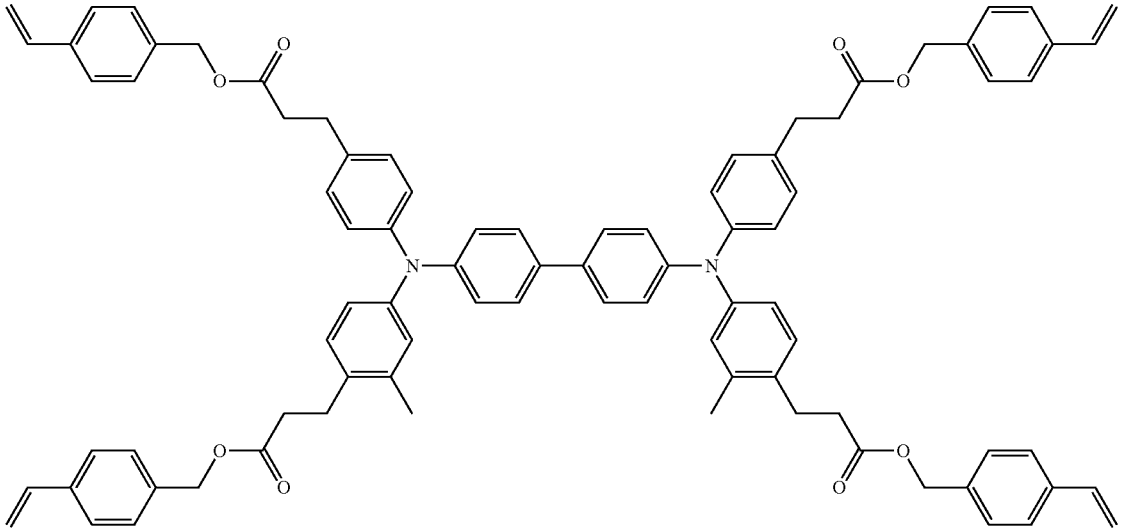
iv-51
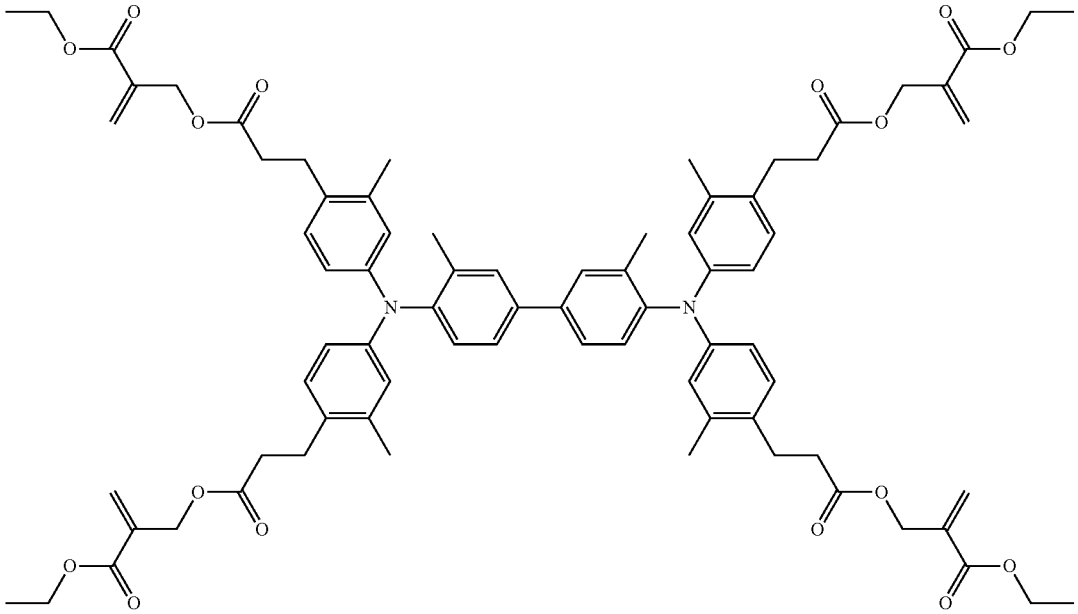

-continued
iv-52
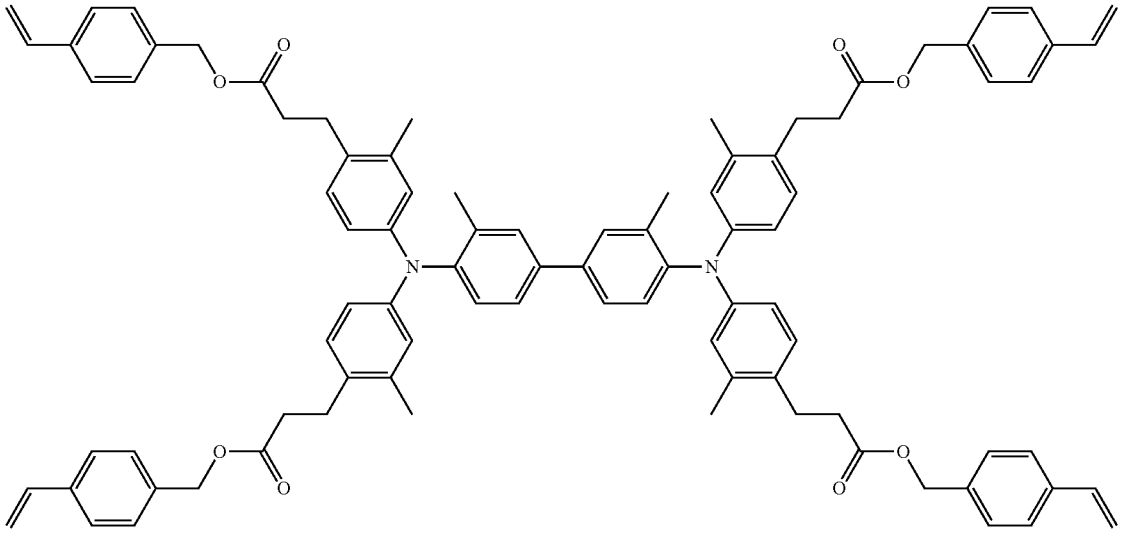
iv-53
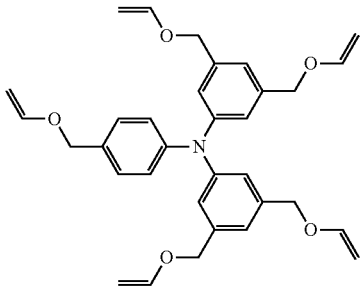
iv-54
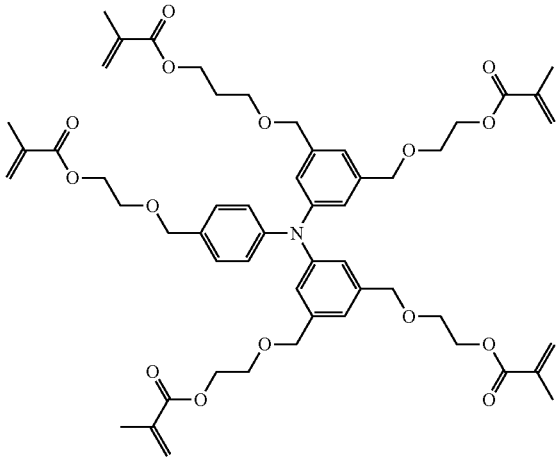
iv-55
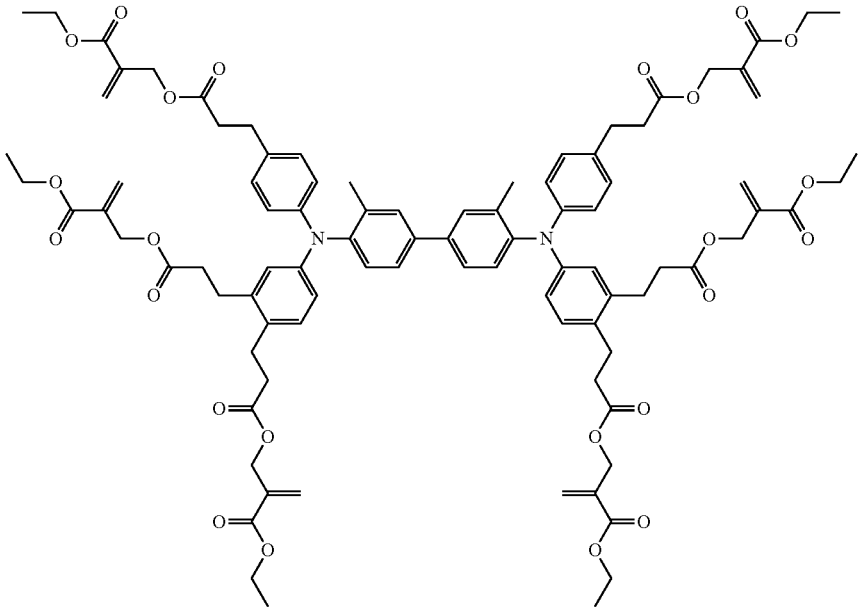

-continued iv-56

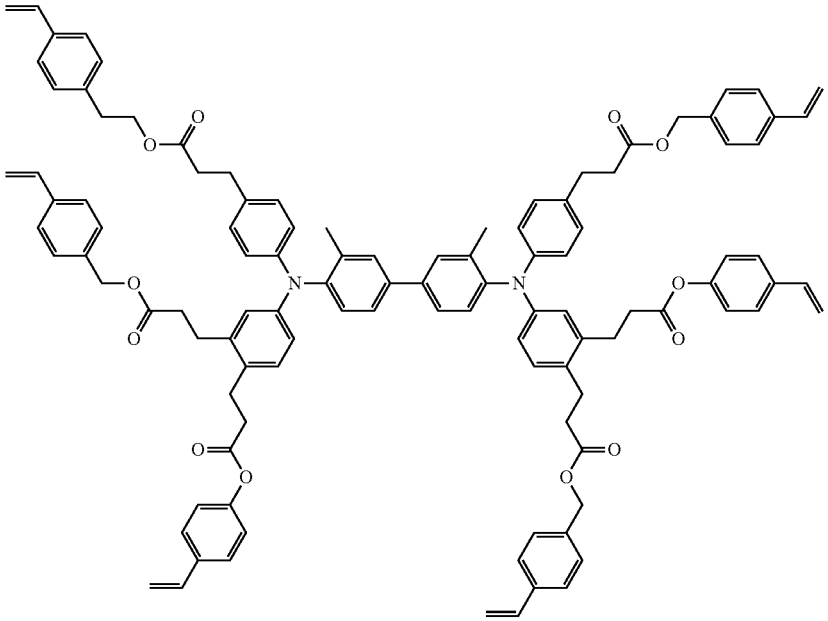

iv-57

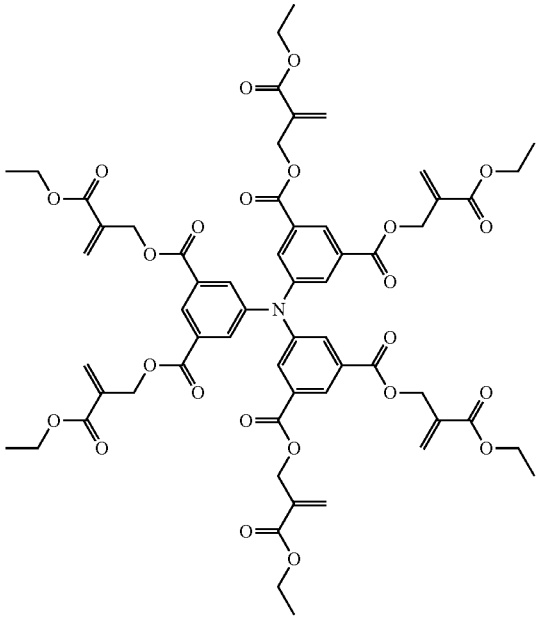

iv-58

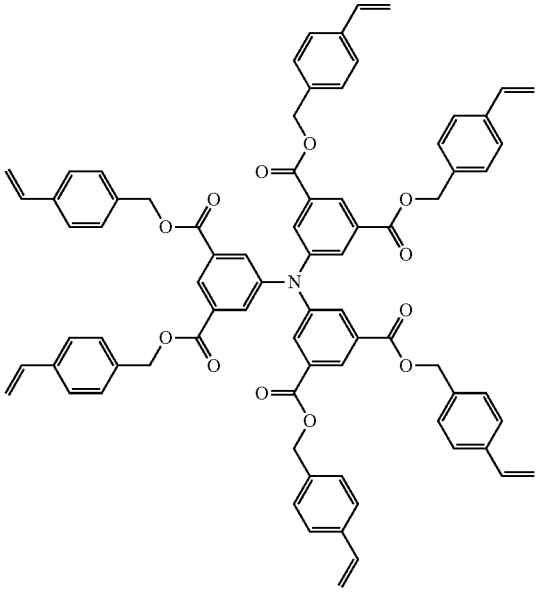

The specific charge transporting material is synthesized, for example, as follows.

That is, the specific charge transporting material may be synthesized by condensation of an alcohol which is a precursor with a corresponding methacrylic acid or methacrylic acid halide. When an alcohol which is a precursor has a benzyl alcohol structure, the specific charge transporting material may also be synthesized by dehydration etherification of an alcohol with a methacrylic acid derivative having a hydroxyl group, such as hydroxyethyl methacrylate and the like.

The synthesis routes of Compound iv-4 and Compound iv-17 that are used in the present exemplary embodiment are shown below as one example.

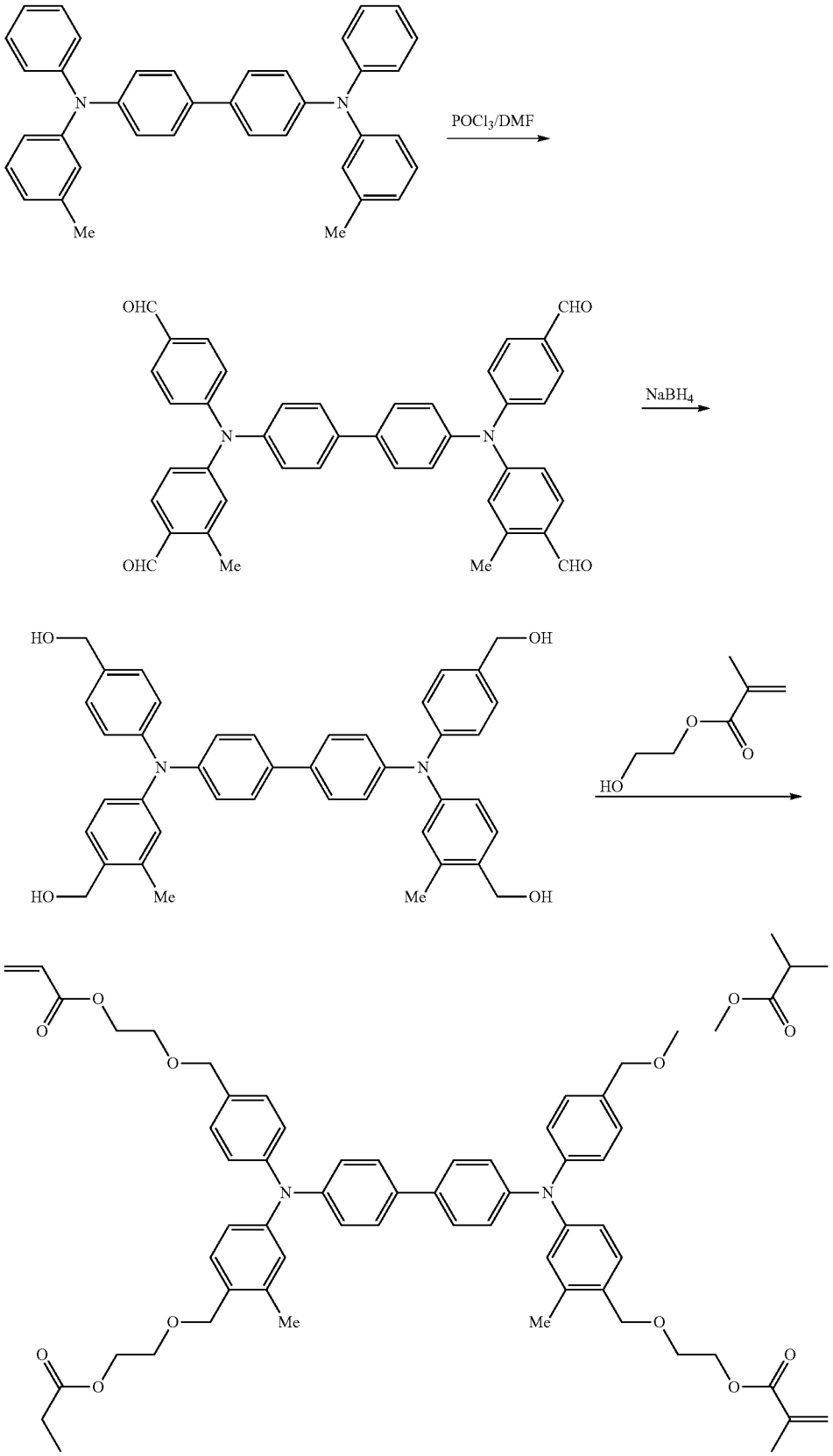
Compound iv-4

-continued
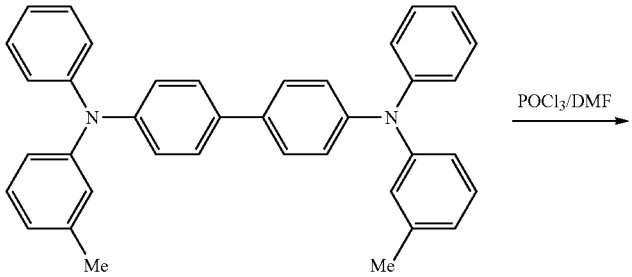
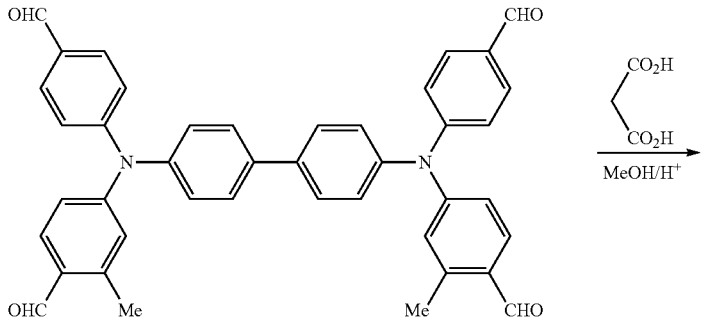
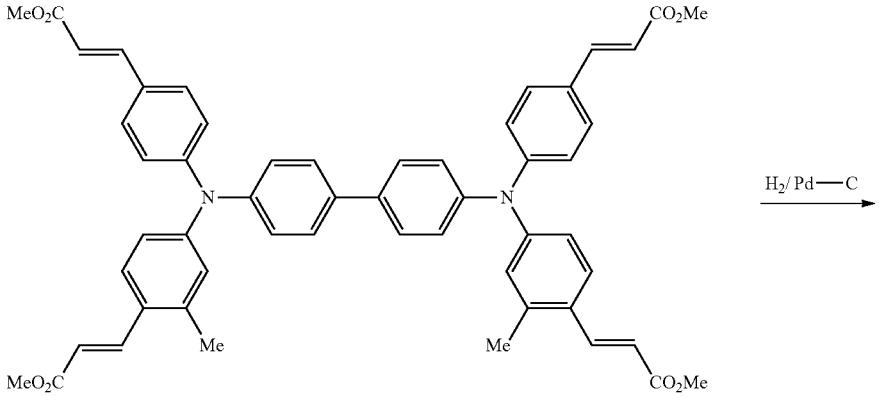
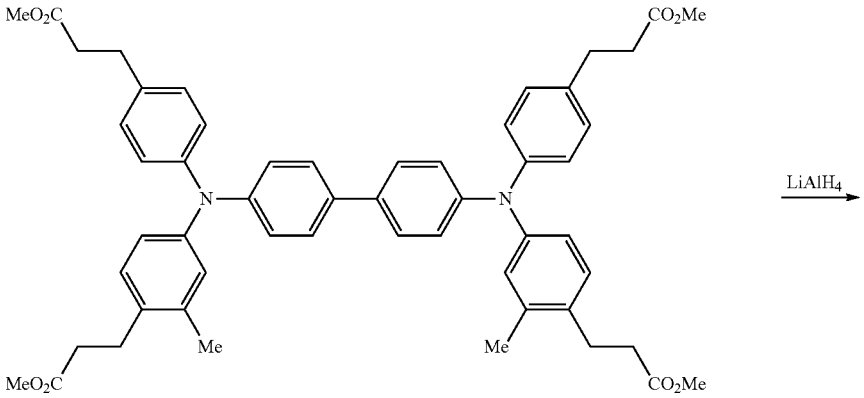

-continued

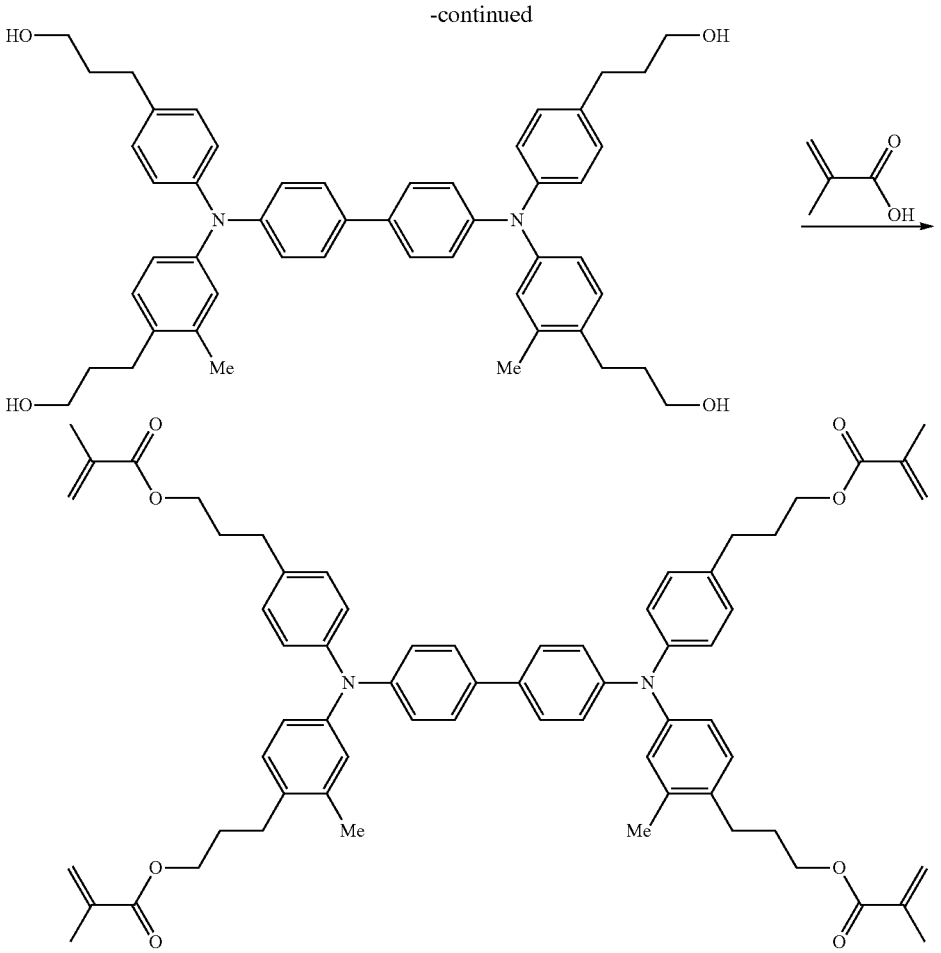

Compound iv-17

Other specific charge transporting materials are synthesized, for example, in the same manner as in the synthesis routes of the Compound iv-4 and the Compound iv-17 as described above.

In the present exemplary embodiment, as the specific charge transporting material, as described above, a compound having 2 or more chain polymerizable functional groups is preferable from the viewpoint that mechanical strength of the resulting cured film is improved, and a compound having 4 or more chain polymerizable functional groups is particularly preferable.

Furthermore, as the specific charge transporting material, a compound having 4 or more chain polymerizable functional groups and a compound having 1 to 3 chain polymerizable functional groups may be used in combination. By this combined use, the strength of the cured film is adjusted while reduction of the charge transporting performance is inhibited.

If as the specific charge transporting material, a compound having 4 or more chain polymerizable functional groups and a compound having 1 to 3 chain polymerizable functional groups is used in combination, the content of the compound having 4 or more chain polymerizable functional groups is preferably adjusted to 5% by mass or more, and particularly preferably 20% by mass or more, based on the total content of the specific charge transporting materials.

Next, other specific charge transporting materials will be described.

The specific charge transporting material may be a polymer including a partial structure represented by each of the following formulae (B) and (C).

(B)

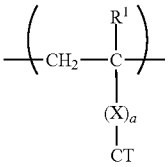

(C)

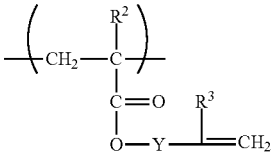

In the formulae (B) and (C), $R^1$, $R^2$, and $R^3$ each independently represent a hydrogen atom or an alkyl group having 1 to 4 carbon atoms; X and Y each independently represent a divalent organic group having 1 to 20 carbon atoms, a represents 0 or 1, and CT represents an organic group having a charge transporting skeleton.

Here, the terminal group of the polymer including a partial structure represented by each of the following formulae (B) and (C) is a structure produced from a radical polymerization reaction (chain termination).

In the formula (B), examples of the organic group having an electron transporting skeleton represented by CT include groups having a triarylamine skeleton, a benzidine skeleton, an arylalkane skeleton, an aryl-substituted ethylene skeleton, a stilbene skeleton, an anthracene skeleton, and a hydrozone skeleton, and among these, groups having a triarylamine skeleton, a benzidine skeleton, and a stilbene skeleton are preferable.

In the formulae (B) and (C), examples of the divalent organic group represented by X and Y include divalent organic groups including one selected from an alkylene group, —C(=O)—, —O—C(=O)—, an aromatic ring, and a linking group having a combination thereof. Further, the divalent organic group represented by X and Y preferably does not have a hydroxyl group.

Specific examples of the divalent organic group represented by X include —C(=O)—O—$CH_2)_n$— (wherein n represents 0 or an integer of 1 or more and 10 or less).

Specific examples of the divalent organic group represented by Y include —$(CH)_n$— (wherein n represents an integer of 1 or more and 10 or less), —$(CH_2)_n$—O—C(=O)— (wherein n represents 0 or an integer of 1 or more and 10 or less, and a part of hydrogen atoms of "$(CH_2)_n$" may be substituted with a hydroxyl group), —$(CH_2)_n$—Ar— (wherein Ar represents an arylene group having 1 to 5 aromatic rings, and n represents 0 or an integer of 1 or more and 10 or less), —Ar—O—$(CH_2)_n$—O—C(=O)— (wherein Ar represents an arylene group having 1 to 5 aromatic rings, and n represents 0 or an integer of 1 or more and 10 or less), and the like.

Specific examples of a partial structure represented by the formula (B) include the following structures, but are not limited thereto. Further, a case where "-" is denoted in the section of "$(X)_a$" indicates a case of a=0, a case where a group is denoted indicates a case with a=1, meaning a group represented by X together with CT.

| | $R^1$ | $(X)_a$ | CT |
|---|---|---|---|
| (B)-1 | H | — | 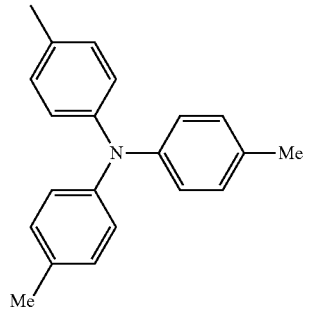 |
| (B)-2 | H | — | 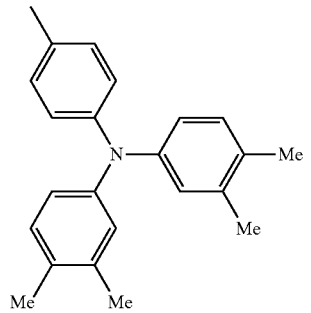 |
| (B)-3 | H | — | 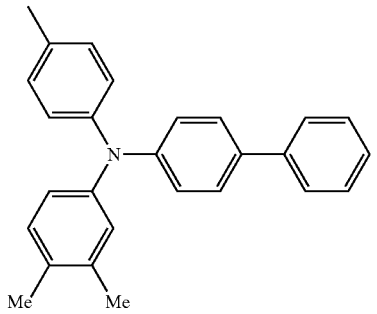 |

-continued
| | $R^1$ | $(X)_a$ | CT |
|---|---|---|---|
| (B)-4 | H | — | 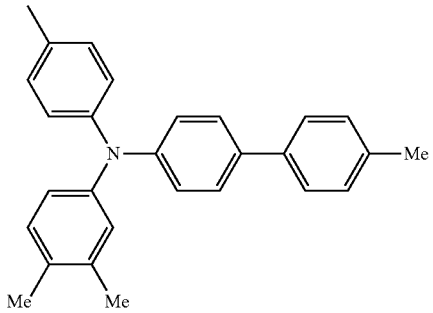 |
| (B)-5 | H | — | 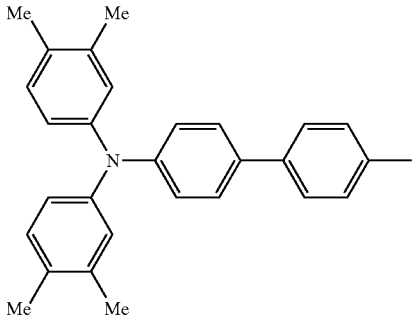 |
| (B)-6 | H | — | 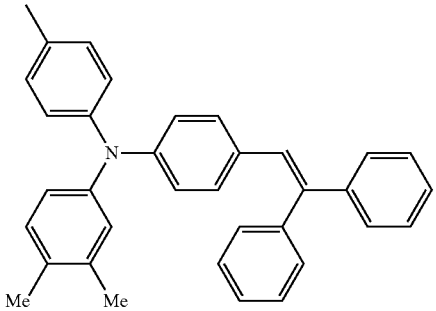 |
| (B)-7 | H | — | 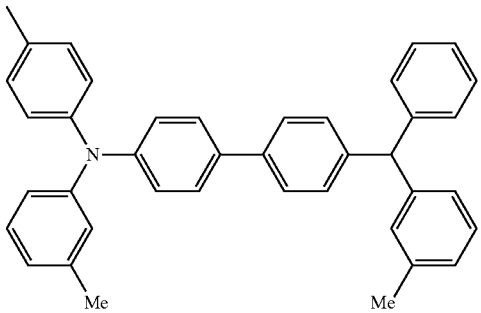 |

-continued
| | $R^1$ | $(X)_a$ | CT |
|---|---|---|---|
| (B)-8 | H | — | 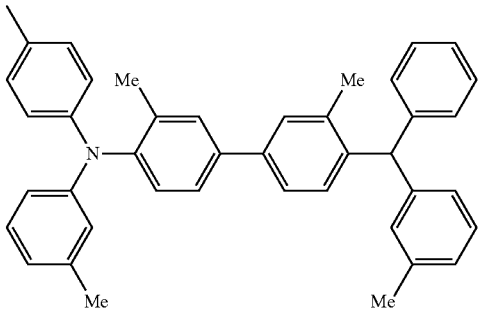 |
| (B)-9 | H | — | 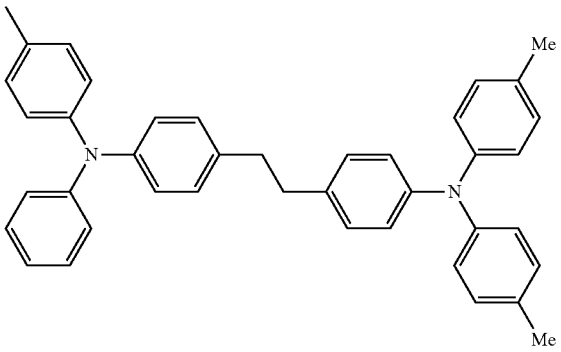 |
| (B)-10 | H | — | 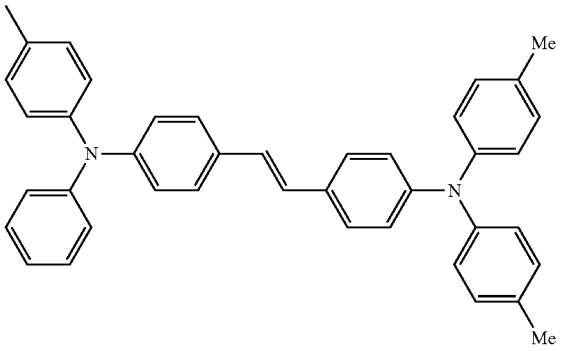 |
| (B)-11 | H | — | 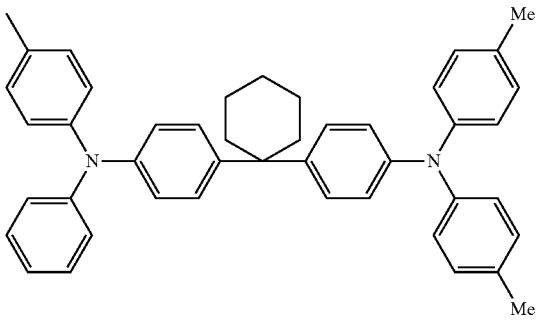 |

-continued
| | $R^1$ | $(X)_a$ | CT |
|---|---|---|---|
| (B)-12 | H | 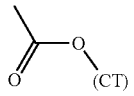 | 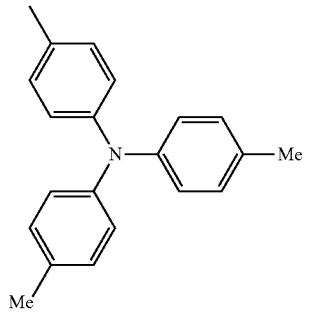 |
| (B)-13 | H | 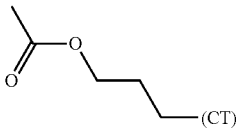 | 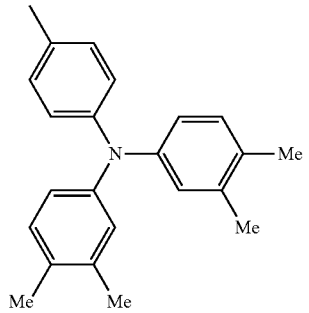 |
| (B)-14 | H | 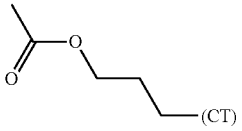 | 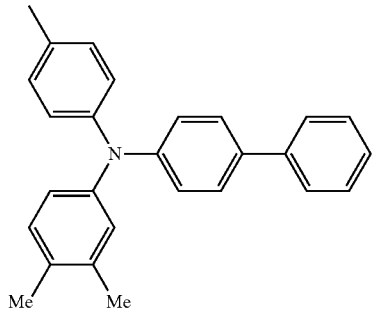 |
| (B)-15 | H | 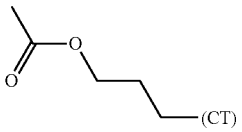 | 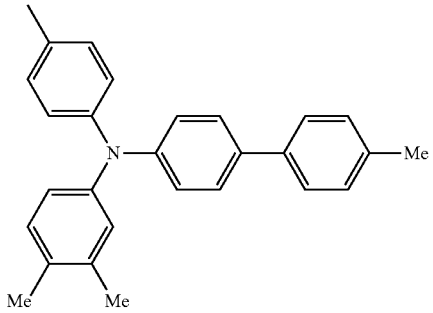 |
| (B)-16 | H | 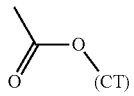 | 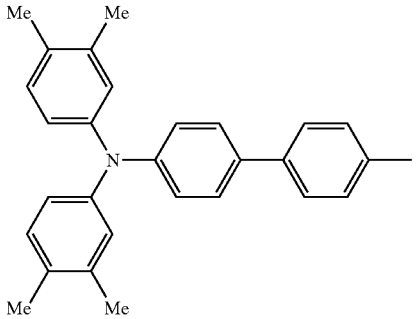 |

-continued
| | $R^1$ | $(X)_a$ | CT |
|---|---|---|---|
| (B)-17 | H | 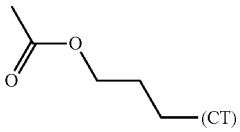 | 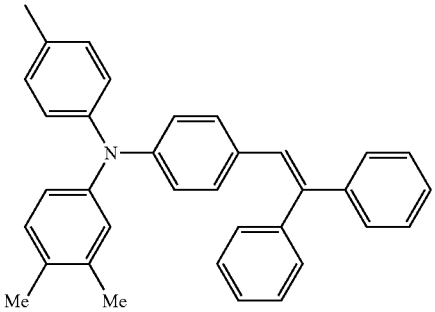 |
| (B)-18 | H | 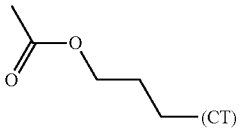 | 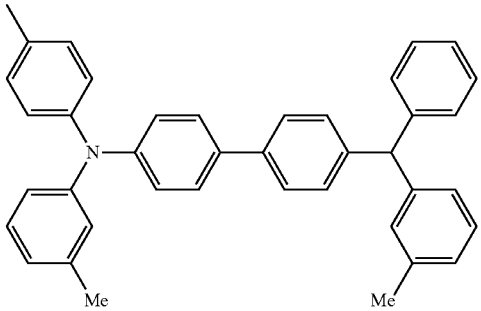 |
| (B)-19 | H | 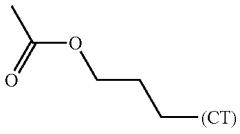 | 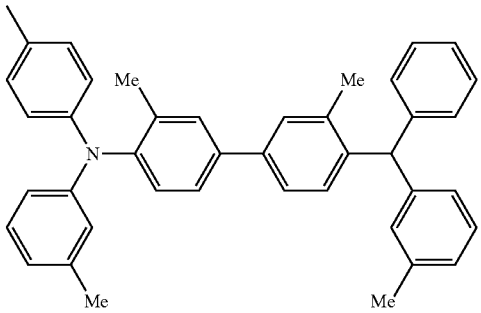 |
| (B)-20 | H | 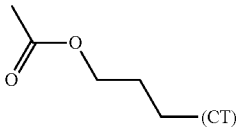 | 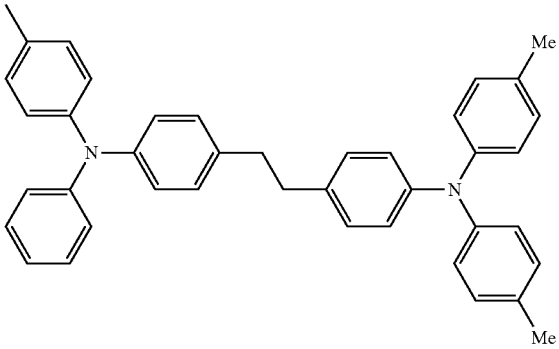 |

-continued
| | $R^1$ | $(X)_a$ | CT |
|---|---|---|---|
| (B)-21 | H | 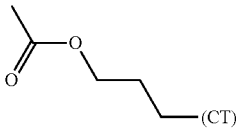 | 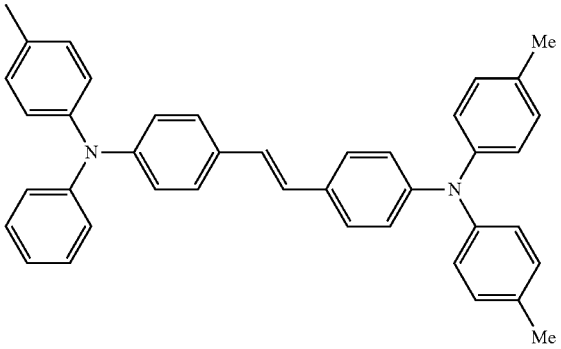 |
| (B)-22 | H | 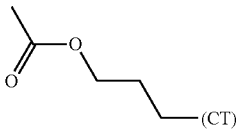 | 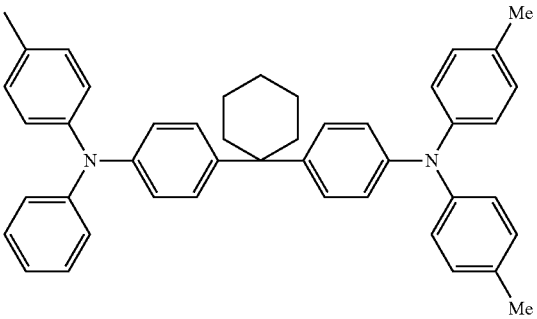 |
| (B)-23 | Me | 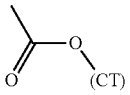 | 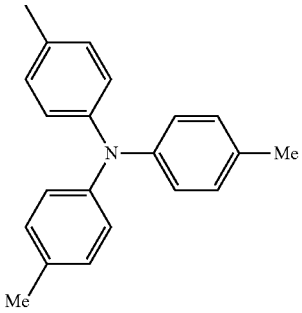 |
| (B)-24 | Me | 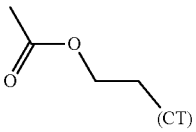 | 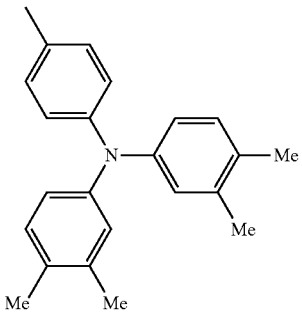 |

-continued
| | $R^1$ | $(X)_a$ | CT |
|---|---|---|---|
| (B)-25 | Me | 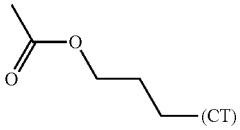 | 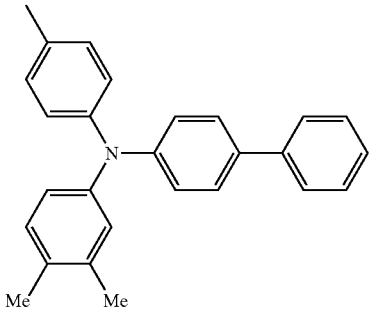 |
| (B)-26 | Me | 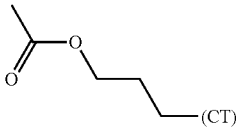 | 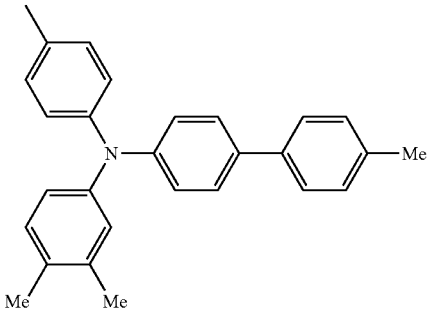 |
| (B)-27 | Me | 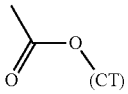 | 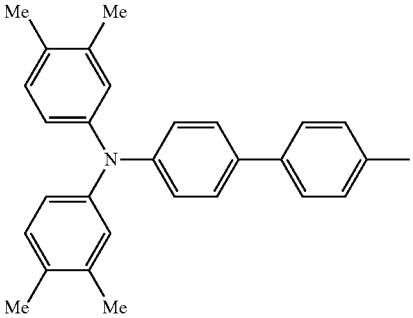 |
| (B)-28 | Me | 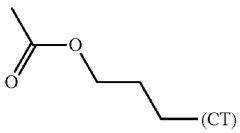 | 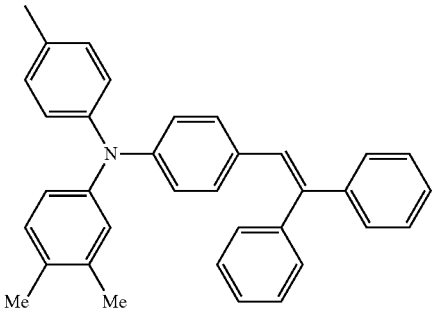 |
| (B)-29 | Me | 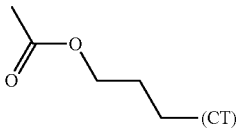 | 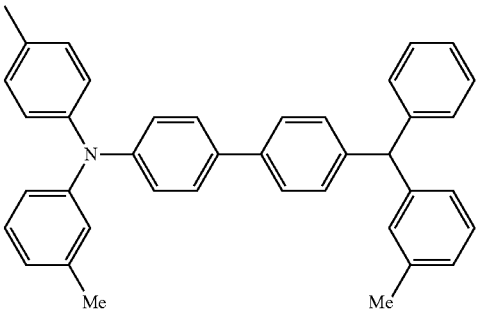 |

-continued
| | $R^1$ | $(X)_a$ | CT |
|---|---|---|---|
| (B)-30 | Me | 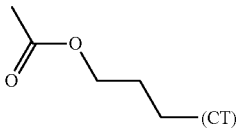 | 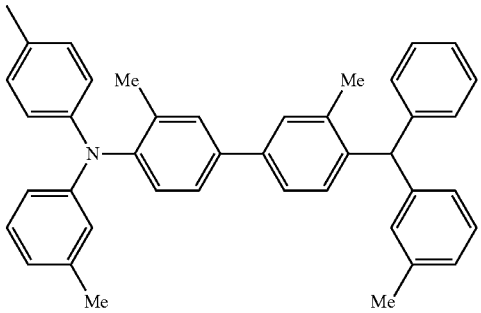 |
| (B)-31 | Me | 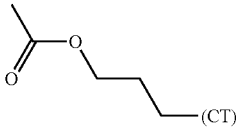 | 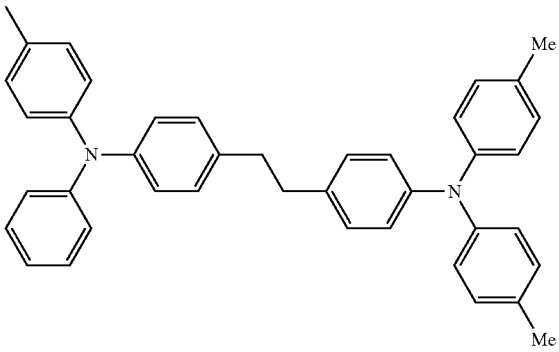 |
| (B)-32 | Me | 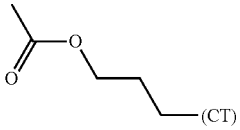 | 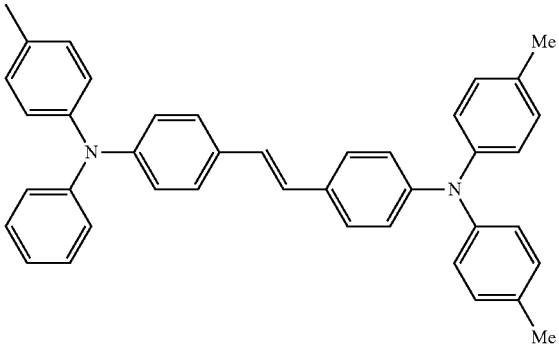 |
| (B)-33 | Me | 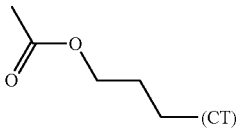 | 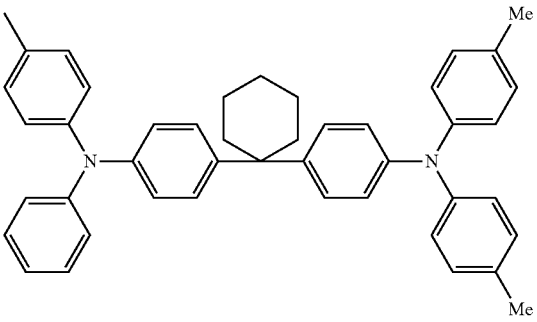 |

Next, specific examples of the partial structure represented by the formula (C) are shown, but are not limited thereto.

| | $R^2$ | Y | $R^3$ |
|---|---|---|---|
| (C)-1 | H | —$CH_2$— | H |
| (C)-2 | H | 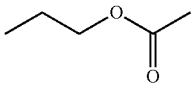 | H |
| (C)-3 | H | 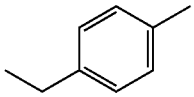 | H |
| (C)-4 | H | $CH_2$ | Me |
| (C)-5 | H | 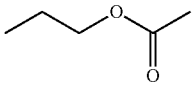 | Me |
| (C)-6 | H | 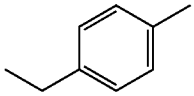 | Bu |
| (C)-7 | H | 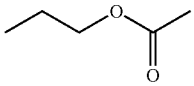 | Bu |
| (C)-8 | H | 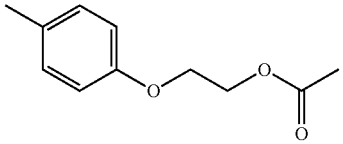 | Me |
| (C)-9 | H | 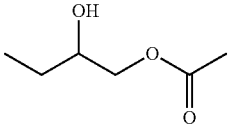 | H |
| (C)-10 | H | 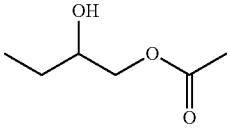 | Me |
| (C)-11 | H | 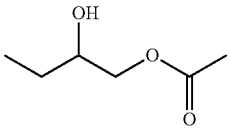 | Bu |
| (C)-12 | Me | $CH_2$ | H |
| (C)-13 | Me | 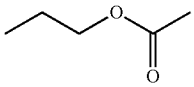 | H |
| (C)-14 | Me | 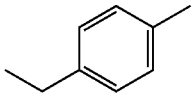 | H |
| (C)-15 | Me | $CH_2$ | Me |

-continued

| | $R^2$ | Y | $R^3$ |
|---|---|---|---|
| (C)-16 | Me | 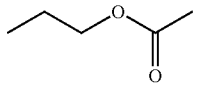 | Me |
| (C)-17 | Me | 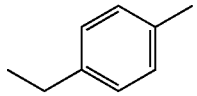 | Bu |
| (C)-18 | Me | 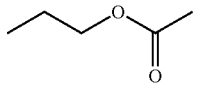 | Bu |
| (C)-19 | Me | 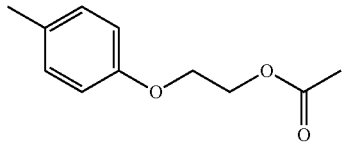 | Me |
| (C)-20 | Me | 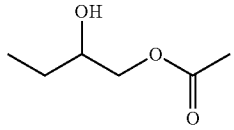 | H |
| (C)-21 | Me | 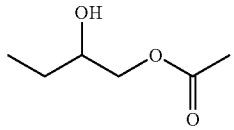 | Me |
| (C)-22 | Me | 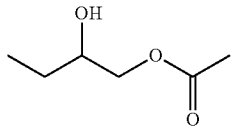 | Bu |

The groups including only partial structures represented by the formulae (B) and (C) are preferably groups including partial structures represented by the following formulae (B') and (C').

(B')

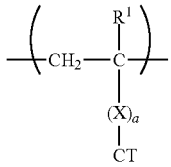

(C')

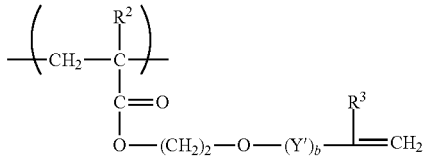

In the formulae (B') and (C'), $R^1$, $R^2$, and $R^3$ each independently represent a hydrogen atom or an alkyl group having 1 to 4 carbon atoms; X represents a divalent organic group having 1 to 20 carbon atoms; Y' represents —C(=O)—, —O—C(=O)—, an alkylene group, an aromatic ring, or a linking group having a combination thereof, any of which has no hydroxyl group; a and b each independently represent 0 or 1; and CT represents an organic group having a charge transporting skeleton.

Further, in the formulae (B') and (C'), the divalent organic group represented by X and the organic group having a charge transporting skeleton represented by CT are the same as X and CT in the formulae (B) and (C).

Among these, a group represented by the following structural formula (D) has excellent solubility and film forming ability, which is thus preferable.

(D)

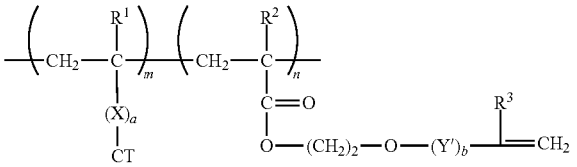

In the formula (D), R', $R^2$, and $R^3$ each independently represent a hydrogen atom or an alkyl group having 1 to 4 carbon atoms; X represents a divalent organic group having 1 to 20 carbon atoms; Y' represents —C(=O)—, —O—C(=O)—, an alkylene group, an aromatic ring, or a linking group having a combination thereof, any of which has no hydroxyl group; a and b each independently represent 0 or 1; and CT represents an organic group having a charge transporting skeleton.

m and n each represent an integer of 5 or more, and satisfy a condition of $10<m+n\leq 2000$ and $0.2<m/(m+n)<0.95$, and from the viewpoints of strength, flexibility, and electrical characteristics, they preferably satisfy a condition of $15<m+n\leq 2000$ and $0.3<m/(m+n)<0.95$, and more preferably a condition of $20<m+n\leq 2000$ and $0.4<m/(m+n)<0.95$.

Further, in the formula (D), the divalent organic group represented by X, and the organic group having a charge transporting skeleton represented by CT are the same as X and CT in the formulae (B) and (C).

The polymers including a partial structure, each represented by the formulae (B) and (C) are prepared for example, by using the compound represented by the formula (A) as a monomer by a known method such as copolymerization with methacrylic acid, acrylic acid, glycidyl compounds, and derivative thereof, and the like.

Furthermore, the polymers including a partial structure, each represented by the formulae (B) and (C) may be formed by copolymerization of monofunctional monomers in order to provide solubility and flexibility, in addition to the monomers represented by the formulae (B) and (C).

Examples of the monofunctional monomers include acrylates or methacrylates such as isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenyl phenol acrylate, α-phenyl phenol glycidyl ether acrylate, and the like, and styrene derivatives such as such as styrene, α-methyl styrene, 4-methyl styrene, and the like.

The amount (I) thereof to be used in copolymerization of these monomers is one satisfying a condition of $l/m<0.3$, and more preferably a condition of $l/m<0.2$ in terms of m in the formula (D) from the viewpoint of provision of the solubility and the flexibility.

The total content of the above-described specific charge transporting materials is, for example, in the range of 30% by mass or more and 100% by mass or less, of 35% by mass or more and 99% by mass or less, or of 40% by mass or more and 95% by mass or less, based on the total mass of the solid content of the charge transporting composition.

—Chain Transfer Agent—

As the chain transfer agent, at least one polyfunctional thiol compound selected from a compound having 4 or more primary thiol groups and a compound having 2 or more secondary thiol groups is applied.

That is, if the compound applied as the chain transfer agent has primary thiol groups, it has 4 or more thiol groups, and if the compound applied as the chain transfer agent has secondary thiol groups, it has 2 or more thiol groups.

Here, the primary thiol group refers to a thiol group represented by R—$CH_2$—SH in the structure (wherein R represents a hydrocarbon group).

On the other hand, the secondary thiol group refers to a thiol group represented by R'—CH(SH)—R" in the structure (wherein R' and R" represent hydrocarbon groups).

The compound having 4 or more primary thiol groups is a thiol compound having 4 or more primary thiol groups in the same molecule. The number of the primary thiol groups is preferably, for example, 4 or more and 6 or less.

Examples of the compound containing 4 primary thiol groups include pentaerythritol tetrakis(3-mercaptopropionate) and the like.

Examples of the compound containing 6 primary thiol groups include dipentaerythritol hexakis(3-mercaptopropionate) and the like.

The compound having 4 or more primary thiol groups has a decreased residual potential in an electrophotographic photoreceptor, that is, it is preferable since the image density unevenness is inhibited, which is caused by repeated use of the electrophotogaphic photoreceptor and the mechanical strength as a cured film of the outermost layer is excellent.

On the other hand, the compound having 2 or more secondary thiol groups is a thiol compound having 2 or more secondary thiol groups in the same molecule. The number of secondary thiol groups is preferably, for example, 2 or more and 6 or less.

Examples of the compound having 2 or more secondary thiol groups include 1,4-bis(3-mercaptobutyryloxy)butane, 1,3,5-tris(3-mercaptobutyloxyethyl)-1,3,5-triazine 2,4,6(1H,3H,5H-trione), pentaerythritol tetrakis(3-mercaptobutylate), and the like.

Particularly, the compound having a secondary thiol group is preferable from the viewpoints that in a solution state of the charge transporting composition including the specific charge transporting material and the chain transfer agent, the viscosity stability of the solution is excellent.

Further, the chain transfer agent may be used singly or in combination of two or more kinds thereof.

Furthermore, the chain transfer agent is not particularly limited to those compounds exemplified above as long as it is used for known polymerization, processing, vulcanization, plasticizers, or the like of resins, rubbers, or the like.

The content of the chain transfer agent is not particularly limited, but it may be, for example, in the range of 0.1 part by mass or more and 30 parts by mass or less (or about 0.1 part by mass or more and about 30 parts by mass or less), in the range of 1 part by mass or more and 20 parts by mass or less, or in the range of 2 parts by mass or more and 15 parts by mass or less, based on 100 parts by mass of the specific charge transporting material.

By setting the content of the chain transfer agent to these ranges, it becomes easier for the chain polymerization reaction to be allowed to proceed efficiently and both of the mechanical strength and the electrical characteristics (a charge transporting property) of the resulting cured film to be satisfied at the same time.

—Other Additives: Polymerization Initiator—

Next, other additives of the charge transporting composition will be described.

In order to increase the efficiency of the reaction of the chain polymerization reactive group, for example, a known polymerization initiator that generates radicals may be added to the charge transporting composition. That is, a polymerization initiator may be used in combination with the chain transfer agent. At this time, as the polymerization initiator, a polymerization initiator that generates radicals by heat is preferable for accomplishment of the purposes of the present exemplary embodiment.

Examples of the polymerization initiator that generates radicals by heat include an azo-based initiator such as V-30 (10 hour half-life temperature: 104° C.), V-40 (10 hour half-life temperature: 88° C.), V-59 (10 hour half-life temperature: 67° C.), V-601 (10 hour half-life temperature: 66° C.), V-65 (10 hour half-life temperature: 51° C.), V-70 (10 hour half-life temperature: 30° C.), VF-096 (10 hour half-life temperature: 96° C.), Vam-110 (10 hour half-life temperature: 111° C.), and Vam-111 (10 hour half-life temperature: 111° C.) (all manufactured by Wako Pure Chemical Industries, Ltd.); OTazo-15 (10 hour half-life temperature: 61° C.), OTazo-30, AIBN (10 hour half-life temperature: 65° C.), AMBN (10 hour half-life temperature: 67° C.), ADVN (10 hour half-life temperature: 52° C.), and ACVA (10 hour half-life temperature: 68° C.) (all manufactured by Otsuka Chemical Co., Ltd.);

PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (all manufactured by NOF Corp.); KAYAKETAL AM-055, TRIGONOX 36-C75, LAUROX, PERKADOX L-W75, PERKADOX CH-50L, TRIGONOX TMBH, KAYACUMENE H, KAYABUTYL H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-050, KAYABUTYL B, KAYACARBON EH-C70, KAYACARBON EH-W60, KAYACARBON I-20, KAYACARBON BIC-75, TRIGONOX 117, and KAYARENE 6-70 (all manufactured by Kayaku Akzo Co., Ltd.); and LUPEROX LP (10 hour half-life temperature: 64° C.), LUPEROX 610 (10 hour half-life temperature: 37° C.), LUPEROX 188 (10 hour half-life temperature: 38° C.), LUPEROX 844 (10 hour half-life temperature: 44° C.), LUPEROX 259 (10 hour half-life temperature: 46° C.), LUPEROX 10 (10 hour half-life temperature: 48° C.), LUPEROX 701 (10 hour half-life temperature: 53° C.), LUPEROX 11 (10 hour half-life temperature: 58° C.), LUPEROX 26 (10 hour half-life temperature: 77° C.), LUPEROX 80 (10 hour half-life temperature: 82° C.), LUPEROX 7 (10 hour half-life temperature: 102° C.), LUPEROX 270 (10 hour half-life temperature: 102° C.), LUPEROX P (10 hour half-life temperature: 104° C.), LUPEROX 546 (10 hour half-life temperature: 46° C.), LUPEROX 554 (10 hour half-life temperature: 55° C.), LUPEROX 575 (10 hour half-life temperature: 75° C.), LUPEROX TANPO (10 hour half-life temperature: 96° C.), LUPEROX 555 (10 hour half-life temperature: 100° C.), LUPEROX 570 (10 hour half-life temperature: 96° C.), LUPEROX TAP (10 hour half-life temperature: 100° C.), LUPEROX TBIC (10 hour half-life temperature: 99° C.), LUPEROX TBEC (10 hour half-life temperature: 100° C.), LUPEROX JW (10 hour half-life temperature: 100° C.), LUPEROX TRIC (10 hour half-life temperature: 96° C.), LUPEROX TAEC (10 hour half-life temperature: 99° C.), LUPEROX DC (10 hour half-life temperature: 117° C.), LUPEROX 101 (10 hour half-life temperature: 120° C.), LUPEROX F (10 hour half-life temperature: 116° C.), LUPEROX DI (10 hour half-life temperature: 129° C.), LUPEROX 130 (10 hour half-life temperature: 131° C.), LUPEROX 220 (10 hour half-life temperature: 107° C.), LUPEROX 230 (10 hour half-life temperature: 109° C.), LUPEROX 233 (10 hour half-life temperature: 114° C.), and LUPEROX 531 (10 hour half-life temperature: 93° C.) (all manufactured by ARKEMA YOSHITOMI, Ltd.).

The polymerization initiator may be used singly or in a mixture of two or more kinds thereof.

The content of the polymerization initiator may be, for example, in the range of 0.01 part by mass or more and 10 parts by mass or less, in the range of 0.05 part by mass or more and 5 parts by mass or less, or in the range of 0.1 part by mass or more and 3 parts by mass or less, based on the 100 parts by mass of the specific charge transporting material, from the viewpoint that the chain polymerization reaction proceeds and the mechanical strength of the cured film after curing is excellent.

—Other Additives: Various Compounds/Resins—

The charge transporting composition may include, for example, at least one kind selected from a compound having no chain polymerizable reactive group and having a charge transporting skeleton, a compound having a chain polymerizable reactive group and having no charge transporting skeleton, and a binder resin, for the purpose of controlling the electrical characteristics and the mechanical strength of the cured film.

Compound Having No Chain Polymerizable Reactive Group and Having Charge Transporting Skeleton The compound having no chain polymerizable reactive group and having a charge transporting skeleton is not particularly limited as long as it is a known one, and examples thereof include electron transporting compounds, for example, quinone-based compounds such as p-benzoquinone, chloranil, bromanil, anthraquinone, and the like tetracyanoquinodimethane-based compounds, fluorenone-based compounds such as 2,4,7-trinitrofluorenone and the like, xanthone-based compounds, benzophenone-based compounds, cyanovinyl-based compounds, ethylene-based compounds, and the like; and known hole transporting compounds, for example, triarylamine-based compounds, benzidine-based compounds, arylalkane-based compounds, aryl-substituted ethylene-based compounds, stilbene-based compounds, anthracene-based compounds, hydrazone-based compounds, and the like.

As the compound having no chain polymerizable reactive group and having a charge transporting skeleton, for example, a triarylamine derivative represented by the following structural formula (a-1) and a benzidine derivative represented by the following structural formula (a-2) are preferable from the viewpoint of charge mobility.

(a-1)

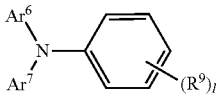

In the structural formula (a-1), $R^9$ represents a hydrogen atom or a methyl group; l represents 1 or 2; $Ar^6$ and $Ar^7$ each independently represent a substituted or unsubstituted aryl group, $—C_6H_4—C(R^{10})=C(R^{11})(R^{12})$, or $—C_6H_4—CH=CH—CH=C(R^{13})(R^{14})$; and $R^{10}$ to $R^{14}$ each independently represent a hydrogen atom, a substituted or unsubstituted alkyl group, or a substituted or unsubstituted aryl group.

Here, examples of the substituent of the respective groups include a halogen atom, an alkyl group having 1 to 5 carbon atoms, an alkoxy group having 1 to 5 carbon atoms, and a substituted amino group substituted by an alkyl group having 1 to 3 carbon atoms.

(a-2)

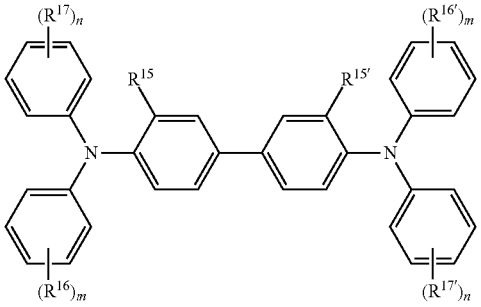

In the structural formula (a-2), $R^{15}$ and $R^{15'}$ each independently represent a hydrogen atom, a halogen atom, an alkyl group having 1 to 5 carbon atoms, or an alkoxy group having 1 to 5 carbon atoms; $R^{16}$, $R^{16'}$, $R^{17}$, and $R^{17'}$ each independently represent a hydrogen atom, a halogen atom, an alkyl group having 1 to 5 carbon atoms, an alkoxy group having 1 to 5 carbon atom, an amino group substituted by an alkyl group having 1 or 2 carbon atoms, a substituted or unsubstituted aryl group, $—C(R^{18})=C(R^{19})(R^{20})$; or $—CH=CH—CH=C(R^{21})(R^{22})$; $R^{18}$ to $R^{22}$ each independently represent a hydrogen atom, a substituted or unsubstituted alkyl group, or a substituted or unsubstituted aryl group; and m and n each independently represent an integer of 0 or more and 2 or less.

Here, among the triarylamine derivatives represented by the structural formula (a-1) and the benzidine derivatives represented by the structural formula (a-2), in particular, a triarylamine derivative having "$—C_6H_4—CH=CH—CH=C(R^{13})(R^{14})$" and a benzidine derivative having "$—CH=CH—CH=C(R^{21})(R^{22})$" are preferable.

Furthermore, examples of the compound having no chain polymerizable reactive group and having a charge transporting skeleton include known non-crosslinking type polymer charge transporting materials with no reactivity (for example, poly-N-vinylcarbazole, polysilane, and the like). Among these known non-crosslinking type polymer charge transporting materials, particularly, polyester-based polymer charge transporting materials disclosed in JP-A-8-176293 and JP-A-8-208820, or the like have high charge transporting property.

The compound having no chain polymerizable reactive group and having a charge transporting skeleton may be used singly or in a mixture of two or more kinds thereof.

The content of the compound having no chain polymerizable reactive group and having a charge transporting skeleton is not particularly limited, but may be, for example, in the range of 0.1 part by mass or more and 100 parts by mass or less, in the range of 1 part by mass or more and 50 parts by mass or less (or about 1 part by mass or more and about 50 parts by mass or less), or in the range of 3 parts by mass or more and 30 parts by mass or less, based on the 100 parts by mass of the specific charge transporting material, from the viewpoint that the mechanical strength of the film after curing is excellent and the electrical characteristics (a charge transporting property) of the cured film is excellent.

Compound Having Chain Polymerizable Reactive Group and Having No Charge Transporting Skeleton Examples of the compound having a chain polymerizable reactive group and having no charge transporting skeleton include organic compounds having carbon unsaturated bonds and chain polymerizability, and having no charge transporting skeleton. Examples of the compound include those that are used as a raw material for generally used resins, such as styrene, acrylic acid, methacrylic acid, acrylonitrile, butadiene, and the like.

In addition, examples of the compound having a chain polymerizable reactive group and having no charge transporting skeleton include monofunctional compounds such as isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenyl phenol acrylate, o-phenyl phenol glycidyl ether acrylate, and the like; bifunctional compounds such as 1,4-butanediol diacrylate, 1,6-hexanediol diacrylate, 1,9-nonanediol diacrylate, 2-n-butyl-2-ethyl-1,3-propanediol diacrylate, tripropylene glycol diacrylate, tetraethylene glycol diacrylate, dioxane glycol diacrylate, polytetramethylene glycol diacrylate, ethoxylated bisphenol A diacrylate, ethoxylated bisphenol A dimethacrylate, tricyclodecanemethanol diacrylate, tricyclodecanemethanol dimethacrylate, and the like; and trifunctional compounds such as trimethylolpropane triacrylate, trimethylolpropane trimethacrylate, pentaerythritol acrylate, trimethylolpropane EO adduct triacrylate, glycerin PO adduct triacrylate, trisacryloyloxyethyl phosphate, pentaerythritol tetraacrylate, ethoxylated isocyanuric triacrylate, and the like.

Examples of the compound having a chain polymerizable reactive group and having no charge transporting skeleton include polyfunctional acrylates having an isocyanuric acid skeleton, for examples, tris(2-hydroxyethyl) isocyanurate triacrylate, tris(2-hydroxyethyl) isocyanurate trimethacrylate, bis(2-hydroxyethyl) isocyanurate triacrylate, bis(2-hydroxyethyl) isocyanurate trimethacrylate, caprolactone modified acrylates of bis(acryloxyethyl) isocyanurate, caprolactone modified methacrylates of bis(acryloxyethyl) isocyanurate, caprolactone modified acrylates of bis(methacryloxyethyl) isocyanurate, and caprolactone modified methacrylates of bis(methacryloxyethyl) isocyanurate.

The compound having a chain polymerizable reactive group and having no charge transporting skeleton may be used singly or in a mixture of two or more kinds thereof.

The content of the compound having a chain polymerizable reactive group and having no charge transporting skeleton is not particularly limited, but may be, for example, in the range of 0.01 part by mass or more and 100 parts by mass or less, in the range of 0.1 part by mass or more and 50 parts by mass or less, or in the range of 1 part by mass or more and 30 parts by mass or less, based on the 100 parts by mass of the specific charge transporting material, from the viewpoint of improvement of the mechanical strength of the cured film after curing.

Binder Resin

Examples of the binder resin include known binder resins. Examples of the binder resin include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, a poly-N-vinylcarbazole, a polysilane, and the like.

The binder resin may be used singly or in a mixture of two or more kinds thereof.

The content of the binder resin may be, for example, in the range of 1 part by mass or more and 1000 parts by mass or less, in the range of 5 parts by mass or more and 500 parts by mass or less, or in the range of 10 parts by mass or more and 100 parts by mass or less, based on the 100 parts by mass of the specific charge transporting material, from the viewpoints of improvement of the viscosity stability of the charge transporting composition (coating liquid) and the processability of the coating film and the like, and of improvement of the mechanical strength of the cured film after curing.

—Other Additives—

For example, a coupling agent, a hard-coating agent, or a fluorine-containing compound may be added to the charge transporting composition for the purpose of controlling the film forming property, flexibility, lubricity, and adhesive property of the film, and others. Specific examples of the additives include various silane coupling agents and commercially available silicone-based hard-coating agents.

As the silane coupling agents, vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl) γ-aminopropyl triethoxysilane, tetramethoxysilane, methyltrimethoxysilane, dimethyldimethoxysilane, or the like is used.

Furthermore, as the commercially available hard-coating agent, KP-85, X-40-9740, and X-8239 (manufactured by Shin-Etsu Silicones Co., Ltd.), AY42-440, AY42-441, and AY49-208 (manufactured by Dow Corning Toray Co., Ltd.), or the like is used.

In addition, in order to provide water-repellency or the like, a fluorine-containing compound, such as (tridecafluoro-1,1,2,2-tetrahydrooctyl)triethoxysilane, (3,3,3-trifluoropropyl) trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, 1H,1H,2H,2H-perfluorooctyltriethoxysilane, and the like, may be mixed with the charge transporting composition. In addition, a reactive fluorine-containing compound disclosed in JP-A-2001-166510 or the like may be mixed therewith.

The content of the silane coupling agent is not particularly limited, but the content of the fluorine-containing compound is preferably 0.25 time or less of the mass of the compounds free of fluorine. When the content is more than this value, a problem with the film forming property of the cured film may be brought about in some cases.

In addition, to the charge transporting composition, for example, a resin which is dissolved in an alcohol may be added for the purpose of providing resistance against discharge product gases, mechanical strength, scratch resistance, torque reduction, control of the abrasion amount, extension of the lifespan (pot-life), or the like of the film, or for controlling the particle dispersibility and the viscosity.

Furthermore, for example, an antioxidant is preferably added to the charge transporting composition for the purpose of preventing degradation caused by oxidative gases such as ozone generated in a charging device of the charge transporting layer. The reason therefor is that when the mechanical strength of the photoreceptor surface is increased and the durability of the photoreceptor is improved, there are demands for still stronger oxidation resistance as compared before because the photoreceptor is exposed to oxidative gases over a long time.

As the antioxidant, hindered phenol antioxidants or hindered amine antioxidants are preferable. Known antioxidants such as an organic sulfur-based antioxidant, a phosphite-based antioxidant, a dithiocarbamate-based antioxidant, a thiourea-based antioxidant, a benzimidazole-based antioxidant, and the like may be used. The content of the antioxidant may be, for example, in the range of 20% by mass or less or in the range of 10% by mass or less, based on the total mass of the solid content in the charge transporting composition.

Examples of the hindered phenol-based antioxidant include "IRGANOX 1076", "IRGANOX 1010", "IRGANOX 1098", "IRGANOX 245", "IRGANOX 1330", "IRGANOX 3114", and "IRGANOX 1076" (manufactured by Ciba Japan K.K.), "3,5-di-t-butyl-4-hydroxybiphenyl", and the like.

Examples of the hindered amine-based antioxidant include "SANOL LS2626", "SANOL LS765", "SANOL LS770", "SANOL LS744" (manufactured by Sankyo Lifetech Co., Ltd.), "TINUVIN 144", "TINUVIN 622LD" (manufactured by Ciba Japan K.K.), "MARK LA57", "MARK LA67", "MARK LA62", "MARK LA68", and "MARK LA63" (manufactured by Adeka Corporation), and examples of the thioether-based antioxidant include "SUMILIZER TPS" and "SUMILIZER TP-D" (manufactured by Sumitomo Chemical Co., Ltd.). Examples of the phosphite-based antioxidant include "MARK 2112", "MARK PEP-8", "MARK PEP-24G", "MARK PEP-36", "MARK 329K", and "MARK HP-10" (manufactured by Adeka Corporation), and the like.

Furthermore, for the purpose of decreasing the residual potential or improve the strength of the charge transporting layer, various particles may be added to the charge transporting composition.

One example of the particles may be a silicon-containing particle. The silicon-containing particle is a particle including silicon as a constituent element, and specific examples thereof include colloidal silica, silicone particles, and the like. The colloidal silica used as a silicon-containing particle is, for example, a dispersion in which silica particles having an average particle diameter of 1 nm or more and 100 nm or less (preferably 10 μm or more and 30 nm or less) are dispersed in an acidic or alkaline aqueous solvent, or in an organic solvent such as an alcohol, a ketone, an ester, and the like. As the colloidal silica, a commercially available product may be used.

The content of the colloidal silica is not particularly limited, but is preferably in the range of 0.1% by mass or more and 50% by mass or less, and more preferably in the range of 0.1% by mass or more and 30% by mass or less, based on the total mass of the solid content of the charge transporting composition, from the viewpoints of the film forming ability, the electrical characteristics, and the strength.

The silicone particles that are used as silicon-containing particles are selected, for example, from silicone resin particles, silicone rubber particles, and silica particles surface-treated with silicone, and silicone particles generally commercially available are used. These silicone particles are, for example, spherical in shape, having an average particle diameter of preferably 1 nm or more and 500 nm or less (particularly 10 nm or more and 100 nm or less).

The content of the silicone particles is preferably 0.1% by mass or more and 30% by mass or less, and more preferably 0.5% by mass or more and 10% by mass or less, based on based on the total mass of the solid content of the charge transporting composition.

In addition, other examples of the particles include fluorine particles such as ethylene tetrafluoride, ethylene trifluoride, propylene hexafluoride, vinyl fluoride, vinylidene fluoride, and the like, particles of resin obtained by copolymerizing a fluorine resin and a monomer having a hydroxyl group, such as those described on p. 89 to 90 of "The Proceeding of 8th Polymer Material Forum Lecture", and particles of semiconductive metal oxides (wherein the semiconductive metal oxide preferably has a volume resistivity of, for example, $10^3$ Ωcm or more and $10^{10}$ Ωcm or less), such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, MgO, and the like.

Furthermore, for the purpose of decreasing the residual potential or improving the strength of the charge transporting layer, oils such as silicone oil and the like may be added to the charge transporting composition. Examples of the silicone oil include silicone oils such as dimethylpolysiloxane, diphenylpolysiloxane, phenylmethylsiloxane, and the like; reactive silicone oils such as amino-modified polysiloxane, epoxy-modified polysiloxane, carboxy-modified polysiloxane, carbinol-modified polysiloxane, methacryl-modified polysiloxane, mercapto-modified polysiloxane, phenol-modified polysiloxane, and the like; cyclic dimethylcyclosiloxanes such as hexamethylcyclotrisiloxane, octamethylcyclotetrasiloxane, decamethylcyclopentasiloxane, dodecamethylcyclohexasiloxane, and the like; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, 1,3,5,7,9-pentamethyl-1,3,5,7,9-pentaphenylcyclopentasiloxane, and the like; cyclic phenylcyclosiloxanes such as hexaphenylcyclotrisiloxane and the like; fluorine-containing cyclosiloxanes such as (3,3,3-trifluoropropyl)methylcyclotrisiloxane and the like; hydrosilyl group-containing cyclosiloxanes such as a methylhydrosiloxane mixture, pentamethylcyclopentasiloxane, phenylhydrocyclosiloxane, and the like; and vinyl group-containing cyclosiloxanes such as pentavinylpentamethylcyclopentasiloxane and the like.

Furthermore, a metal, a metal oxide, carbon black, or the like may be added to the charge transporting composition. Examples of the metal include aluminum, zinc, copper, chromium, nickel, silver, stainless steel, and the like, and resin particles onto which a metal such as above is vapor-deposited. Examples of the metal oxide include zinc oxide, titanium oxide, tin oxide, antimony oxide, indium oxide, bismuth oxide, tin-doped indium oxide, antimony-doped or tantalum-doped tin oxide, antimony-doped zirconium oxide, and the like. These may be used alone or in a combination of 2 or more kinds thereof. When 2 or more kinds thereof are used in combination, these may be simply mixed or made into a solid solution or a fused product. The average particle diameter of the conductive particles may be, for example, in the range of 0.3 μm or less or in the range of 0.1 μm or less, from the viewpoint of transparency of the cured film.

—Method for Forming Charge Transporting Layer—

The method for forming a charge transporting layer will be described.

In the first place, a coating liquid for forming a charge transporting layer, including the charge transporting composition, is coated on a charge generating layer.

The coating liquid for forming a charge transporting layer, including the charge transporting composition, for example, is obtained by mixing the above-described materials and making a solution thereof with a solvent. The coating liquid for forming a charge transporting layer, including, the charge transporting composition, is preferably made as a coating liquid in the form of a slurry by the addition of various particles in terms of film formation. Here, examples of the method for obtaining a coating liquid in the form of a slurry by the addition of various particles include methods using an agitation method by an agitation blade, a wet type method (for example, a jet mill, a bead mill, and the like), or the like, In addition, examples of the coating method include usual methods such as a ring coating method, a blade coating method, a wire bar coating method, a spray coating method, a dip coating method, a bead coating method, an air knife coating method, a curtain coating method, and the like.

Next, by curing the formed coating film by, for example, a heating treatment or an electron beam irradiation treatment, a cured film is formed, which is taken as a charge transporting layer.

Examples of the method for the heating treatment include methods using a known heating treatment apparatus such as a heat air-type drying furnace and the like.

In the heating treatment, that is, the curing by heat, from the viewpoint of the preparation efficiency, control of the side reaction, and inhibition of deterioration of the charge transporting composition, the reaction temperature may be, for example, in the range of 30° C. or higher and 180° C. or lower, in the range of 80° C. or higher and 170° C. or lower, or in the range of 100° C. or higher and 160° C. or lower.

Furthermore, the reaction time is chosen according to the reaction temperature, and it may be, for example, in the range of 5 minutes or more and 1000 minutes or less, in the range of 15 minutes or more and 500 minutes or less, or in the range of 30 minutes or more and 120 minutes or less.

Further, the heating treatment, that is, the curing by heat is preferably carried out, for example, in a vacuum or under an inert gas atmosphere (for example, of an oxygen concentration in the range of 1 ppm or more and 5% or less, in the range of 5 ppm or more and 3% or less, or in the range of 10 ppm or more and 500 ppm or less), in order to contribute to a polymerization reaction (chain polymerization reaction) of a chain polymerizable functional group without deactivation of the radicals generated by a polymerization initiator.

Examples of the method for the electron beam irradiation treatment include methods carried out by a known electron beam irradiation apparatus.

The electron beam irradiation treatment may be generally, for example, irradiation of energy at preferably 300 eV or less, generally from the viewpoint of allowing the curing reaction to proceed efficiently while inhibiting decomposition of the compound, but in the case of temporary curing, it may be carried out at 1 Mrad to 5 Mrad.

The film thickness of the charge transporting layer may be, for example, in the range of 5 μm or more and 50 μm or less or in the range of 10 μm or more and 40 μm or less.

Examples of the function-separate type electrophotographic photoreceptors are described above, and in this regard, in the case of the constitution of the layer of the electrophotographic photoreceptor shown in FIG. 2, the singlelayer type photosensitive layer (charge generating/charge transporting layer) positioned on the outermost surface in the constitution of the layer becomes the outermost layer, and on this singlelayer type photosensitive layer, a layer including a cured film of the charge transporting composition is applied. In this case, the charge transporting composition contains a charge generating material, the content of which may be, for example, in the range of 10% by mass or more and 85% by mass or less or in the range of 20% by mass or more and 50% by mass or less, based on the total mass of the solid content. The film thickness of the singlelayer type photosensitive layer (charge generating/charge transporting layer) may be, for example, in the range of 5 μm or more and 50 μm or less or in the range of 10 μm or more and 40 μm or less.

Furthermore, in the present exemplary embodiment, a configuration where the outermost layer including the cured film of the charge transporting composition is a charge transporting layer is described, and in this regard, in the case of the constitution of the layer including a protective layer as in the electrophotographic photoreceptor shown in FIGS. 3 and 4, the protective layer positioned on the outermost surface in the constitution of the layer becomes an outermost layer, and a layer including the cured film of the charge transporting composition is applied on the protective layer. The film thickness of the protective layer may be, for example, in the range of 1 μm or more and 15 μm or less or in the range of 3 μm or more and 10 μm or less.

Further, as a constitution of the charge transporting layer and the singlelayer type photosensitive layer in the case of having a protective layer, a well-known constitution is employed.

[Image Forming Apparatus/Process Cartridge]

Figure 5:
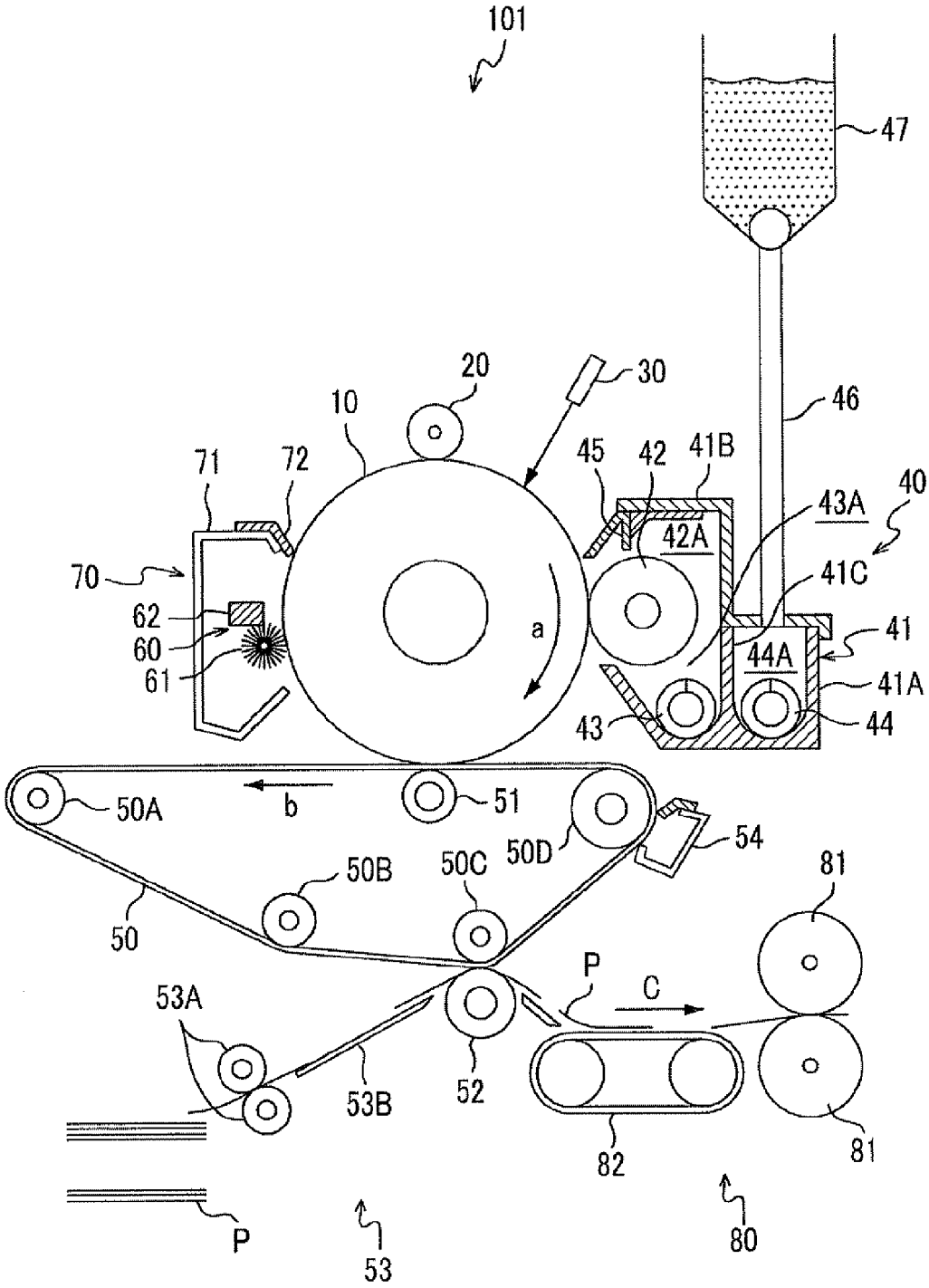
FIG. 5 is a schematic structural view showing an image forming apparatus according to the present exemplary embodiment.

FIG. 5 is a schematic structural view showing one example of an image forming apparatus according to the present exemplary embodiment.

As shown in FIG. 5, the image forming apparatus 101 according to the present exemplary embodiment is equipped with, for example, an electrophotographic photoreceptor 10 (the electrophotographic photoreceptor according to the present exemplary embodiment) that rotates clockwise as indicated by an arrow a; a charging device 20 (one example of charging units) that is provided, facing the electrophotographic photoreceptor 10, on the upper side of the electrophotographic photoreceptor 10, and charges the surface of the electrophotographic photoreceptor 10; an exposure device 30 (one example of electrostatic latent image forming units) that is exposed to the surface of the electrophotographic photoreceptor 10 charged by the charging device 20 to form an electrostatic latent image; a developing device 40 (one example of developing units) that stores a developer including a toner and develops an electrostatic latent image on the electrophotographic photoreceptor 10 into a toner image by a developer; an intermediate transfer medium 50 in the form of a belt that transfers a toner image formed on the surface of the electrophotographic photoreceptor 10 while moving in the direction indicated by an arrow b in contact with the electrophotographic photoreceptor 10; and a cleaning device 70 (one example of cleaning units) that cleans the surface of the electrophotographic photoreceptor 10.

It is structured that the charging device 20, the exposure device 30, the developing device 40, the intermediate transfer medium 50, the lubricant supply apparatus 60, and the cleaning device 70 are configured to rotate clockwise in a circle surrounding the electrophotographic photoreceptor 10. Further, in the present exemplary embodiment, a configuration where the lubricant supply apparatus 60 is disposed in the cleaning device 70 will be described, but is not limitative, and thus, a configuration where a lubricant supply apparatus 60 is disposed separately from the cleaning device 70 may be allowed. Of course, a configuration where a lubricant supply apparatus 60 is not provided may be allowed, The intermediate transfer medium 50 is driven in the direction of an arrow b with rotation of a driving roll 50D while being held by applying tension by means of support rolls 50A and 50B, a backside roll 50C, and a driving roll 50D from the inside. At a position facing the electrophotographic photoreceptor 10 inside the intermediate transfer medium 50, a primary transfer device 51 that charges the intermediate transfer medium 50 to have a polarity different from the charged polarity of the toner to adsorb the toner on the electrophotographic photoreceptor 10 onto the outside of the intermediate transfer medium 50, is provided. On the outside in the lower part of the intermediate transfer medium 50, a secondary transfer device 52, that charges the recording paper P (one example of transferred media) to a polarity different from the charged polarity of the toner to transfer the toner image formed on the intermediate transfer medium 50 to the recording paper P, is provided, facing the backside roll 50C. Further, this member for transferring the toner image formed on the electrophotographic photoreceptor 10 to recording paper P corresponds to one example of transfer units.

In the lower part of the intermediate transfer medium 50, a recording paper supply apparatus 53 that supplies recording paper P to the secondary transfer device 52, and a fixing apparatus 80 that fixes the toner image while transporting the recording paper P on which the toner image is formed in the secondary transfer device 52, are further provided.

The recording paper supply apparatus 53 is equipped with one pair of transport rolls 53A and an induction plate 53B that induces the recording paper P transported by the transport roll 53A toward the secondary transfer device 52. On the other hand, the fixing apparatus 80 has fixing rolls 81 that are a pair of heat rolls that perform fixing of the toner image by heating and pressing the recording paper P on which the toner image is transferred by the secondary transfer device 52, and a transporting rotating element 82 that transports the recording paper P toward the fixing rolls 81.

The recording paper P is transported in the direction indicated by an arrow c by the recording paper supply apparatus 53, the secondary transfer device 52, and the fixing apparatus 80.

In the intermediate transfer medium 50, an intermediate transfer medium cleaning device 54 having a cleaning blade that removes the toner remaining on the intermediate transfer medium 50 after transferring the toner image to the recording paper P in the secondary transfer device 52, is further provided.

Hereinafter, the details on the main constitution members in the image forming apparatus 101 according to the present exemplary embodiment will be described.

—Charging Device—

Examples of the charging device 20 include contact type charging devices using conductive charging rolls, charging brushes, charging films, charging rubber blades, charging tubes, or the like. Further, examples of the charging device 20 include known charging devices, such as non-contact type roll charging devices, scorotron charging devices or corotron charging devices utilizing corona discharge, and the like. As the charging device 20, a contact type charging device is preferable.

—Exposure Device—

Examples of the exposure device 30 include optical instruments which may expose the surface of the electrophotographic photoreceptor 10 to an image by using light of semiconductor laser light, LED light, or a liquid-crystal shutter light, and the like. The wavelength of a light source is preferably in the spectral sensitivity region of the electrophotographic photoreceptor 10. As the wavelength of the semiconductor laser light, near-infrared light having an oscillation wavelength, for example, in the vicinity of 780 nm is preferable. However, the wavelength is not limited to the above-described wavelength, and laser light having an oscillation wavelength on the order of 600 nm and blue laser light having an oscillation wavelength of 400 nm or more and 450 nm or less may also be used. Further, for the exposure device 30, a surface-emitting type laser light source which performs multi-beam output is also effective to form a color image.

—Developing Device—

The developing device 40 is, for example, disposed facing the electrophotographic photoreceptor 10 in the developing region, and has, for example, a developing container 41 (developing device main body) that stores a two-component developer including a toner and a carrier and a replenishing developer storing container (toner cartridge) 47. The developing container 41 has a developing container main body 41A and a developing container cover 41B that blocks the top of the main body.

The developing container main body 41A has, for example, inside thereof, a developing roll chamber 42A that stores a developing roll 42, a first agitation chamber 43A adjacent to the developing roll chamber 42A, and a second agitation chamber 44A adjacent to the first agitation chamber 43A. Further, in the developing roll chamber 42A, for example, a layer thickness regulating member 45 that regulates the layer thickness of the developer on the surface of the developing roll 42 when the developing container cover 41B is installed on the developing container main body 41A, is provided.

The first agitation chamber 43A and the second agitation chamber 44A are separated by, for example, a partition wall 41C, and although not shown, the first agitation chamber 43A and the second agitation chamber 44A are connected to each other by providing openings at both ends in the longitudinal direction of the partition wall 41C (the longitudinal direction of the developing device), and the first agitation chamber 43A and the second agitation chamber 44A constitute a circulating agitation chamber (43A+44A).

Moreover, in the developing roll chamber 42A, the developing-roll 42 is disposed to face the electrophotographic photoreceptor 10. Although not shown, the developing roll 42 has sleeves provided on the outside of a magnetic roll (fixed magnet) having a magnetic property. The developer of the first agitation chamber 43A is adsorbed on the surface of the developing roll 42 by a magnetic force of the magnetic roll and transported to the developing region. Further, the developing roll 42 is supported so as to allow its roll axis to freely rotate in the developing container main body 41A. Here, the developing roll 42 and the electrophotographic photoreceptor 10 rotate in the opposite directions, and at the opposite part, the developer adsorbed on the surface of the developing roll 42 is configured to be transported to the developing region from the same direction as the traveling direction of the electrophotographic photoreceptor 10.

Furthermore, a bias supply, not shown, is connected to the sleeve of the developing roll 42, and a developing bias is applied thereto (in the present exemplary embodiment, a bias having an alternating current component (DC) superimposed on a direct current component (AC) is applied so as to apply an alternating electric field to a developing region).

In the first agitation chamber 43A and the second agitation chamber 44A, a first agitation member 43 (agitation/transporting member) and a second agitation member 44 (agitation/transporting member) that transport a developer under agitation are disposed. The first agitation member 43 is constituted by a first rotation axis extending in the axial direction of the developing roll 42 and an agitation transporting blade (projection) fixed in a screw shape in the outer periphery of the rotation axis. Further, similarly, the second agitation member 44 is also constituted by a second rotation axis and an agitation transporting blade (projection). Further, the agitation member is supported so as to freely rotate in the developing container main body 41A. In addition, the first agitation member 43 and the second agitation member 44 are configured so that by the rotation, the developers in the first agitation chamber 43A and the second agitation chamber 44A are transported in the opposite directions to each other.

Further, to one end side in the longitudinal direction of the second agitation chamber 44A, one end of the replenishing transport path 46 for supplying a replenishing developer including a replenishing toner and a replenishing carrier to the second agitation chamber 44A is connected, and to the other end of the replenishing transport path 46, a replenishing developer storing container 47 that stores a replenishing developer is connected.

Thus, the developing device 40 supplies the replenishing developer from the replenishing developer storing container (toner cartridge) 47 through a replenishing transport path 46 to the developing device 40 (second agitation chamber 44A).

—Transfer Device—

Examples of the primary transfer device 51 and the secondary transfer device 52 include known transfer charging devices such as contact type transfer charging devices using a belt, a roll, a film, a rubber blade, or the like, a scorotron transfer charging device and a corotron transfer charging device utilizing corona discharge, and the like.

As the intermediate transfer medium 50, one in the form of a belt (intermediate transfer belt) made of polyimide, polyamideimide, polycarbonate, polyarylate, polyester, rubber, or the like which contains a conductive agent is used. Further, the intermediate transfer medium to be used may also be a cylindrical form, in addition to the form of a belt.

—Cleaning Device—

The cleaning device 70 is configured to include a housing 71, a cleaning blade 72 disposed to protrude from the housing 71, and a lubricant supply apparatus 60 disposed downstream of the rotational direction of the electrophotographic photoreceptor 10 of the cleaning blade 72.

Further, the cleaning blade 72 may be configured to be supported at the ends of the housing 71, or may be configured to be supported by a supporting member (holder), but in the present exemplary embodiment, it is configured to be supported at the ends of the housing 71.

First, the cleaning blade 72 will be described.

Examples of the material constituting the cleaning blade 72 include urethane rubber, silicone rubber, fluorine rubber, chloroprene rubber, butadiene rubber, and the like. Among these, urethane rubber is preferable.

The urethane rubber (polyurethane) is not particularly limited as long as it is generally used in, for example, formation of a polyurethane. Examples thereof include urethane prepolymers including polyols (for example, polyester polyols such as polyethylene adipate, polycaprolactone, and the like), and isocyanate (for example, diphenyl methane diisocyanate, and the like). Further, the urethane rubber (polyurethane) preferably has a crosslinking agent, such as for example, 1,4-butanediol, trimethylolpropane, ethylene glycol, a mixture thereof, and the like, as a raw material.

Next, the lubricant supply apparatus 60 will be described.

The lubricant supply apparatus 60 is, for example, provided upstream of the rotating direction of the electrophotographic photoreceptor 10, with respect to the cleaning blade 72 in the cleaning device 70.

The lubricant supply apparatus 60 is constituted with, for example, a rotating brush 61 disposed to be in contact with the electrophotographic photoreceptor 10, and a lubricant 62 in the solid form, disposed to be in contact with the rotating brush 61. In the lubricant supply apparatus 60, when the rotating brush 61 is rotated in contact with the lubricant 62 in the solid form, the lubricant 62 attaches to the rotating brush 61, and also, the attached lubricant 62 is supplied to the surface of the electrophotographic photoreceptor 10 and a film of the lubricant 62 is formed.

Furthermore, the lubricant supply apparatus 60 is not limited to the above-described configurations, and it may be configured to employ, for example, a rubber roll instead of the rotating brush 61.

Next, the operation of the image forming apparatus 101 according to the present exemplary embodiment will be described. First, the electrophotographic photoreceptor 10 rotates in the direction indicated by an arrow a, and at the same time, is negatively charged by the charging device 20.

The electrophotographic photoreceptor 10 having the surface negatively charged by the charging device 20 is exposed by the exposure device 30, and a latent image is formed on the surface.

When the latent image-formed part in the electrophotographic photoreceptor 10 comes closer to the developing device 40, the toner is attached to the latent image by the developing device 40 (developing roll 42) and a toner image is formed.

If the electrophotographic photoreceptor 10 in which the toner image is formed further rotates in the direction of an arrow a, the toner image is transferred to the surface on the outside of the intermediate transfer medium 50.

If the toner image is transferred to the intermediate transfer medium 50, the recording paper P is supplied to the secondary transfer device 52 by the recording paper supply apparatus 53, and the toner image transferred to the intermediate transfer medium 50 is transferred onto the recording paper P by the secondary transfer device 52. By this, a toner image is formed on the recording paper P.

The recording paper P on which an image is formed allows a toner image to be fixed by the fixing apparatus 80.

Here, after the toner image is transferred to the intermediate transfer medium 50, for the electrophotographic photoreceptor 10, the lubricant 62 is supplied to the surface of the electrophotographic photoreceptor 10 by the lubricant supply apparatus 60 after the transfer, and a film of the lubricant 62 is formed on the surface of the electrophotographic photoreceptor 10. Thereafter, the toner or discharge products remaining on the surface are removed by the cleaning blade 72 of the cleaning device 70. Further, in the cleaning device 70, the electrophotographic photoreceptor 10 having the remaining transferred toner or discharge products removed therefrom is charged again by the charging device 20, and exposed by the exposure device 30, and thus, a latent image is formed.

Figure 6:
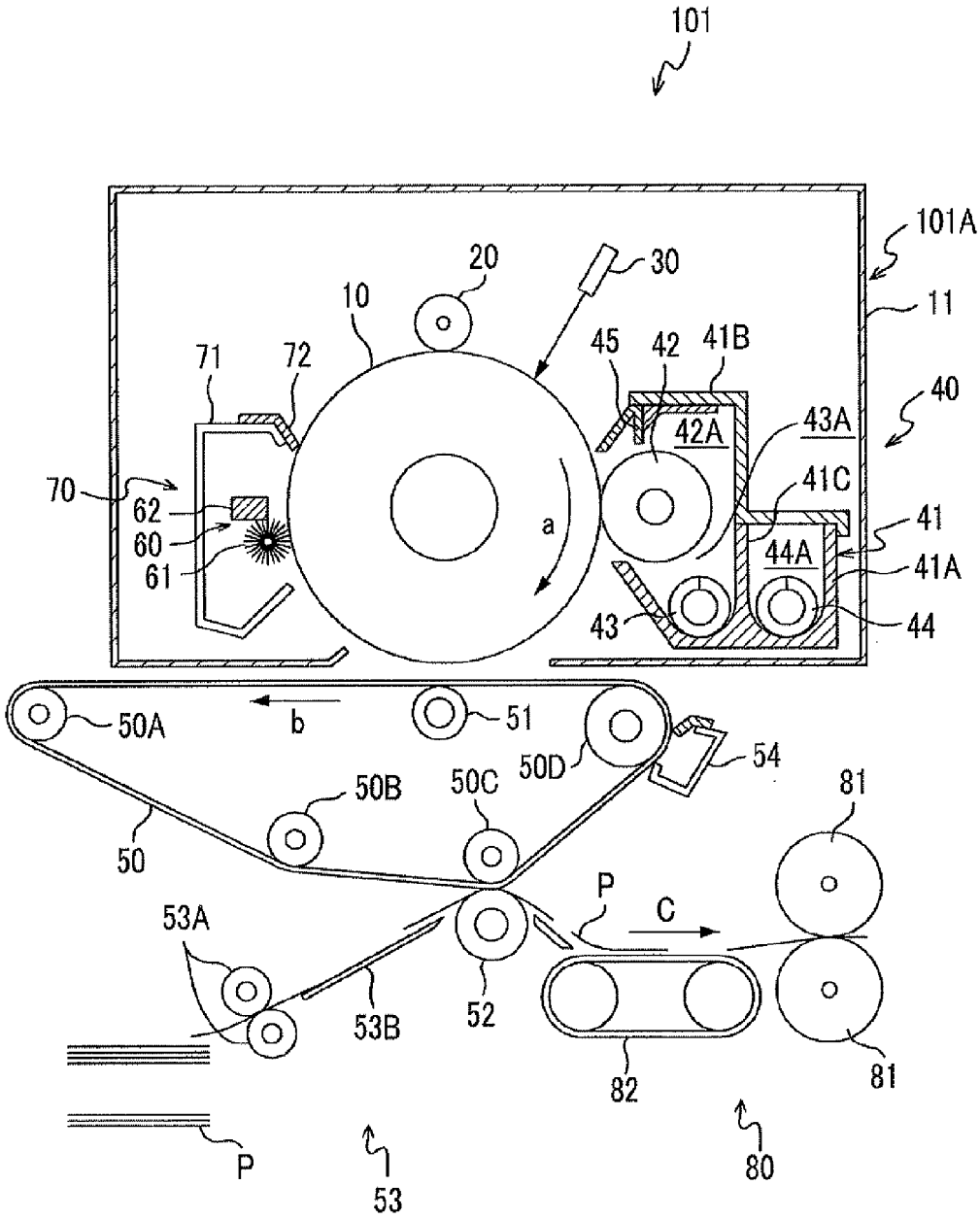
FIG. 6 is a schematic structural view showing another image forming apparatus according to the present exemplary embodiment.

Furthermore, the image forming apparatus 101 according to the present exemplary embodiment may be, for example, configured to include a process cartridge 101A having the electrophotographic photoreceptor 10, the charging device 20, the developing device 40, the lubricant supply apparatus 60, and the cleaning device 70, integrally housed in a housing 11, as shown in FIG. 6. This process cartridge 101A integrally houses plural members and is detached from the image forming apparatus 101. Further, in the image forming apparatus 101 shown in FIG. 6, a configuration is shown in which a replenishing developer storing container 47 is not provided in the developing device 40.

The constitution of the process cartridge 101A is not limited thereto, and it may be equipped with, for example, at least the electrophotographic photoreceptor 10, and in addition, for example, at least one selected from the charging device 20, the exposure device 30, the developing device 40, the primary transfer device 51, the lubricant supply apparatus 60, and the cleaning device 70.

Furthermore, the image forming apparatus 101 according to the present exemplary embodiment is not limited to the above-described constitution, and, it may be configured, for example, to be provided with a first charge erasing apparatus for easily erasing charge by a cleaning brush, having the same polarity of the remaining toner, downstream of the rotating direction of the electrophotographic photoreceptor 10 with respect to the primary transfer device 51 and upstream of the rotating direction of the electrophotographic photoreceptor with respect to the cleaning device 70, or to be provided with a second charge erasing apparatus for erasing charge at the surface of the electrophotographic photoreceptor 10, downstream of the rotating direction of the electrophotographic photoreceptor with respect to the cleaning device 70 and upstream of the rotating direction of the electrophotographic photoreceptor with respect to the charging device 20, around the electrophotographic photoreceptor 10.

Furthermore, the image forming apparatus 101 according to the present exemplary embodiment is not limited to the above-described constitution, and a well-known constitution, for example, a configuration where a toner image formed on the electrophotographic photoreceptor 10 is directly transferred to recording paper P may be employed or a tandem type of an image forming apparatus may also be employed.

EXAMPLES

Hereinbelow, the present invention will be described in more detail with reference to Examples. However, the present invention is not limited thereto.

Reference Example 1

Preparation of Electrophotographic Photoreceptor

—Formation of Undercoat Layer—

100 parts by mass of zinc oxide (average particle diameter: 70 nm, manufactured by Tayca Corporation, specific surface area: 15 $m^2/g$) is stirred and mixed with 500 parts by mass of toluene, into which 1.3 parts by mass of a silane coupling agent (KBM503, manufactured by Shin-Etsu Chemical Co., Ltd.) is added, and the mixture is stirred for 2 hours. Subsequently, toluene is removed by distillation under reduced pressure, and baking is carried out at a temperature of 120° C. for 3 hours to obtain zinc oxide having a surface treated with the silane coupling agent.

110 parts by mass of the surface-treated zinc oxide is stirred and mixed with 500 parts by mass of tetrahydrofuran, into which a solution in which 0.6 part by mass of alizarin is dissolved in 50 parts by mass of tetrahydrofuran is added, and the mixture is then stirred at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by mass of a solution prepared by dissolving 60 parts by mass of the alizarin-added zinc oxide, 13.5 parts by mass of a curing agent (blocked isocyanate, Sumidur 3175, manufactured by Sumitomo-Bayer Urethane Co., Ltd.) and 15 parts by mass of a butyral resin (S-Lee BM-1, manufactured by Sekisui Chemical Co., Ltd.) in 85 parts by mass of methyl ethyl ketone is mixed with 25 parts by mass of methyl ethyl ketone. The mixture is dispersed using a sand mill with glass beads having a diameter of 1 mmϕ for 2 hours to obtain a dispersion.

0.005 part by mass of dioctyltin dilaurate as a catalyst and 40 parts by mass of silicone resin particles (Tospal 145, manufactured by GE Toshiba Silicone Co., Ltd.) are added to the resulting dispersion to obtain a coating liquid for forming an undercoat layer. The coating liquid is applied on a cylindrical aluminum substrate by a dip coating method, and drying to cure at a temperature of 170° C. for 40 minutes to form an undercoat layer having a thickness of 18 μm is performed.

—Formation of Charge Generating Layer—

A mixture comprising 15 parts by mass of hydroxygallium phthalocyanine having the diffraction peaks at least at 7.3°, 16.0°, 24.9° and 28.0° of Bragg angles (2θ±0.2°) in an X-ray diffraction spectrum of Cukα characteristic X rays as a charge generating substance, 10 parts by mass of vinyl chloride-vinyl acetate copolymer resin (VMCH, manufactured by Nippon Unicar Co., Ltd.) as a binder resin, and 200 parts by mass of n-butyl acetate is dispersed using a sand mill with the glass beads of 1 mmϕ diameter for 4 hours. 175 parts by mass of n-butyl acetate and 180 parts by mass of methyl ethyl ketone are added to the obtained dispersion, and the mixture is then stirred to obtain a coating liquid for forming a charge generating layer. The coating liquid for a charge generating layer is applied to the undercoat layer by a dip coating method, and dried at an ordinary temperature to form a charge generating layer having a film thickness of 0.2 μm.

—Formation of Charge Transporting Layer—

45 parts by mass of N,N'-diphenyl-N,N'-bis(3-methylphenyl)-[1,1]biphenyl-4,4'-diamine (hereinafter referred to as "TPD") and 55 parts by mass of a bisphenol Z polycarbonate resin (viscosity average molecular weight: 50,000) are dissolved in 800 parts by mass of chlorobenzene to obtain a coating liquid for forming a charge transporting layer. The coating liquid is applied on the charge generating layer, and then dried at a temperature of 130° C. for 45 minutes to form a charge transporting layer having a film thickness of 20 μm.

—Formation of Protective Layer—

Preliminarily, based on 100 parts by mass of the compound represented by (i-26) above as a specific charge transporting material, 10 parts by mass of EGMP-4 (tetraethylene glycol bis(3-mercaptopropionate), manufactured by SC Organic Chemical Co., Ltd.) as a chain transfer agent is dissolved in 315 parts by mass of a mixed solvent of tetrahydrofuran (stabilizer not included, manufactured by Tokyo Chemical Industry Co., Ltd.) and toluene (manufactured by Kanto Chemical Co., Ltd.) at a ratio by mass of 50:50. Thereafter, 2 parts by mass of VE-70 (manufactured by Wako Pure Chemical Industries, Ltd.) is added as a polymerization initiator and dissolved therein to prepare a coating liquid for forming a protective layer and a film is prepared by a ring coating method on the charge transporting layer. Subsequently, a curing reaction is carried out under the condition of an oxygen concentration of 300 ppm or less at a temperature of 150±5° C. and a time of 60 minutes with a nitrogen dryer having an oxygen concentration meter to form a protective layer having a film thickness of 7 μm.

In the above-described manner, an electrophotographic photoreceptor is prepared.

Examples, Reference Examples 2 to 36, and Comparative Examples 1 to 4

An undercoat layer, a charge generating layer, and a charge transporting layer are formed on a cylindrical aluminum substrate by the method described in Reference Example 1. Thereafter, by the same method as described in Reference Example 1 except that the coating liquid for forming a protective layer is changed according to Tables 1 to 2, a protective layer is formed, and thus, an electrophotographic photoreceptor is prepared.

Example 37

Formation of Undercoat Layer and Charge Generating Layer

An undercoat layer and a charge generating layer are formed on a cylindrical aluminum substrate by the method described in Reference Example 1.

Formation of Charge Transporting Layer 45 parts by mass of N,N'-diphenyl-N,N'-bis(3-methylphenyl)-[1,1']biphenyl-4,4'-diamine (hereinafter referred to as "TPD") and 55 parts by mass of a bisphenol Z polycarbonate resin (viscosity average molecular weight: 50,000) are dissolved in 800 parts by mass of chlorobenzene to obtain a coating liquid for forming a charge transporting layer. The coating liquid is applied on the charge generating layer and then dried at a temperature of 130° C. for 45 minutes to form a charge transporting layer having a film thickness of 20 μm.

—Formation of Protective Layer—

Preliminarily, 10 parts by mass of Karenz MT PE1 (pentaerythritol tetrakis(3-mercaptobutylate, manufactured by Showa Denko Co., Ltd.) as a chain transfer agent is dissolved in 315 parts by mass of a mixed solvent of tetrahydrofuran (stabilizer not included, manufactured by Tokyo Chemical Industry Co., Ltd.) and toluene (manufactured by Kanto Chemical Co., Ltd.) at a ratio by mass of 50:50, based on 100 parts by mass of the compound represented by (i-26) above as a specific charge transporting material. Thereafter, 2 parts by mass Irgacure 651 (manufactured by Ciba Specialty Chemicals Inc.) is added as a polymerization initiator and dissolved therein to prepare a coating liquid for forming a protective layer and a film is prepared by a ring coating method on the charge transporting layer. Subsequently, a curing reaction is carried out by irradiating ultraviolet rays (UV rays) at a temperature of 30±5° C. for 60 seconds under a nitrogen air flow environment, using Unicure Systems (manufactured by USHIO Inc.) and the residual solvent is dried out at a temperature of 120±5° C. for 30 minutes to form a protective layer having a film thickness of 7 μm.

In the above-described manner, the electrophotographic photoreceptor is prepared.

Examples 38 to 40

An undercoat layer, a charge generating layer, and a charge transporting layer are formed on a cylindrical aluminum substrate by the method described in Example 37. Thereafter, by the same method as described in Example 37 except that the coating liquid for forming a protective layer is changed according to Table 3, a protective layer is formed, and thus, an electrophotographic photoreceptor is prepared.

[Evaluation 1]

The electrophotographic photoreceptor obtained in each example is installed on a DocuCentre Color 450 remodeled device manufactured by Fuji Xerox Co., Ltd., and print images having a solid image part having an image concentration of 100% and a half-tone image part having an image concentration of 20% are continuously printed on A4 paper with 5,000 sheets under an environment of 20±3° C. and 40±10% RH.

For the print image of the $5000^{th}$ sheet after elapse of time, the following image evaluation tests are carried out. Further, evaluation on the scratch resistance of the electrophotographic photoreceptor and evaluation of the flexibility and the toughness of the outermost layer are also carried out. The results are shown in Tables 1 to 3.

Further, for the image forming tests, P paper manufactured by Fuji Xerox Co., Ltd. (A4 size, supplied in a transverse direction) is used.

—Evaluation on Image Density Unevenness at Initial Time—

For evaluation on the image density unevenness at an initial time, a solid image part of the print image of the 100th sheet is used, observed with naked eyes, and examined in accordance with the following criteria.

A: Development of image density unevenness is not observed.

B: Development of partial image density unevenness is observed.

C: Development of image density unevenness having a damaging effect on image quality is observed.

—Evaluation on Resolution at Initial Time—

For evaluation on the resolution at an initial time, a half-tone image part of the print image of the $100^{th}$ sheet is used, and five places are observed using an optical microscope (magnification 100 times) and examined in accordance with the following criteria.

A: Half-tone dots are observed.

B: Parts of the half-tone dots are not developed.

C: Half-tone dots are not developed.

—Evaluation on Image Density Unevenness after Elapse of Time—

For evaluation on the image density unevenness after elapse of time, a solid image part of the print image of the $5000^{th}$ sheet is used, observed with naked eyes, and examined in accordance with the following criteria.

A: Development of image density unevenness is not observed.

B: Development of partial image density unevenness is observed.

C: Development of image density unevenness having a damaging effect on image quality is observed.

—Evaluation on Resolution after Elapse of Time—

For evaluation on the resolution after elapse of time, a half-tone image part of the print image of the $5000^{th}$ sheet is used, and five places are observed using an optical microscope (magnification 100 times) and examined in accordance with the following criteria.

A: Half-tone dots are observed.

B: Parts of the half-tone dots are not developed.

C: Half-tone dots are not developed.

—Evaluation on Scratch Resistance—

The surface of the electrophotographic photoreceptor after printing 5000 sheets is observed with naked eyes and evaluated in accordance with the following criteria.

A: Development of scratch is not observed.

B: Very partial development of scratch is observed.

C: Partial development of scratch is observed,

D: Overall development of scratch is observed.

—Evaluation on Cut-Bending Property of Outermost Layer—

In the same manner as the methods in the respective examples, only a layer corresponding to the outermost layer of the electrophotographic photoreceptor is formed to have a thickness of 69 μm on a glass substrate, and 5 sheets of samples for evaluation are prepared.

Further, for the layers formed as the samples for evaluation, strip specimens at horizontal×vertical=25±1 mm×5±1 mm are cut out using a cutter knife, and additionally, the grinding depth is made in advance at a length of 1 mm for correspondence to the notch, and evaluation on cut-bending is carried out in accordance with the following criteria.

AA: From all of the 5 sheets, strip specimens can be cut out and further bent and there is toughness in the film.

A: From 3 or more sheets, strip specimens can be cut out and further bent.

B: Up to 3 sheets, strip specimens can be cut out and bent to some extent, but the film cracks.

C: A strip specimen cannot be cut out even from one sheet and the film cracks.

In the evaluation above, a sample in which the strip specimen can be further bent indicates one having flexibility in the film, and a sample having toughness indicates one showing excellent resistance when an external force is applied to the film and also indicates that it is advantageous for the use of the film in the bent state.

[Evaluation 2]

For the resulting electrophotographic photoreceptors obtained in Examples and Reference Examples, after completion of Evaluation 1, 5000 sheets are additionally printed, and under the conditions changed to be more stringent, evaluations (evaluation on image density unevenness, evaluation on resolution, and evaluation on scratch resistance) are carried out by the methods described in Evaluation 1, and in addition, evaluations on cracks and peeling are carried out according to the cross-cutting method shown below, The results are shown in Tables 4 to 5.

—Evaluation of Crack and Peeling According to Cross-Cutting Method—

Four grids are prepared by putting three lines orthogonal to each other to a photoreceptor surface after performing the printing at a spacing of 5±1 mm, using a cutter knife, and the states of the grids at that time are evaluated in accordance with the following criteria.

A: Development of cracks on the photoreceptor surface is not observed and peeling of the grids is also not observed.

B: Partial development of cracks on the photoreceptor surface is observed, but peeling of the grids is not observed.

C: Development and propagation of cracks on the photoreceptor surface is observed and peeling of the grids is also observed.

In the present evaluation, in the case where the film is excellent in flexibility and toughness, it exhibits a ductile fracture behavior when a cross-cut is performed, and thus, development and propagation of cracks may be inhibited and peeling of the grids may also be inhibited.

TABLE 1

Composition of Coating Liquid for Forming Protective Layer, and Results of Evaluation 1

| | Specific charge transporting material | | Chain transfer agent | | Polymerization initiator | | Evaluation of initial | Evaluation of | Evaluation of density unevenness | Evaluation of resolution | Evaluation | Evaluation of outermost |
|---|---|---|---|---|---|---|---|---|---|---|---|---|
| | Kind | Parts by mass | Kind | Parts by mass | Kind | Parts by mass | image unevenness | initial resolution | after elapse of time | after elapse of time | of scratch resistance | layer cut-bending |
| Reference Example 1 | a-1 | 100 | b-1 | 10 | c-1 | 2 | A | A | C | C | C | A |
| Reference Example 2 | a-1 | 100 | b-2 | 10 | c-1 | 2 | A | A | C | C | C | A |
| Reference Example 3 | a-1 | 100 | b-3 | 10 | c-1 | 2 | A | A | C | C | C | A |
| Example 4 | a-1 | 100 | b-4 | 10 | c-1 | 2 | A | A | C | C | C | AA |
| Example 5 | a-1 | 100 | b-5 | 10 | c-1 | 2 | A | A | C | C | C | AA |
| Example 6 | a-1 | 100 | b-6 | 10 | c-1 | 2 | A | A | C | C | C | AA |
| Example 7 | a-1 | 100 | b-7 | 10 | c-1 | 2 | A | A | C | C | C | AA |
| Example 8 | a-1 | 100 | b-8 | 10 | c-1 | 2 | A | A | C | C | C | AA |
| Reference Example 9 | a-2 | 100 | b-1 | 10 | c-1 | 2 | A | A | A | A | B | A |
| Reference Example 10 | a-2 | 100 | b-2 | 10 | c-1 | 2 | A | A | A | A | B | A |
| Reference Example 11 | a-2 | 100 | b-3 | 10 | c-1 | 2 | A | A | A | A | B | A |
| Example 12 | a-2 | 100 | b-4 | 10 | c-1 | 2 | A | A | A | A | A | AA |
| Example 13 | a-2 | 100 | b-5 | 10 | c-1 | 2 | B | B | B | B | B | AA |
| Example 14 | a-2 | 100 | b-6 | 10 | c-1 | 2 | A | A | A | A | B | AA |
| Example 15 | a-2 | 100 | b-7 | 10 | c-1 | 2 | A | A | A | A | B | AA |
| Example 16 | a-2 | 100 | b-8 | 10 | c-1 | 2 | A | A | A | A | B | AA |
| Reference Example 17 | a-3 | 100 | b-1 | 10 | c-1 | 2 | A | A | A | A | A | B |
| Reference Example 18 | a-3 | 100 | b-2 | 10 | c-1 | 2 | A | A | A | A | A | B |
| Reference Example 19 | a-3 | 100 | b-3 | 10 | c-1 | 2 | A | A | A | A | A | B |
| Example 20 | a-3 | 100 | b-4 | 10 | c-1 | 2 | A | A | A | A | A | AA |

TABLE 2

Composition of Coating Liquid for Forming Protective Layer, and Results of Evaluation 1

| | Specific charge transporting material | | Chain transfer agent | | Polymerization initiator | | Evaluation of initial | Evaluation of | Evaluation of density unevenness | Evaluation of resolution | Evaluation | Evaluation of outermost |
|---|---|---|---|---|---|---|---|---|---|---|---|---|
| | Kind | Parts by mass | Kind | Parts by mass | Kind | Parts by mass | image unevenness | initial resolution | after elapse of time | after elapse of time | of scratch resistance | layer cut-bending |
| Example 21 | a-3 | 100 | b-5 | 10 | c-1 | 2 | B | B | B | B | B | AA |
| Example 22 | a-3 | 100 | b-6 | 10 | c-1 | 2 | A | A | A | A | A | AA |
| Example 23 | a-3 | 100 | b-7 | 10 | c-1 | 2 | A | A | A | A | A | AA |
| Example 24 | a-3 | 100 | b-8 | 10 | c-1 | 2 | A | A | A | A | A | AA |
| Reference Example 25 | a-4 | 100 | b-1 | 10 | c-1 | 2 | A | A | A | A | A | AA |
| Reference Example 26 | a-4 | 100 | b-2 | 10 | c-1 | 2 | A | A | A | A | A | B |
| Reference Example 27 | a-4 | 100 | b-3 | 10 | c-1 | 2 | A | A | A | A | A | B |
| Example 28 | a-4 | 100 | b-4 | 10 | c-1 | 2 | A | A | A | A | A | AA |
| Example 29 | a-4 | 100 | b-5 | 10 | c-1 | 2 | B | B | B | B | B | AA |
| Example 30 | a-4 | 100 | b-6 | 10 | c-1 | 2 | A | A | A | A | A | AA |
| Example 31 | a-4 | 100 | b-7 | 10 | c-1 | 2 | A | A | A | A | A | AA |
| Example 32 | a-4 | 100 | b-8 | 10 | c-1 | 2 | A | A | A | A | A | AA |
| Example 33 | a-1 | 100 | b-8 | 20 | c-1 | 2 | A | A | A | A | A | AA |
| Example 34 | a-2 | 100 | b-8 | 20 | c-1 | 2 | A | A | A | A | A | AA |
| Example 35 | a-3 | 100 | b-8 | 20 | c-1 | 2 | A | A | A | A | A | AA |
| Example 36 | a-4 | 100 | b-8 | 20 | c-1 | 2 | A | A | A | A | A | AA |
| Example 33 | a-1 | 100 | b-8 | 30 | c-1 | 2 | A | A | A | A | A | AA |
| Example 34 | a-2 | 100 | b-8 | 30 | c-1 | 2 | A | A | A | A | A | AA |
| Example 35 | a-3 | 100 | b-8 | 30 | c-1 | 2 | A | A | A | A | A | AA |
| Example 36 | a-4 | 100 | b-8 | 30 | c-1 | 2 | A | A | A | A | A | AA |

TABLE 3

Composition of Coating Liquid for Forming Protective Layer, and Results of Evaluation 1

| | Specific charge transporting material | | Chain transfer agent | | Polymerization initiator | | Evaluation of initial image unevenness | Evaluation of initial resolution | Evaluation of density unevenness after elapse of time | Evaluation of resolution after elapse of time | Evaluation of scratch resistance | Evaluation of outermost layer cut-bending |
|---|---|---|---|---|---|---|---|---|---|---|---|---|
| | Kind | Parts by mass | Kind | Parts by mass | Kind | Parts by mass | | | | | | |
| Comparative Example 1 | a-1 | 100 | b-9 | 10 | c-1 | 2 | A | A | D | D | D | B |
| Comparative Example 2 | a-2 | 100 | b-9 | 10 | c-1 | 2 | A | A | D | D | D | B |
| Comparative Example 3 | a-3 | 100 | b-9 | 10 | c-1 | 2 | A | A | D | D | D | C |
| Comparative Example 4 | a-4 | 100 | b-9 | 10 | c-1 | 2 | A | A | D | D | D | C |
| Example 37 | a-1 | 100 | b-8 | 30 | c-2 | 2 | B | B | C | C | C | A |
| Example 38 | a-2 | 100 | b-8 | 30 | c-2 | 2 | B | B | C | C | C | A |
| Example 39 | a-3 | 100 | b-8 | 30 | c-2 | 2 | B | B | C | C | C | A |
| Example 40 | a-4 | 100 | b-8 | 30 | c-2 | 2 | B | B | C | C | C | A |

TABLE 4

Results of Evaluation 2

| | Evaluation of image unevenness after elapse of time | Evaluation of resolution after elapse of time | Evaluation of scratch resistance | Evaluation of crack/peeling |
|---|---|---|---|---|
| Reference Example 1 | C | C | D | B |
| Reference Example 2 | C | C | D | B |
| Reference Example 3 | C | C | D | B |
| Example 4 | C | C | C | A |
| Example 5 | C | C | C | A |
| Example 6 | C | C | C | A |
| Example 7 | C | C | C | A |
| Example 8 | C | C | C | A |
| Reference Example 9 | B | B | D | B |
| Reference Example 10 | B | B | D | B |
| Reference Example 11 | B | B | D | B |
| Example 12 | B | B | C | A |
| Example 13 | B | B | C | A |
| Example 14 | B | B | C | A |
| Example 15 | B | B | C | A |
| Example 16 | B | B | C | A |
| Reference Example 17 | B | B | D | B |
| Reference Example 18 | B | B | D | B |
| Reference Example 19 | B | B | D | B |
| Example 20 | A | A | C | A |

TABLE 5

Results of Evaluation 2

| | Evaluation of image unevenness after elapse of time | Evaluation of resolution after elapse of time | Evaluation of scratch resistance | Evaluation of crack/peeling |
|---|---|---|---|---|
| Example 21 | B | B | C | A |
| Example 22 | B | B | C | A |
| Example 23 | A | A | C | A |
| Reference Example 24 | B | B | D | B |

TABLE 5-continued

Results of Evaluation 2

| | Evaluation of image unevenness after elapse of time | Evaluation of resolution after elapse of time | Evaluation of scratch resistance | Evaluation of crack/peeling |
|---|---|---|---|---|
| Reference Example 25 | B | B | D | B |
| Reference Example 26 | B | B | D | B |
| Reference Example 27 | B | B | D | B |
| Example 28 | A | A | B | A |
| Example 29 | B | B | B | A |
| Example 30 | A | A | B | A |
| Example 31 | A | A | B | A |
| Example 32 | A | A | B | A |
| Example 33 | A | A | B | A |
| Example 34 | A | A | B | A |
| Example 35 | A | A | B | A |
| Example 36 | A | A | B | A |
| Example 33 | A | A | B | A |
| Example 34 | A | A | B | A |
| Example 35 | A | A | B | A |
| Example 36 | A | A | B | A |
| Example 37 | C | C | C | A |
| Example 38 | C | C | C | A |
| Example 39 | C | C | C | A |
| Example 40 | C | C | C | A |

From the results of Evaluations 1 and 2 above, it may be seen that in the present Examples, good results are obtained with respect to the image density unevenness at an initial time and after elapse of time, the resolution at an initial time and after elapse of time, the scratch resistance, and the cut-bending evaluation of the outermost layer, as compared with Comparative Examples.

Hereinafter, the details on the respective materials shown in the Tables are presented below.

[Specific Charge Transporting Material]

(a-1): Compound represented by (i-26)

(a-2): Compound represented by (ii-19)

(a-3): Compound represented by (iv-16)

(a-4): Compound represented by (iv-28)

[Chain Transfer Agent]

(b-1): EGMP-4 (tetraethylene glycol bis(3-mercaptopropionate), manufactured by SC Organic Chemical Co., Ltd., compound containing 2 primary thiol groups)

(b-2): TMMP (trimethylol propane tris(3-mercaptopropionate), manufactured by SC Organic Chemical Co., Ltd., compound containing 3 primary thiol groups)

(b-3): TEMPIC (tris[(3-mercaptopropionyloxy)-ethyl]-isocyanurate, manufactured by SC Organic Chemical Co., Ltd., compound containing 3 primary thiol groups)

(b-4): PEMP (pentaerythritol tetrakis(3-mercaptopropionate), manufactured by SC Organic Chemical Co., Ltd., compound containing 4 primary thiol groups)

(b-5): DPMP (dipentaerythritol hexakis(3-mercaptopropionate), manufactured by SC Organic Chemical Co., Ltd., compound containing 6 primary thiol groups)

(b-6): Karenz MT BD1 (1,4-bis(3-mercaptobutyryloxy) butane, manufactured by Showa Denko Co., Ltd., compound containing 2 secondary thiol groups)

(b-7): Karenz MT NR1 (1,3,5-tris(3-mercaptobutyloxy-ethyl)-1,3,5-triazine 2,4,6(1H,3H,5H-trione), manufactured by Showa Denko Co., Ltd., compound containing 3 secondary thiol groups)

(b-8): Karenz MT PE1 (pentaerythritol tetrakis(3-mercaptobutylate), manufactured by Showa Denko Co., Ltd., compound containing 4 secondary thiol groups)

(b-9): 1-Dodecanethiol (manufactured by Tokyo Chemical Industry Co., Ltd., compound containing one primary thiol group)

[Polymerization Initiator]

(c-1): VE-70 (manufactured by Wako Pure Chemical Industries, Ltd.)

(c-2): Irgacure 651 (manufactured by Ciba Specialty Chemicals Inc.)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. An electrophotographic photoreceptor comprising:

a substrate, and an outermost layer having a cured film of a composition containing a compound having a chain polymerizable functional group and a charge transporting skeleton in the same molecule, and at least one chain transfer agent selected from a compound having 4 or more primary thiol groups and a compound having 2 or more secondary thiol groups.

2. The electrophotographic photoreceptor according to claim 1, wherein the compound having a chain polymerizable functional group and a charge transporting skeleton in the same molecule is a compound having 2 or more of the chain polymerizable functional groups above in the same molecule.

3. The electrophotographic photoreceptor according to claim 1, wherein the compound having a chain polymerizable functional group and a charge transporting skeleton in the same molecule is a compound represented by the following formula (A):

(A)

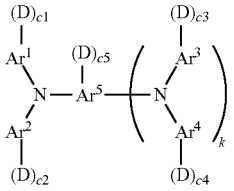

in the formula (A), $Ar^1$ to $Ar^4$ each independently represent a substituted or unsubstituted aryl group; $Ar^5$ represents a substituted or unsubstituted aryl group, or a substituted or unsubstituted arylene group; D represents a group containing a functional group having a carbon double bond; c1 to c5 independently represent 0, 1, or 2; k represents 0 or 1; and the total number of D's is 1 or more.

4. The electrophotographic photoreceptor according to claim 3, wherein the compound represented by the formula (A) is the compound in which D represents a group having at least one selected from an acryloyl group, a methacryloyl group, a vinylphenyl group, an allyl group, a vinyl group, a vinyl ether group, a vinyl ester group, and derivatives thereof, and the total number of D's represents 2 or more.

5. The electrophotographic photoreceptor according to claim 1, wherein the composition further contains a compound having a charge transporting skeleton and having no chain polymerizable reactive group.

6. The electrophotographic photoreceptor according to claim 5, wherein the compound having no chain polymerizable reactive group and having a charge transporting skeleton is in the amount in the range of about 1 part by mass or more and about 50 parts by mass or less, based on 100 parts by mass of the compound having a chain polymerizable functional group and a charge transporting skeleton in the same molecule.

7. The electrophotographic photoreceptor according to claim 1, wherein the chain transfer agent is in the amount in the range of about 0.1 part by mass or more and about 30 parts by mass or less, based on 100 parts by mass of the compound having a chain polymerizable functional group and a charge transporting skeleton in the same molecule.

8. A process cartridge, which comprises the electrophotographic photoreceptor according to claim 1, and is detached from an image forming apparatus.

9. The process cartridge according to claim 8, wherein the compound having a chain polymerizable functional group and a charge transporting skeleton in the same molecule is a compound having 2 or more of the chain polymerizable functional groups above in the same molecule.

10. The process cartridge according to claim 8, wherein the compound having a chain polymerizable functional group and a charge transporting skeleton in the same molecule is a compound represented by the following formula (A):

(A)

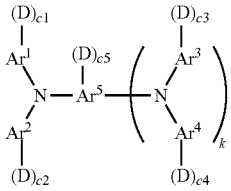

in the formula (A), $Ar^1$ to $Ar^4$ each independently represent a substituted or unsubstituted aryl group; $Ar^5$ represents a substituted or unsubstituted aryl group, or a substituted or unsubstituted arylene group; D represents a group containing a functional group having a carbon double bond; c1 to c5 independently represent 0, 1, or 2; k represents 0 or 1; and the total number of D's is 1 or more.

11. The process cartridge according to claim 10, wherein the compound represented by the formula (A) is the compound in which D represents a group having at least one selected from an acryloyl group, a methacryloyl group, a vinylphenyl group, an allyl group, a vinyl group, a vinyl ether group, a vinyl ester group, and derivatives thereof, and the total number of D's represents 2 or more.

12. The process cartridge according to claim 8, wherein the chain transfer agent is in the amount in the range of about 0.1 part by mass or more and about 30 parts by mass or less, based on 100 parts by mass of the compound having a chain polymerizable functional group and a charge transporting skeleton in the same molecule.

13. An image forming apparatus comprising:

electrophotographic photoreceptor of claim 1, a charging unit that charges the electrophotographic photoreceptor, an electrostatic latent image forming unit that forms an electrostatic latent image on the charged electrophotographic photoreceptor, a developing unit that stores a developer including a toner and develops the electrostatic latent image formed on the electrophotographic photoreceptor as a toner image by the developer, and a transfer unit that transfers the toner image to a transfer medium.

14. The image forming apparatus according to claim 13, wherein the compound having a chain polymerizable functional group and a charge transporting skeleton in the same molecule is a compound having 2 or more of the chain polymerizable functional groups above in the same molecule.

15. The image forming apparatus according to claim 13, wherein the compound having a chain polymerizable functional group and a charge transporting skeleton in the same molecule is a compound represented by the following formula (A):

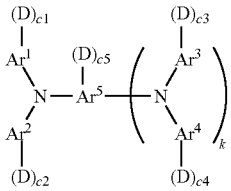

(A)

in the formula (A), $Ar^1$ to $Ar^4$ each independently represent a substituted or unsubstituted aryl group; $Ar^5$ represents a substituted or unsubstituted aryl group, or a substituted or unsubstituted arylene group; D represents a group containing a functional group having a carbon double bond; c1 to c5 independently represent 0, 1, or 2; k represents 0 or 1; and the total number of D's is 1 or more.

16. The image forming apparatus according to claim 13, wherein the compound represented by the formula (A) is the compound in which D represents a group having at least one selected from an acryloyl group, a methacryloyl group, a vinylphenyl group, an allyl group, a vinyl group, a vinyl ether group, a vinyl ester group, and derivatives thereof, and the total number of D's represents 2 or more.

17. The image forming apparatus according to claim 13, wherein the chain transfer agent is in the amount in the range of about 0.1 part by mass or more and about 30 parts by mass or less, based on 100 parts by mass of the compound having a chain polymerizable functional group and a charge transporting skeleton in the same molecule.

18. The electrophotographic photoreceptor according to claim 1, wherein the at least one chain transfer agent is a compound having 2 or more secondary thiol groups.

* * * * *